US009439265B1

(12) United States Patent
Fan

(10) Patent No.: US 9,439,265 B1
(45) Date of Patent: Sep. 6, 2016

(54) METHOD OF DRIVING PIXEL ELEMENT IN ACTIVE MATRIX DISPLAY

(71) Applicant: Nongqiang Fan, Hauppauge, NY (US)

(72) Inventor: Nongqiang Fan, Hauppauge, NY (US)

( * ) Notice: Subject to any disclaimer, the term of this patent is extended or adjusted under 35 U.S.C. 154(b) by 482 days.

(21) Appl. No.: 13/745,849

(22) Filed: Jan. 20, 2013

(51) Int. Cl.
*H01J 7/44* (2006.01)
*H05B 37/02* (2006.01)

(52) U.S. Cl.
CPC ..... *H05B 37/02* (2013.01)

(58) Field of Classification Search
CPC ..... G09G 2300/08; G09G 2360/148; G09G 2320/045; G09G 3/32
USPC ..... 315/53, 169.3; 345/76–78, 81, 82, 204
See application file for complete search history.

(56) References Cited

U.S. PATENT DOCUMENTS 7,876,314 B2 * 1/2011 Uchino ..... G09G 3/3233 345/204

* cited by examiner

*Primary Examiner* — Diana J Cheng

(57) ABSTRACT

A method of driving a pixel element an active matrix display. The method inducing a change of the bias voltage of the first transistor towards its threshold voltage with an essentially constant current provided from the semiconductor channel of a field effect transistor to cause the bias voltage of the first transistor linearly depend upon the time lapse since the light-emitting element starts to emit light. The method also includes terminating light emitted from the light-emitting element after the bias voltage of the first transistor becomes substantially close to the threshold voltage of the first transistor.

20 Claims, 48 Drawing Sheets

800

800B

600

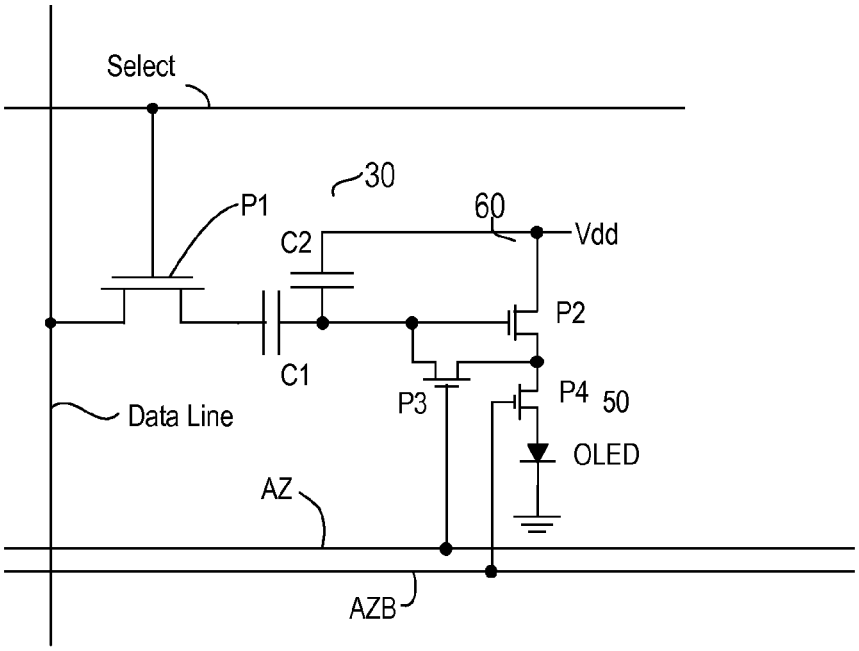
Prior Art FIG. 25A
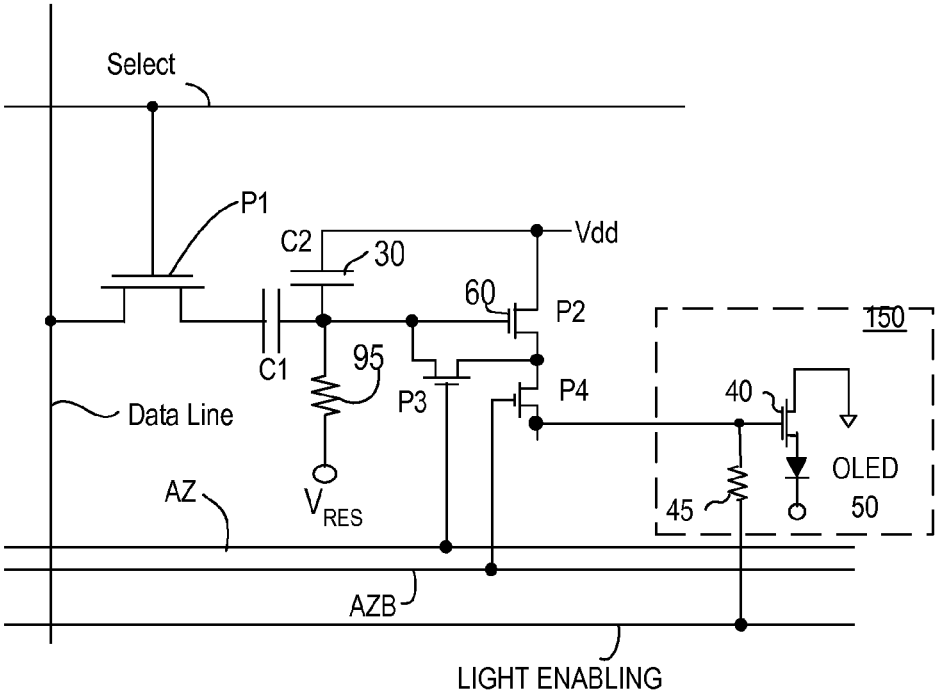
Improvement FIG. 25B

Improvement

600B

METHOD OF DRIVING PIXEL ELEMENT IN ACTIVE MATRIX DISPLAY

RELATED APPLICATIONS

The present application is [ALSO] related to the following U.S. patent applications U.S. patent application Ser. No. 12/404,326, titled "Pixel Element for Active Matrix Display"; Ser. No. 12/404,327, titled "Method of Driving Pixel Element in Active Matrix Display"; Ser. No. 12/404,328, titled "Active Matrix Display Having Pixel Element with Light-emitting Element"; and Ser. No. 12/404,329, titled "Active Matrix Display Having Pixel Element with Capacitive Element." All of these applications as originally filed are hereby incorporated by reference herein in their entirety.

The present application, however, is not filed as a Continuation Application or Continuation-In-Part Application of any U.S. patent applications.

BACKGROUND

The present invention relates generally to active matrix displays.

FIG. 1 shows a section of an active matrix display with pixel elements including light emitting diodes. The section of an active matrix display in FIG. 1 includes a matrix of pixel elements (e.g., 100AA, 100AB, 100AC, 100BA, 100BB, 100BC, 100CA, 100CB, and 100CC), an array of column conducting lines (e.g., 200A, 200B, and 200C), an array of row conducting lines (e.g., 300A, 300B, and 300C) crossing the array of column conducting lines.

A pixel element (e.g., 100BB) in the matrix of pixel elements is electrically connected to a column conducting line (e.g., 200B) and a row conducting line (e.g., 300B). The pixel element (e.g., 100BB) includes a light emitting diode 50, a driving transistor 40, a capacitive element 30, and a switching transistor 20. The light emitting diode 50 is electrically connected to a semiconductor channel of the driving transistor 40. The capacitive element 30 has a terminal electrically connected to a gate of the driving transistor 40. The gate of the driving transistor 40 is electrically connected to a column conducting line (e.g., 200B) through a semiconductor channel of the switching transistor 20. The gate of the switching transistor 20 is electrically connected to a row conducting line (e.g., 300B).

During operation, a pixel element (e.g., 100BB) generally can be either in a charging mode or in a light-emitting mode. When the pixel element (e.g., 100BB) is in the charging mode, a selection signal (e.g., a selection voltage) on the row conducting line (e.g., 300B) drives the switching transistor 20 into a conducting state. When the switching transistor 20 is in the conducting state, a data signal (e.g., a data voltage) on a column conducting line (e.g., 200B) can set a gate voltage at the gate of the driving transistor 40 to a target voltage value. When the pixel element (e.g., 100BB) is in the light-emitting mode, a deselect signal (e.g., a deselect voltage) on the row conducting line (e.g., 300B) drives the switching transistor 20 into a non-conducting state. When the switching transistor 20 is in the non-conducting state, a gate voltage at the gate of the driving transistor 40 can be substantially maintained.

In general, a driving current passing through the light emitting diode 50 is determined by the gate voltage at the gate of the driving transistor 40. But, the driving current passing through the light emitting diode 50 also depends on some individual properties of the driving transistor 40. For example, the driving current passing through the light emitting diode 50 can depend on the threshold voltage and the carrier mobility of the driving transistor 40. The driving transistor 40 in different pixel elements may have different properties. Therefore, in certain applications, it is desirable to provide a pixel element that can compensate property variations among different pixel elements.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

FIG. 25A and FIG. 25 B are respectively a prior art pixel element and the corresponding modified pixel element in accordance with some embodiments.

Figure 1:
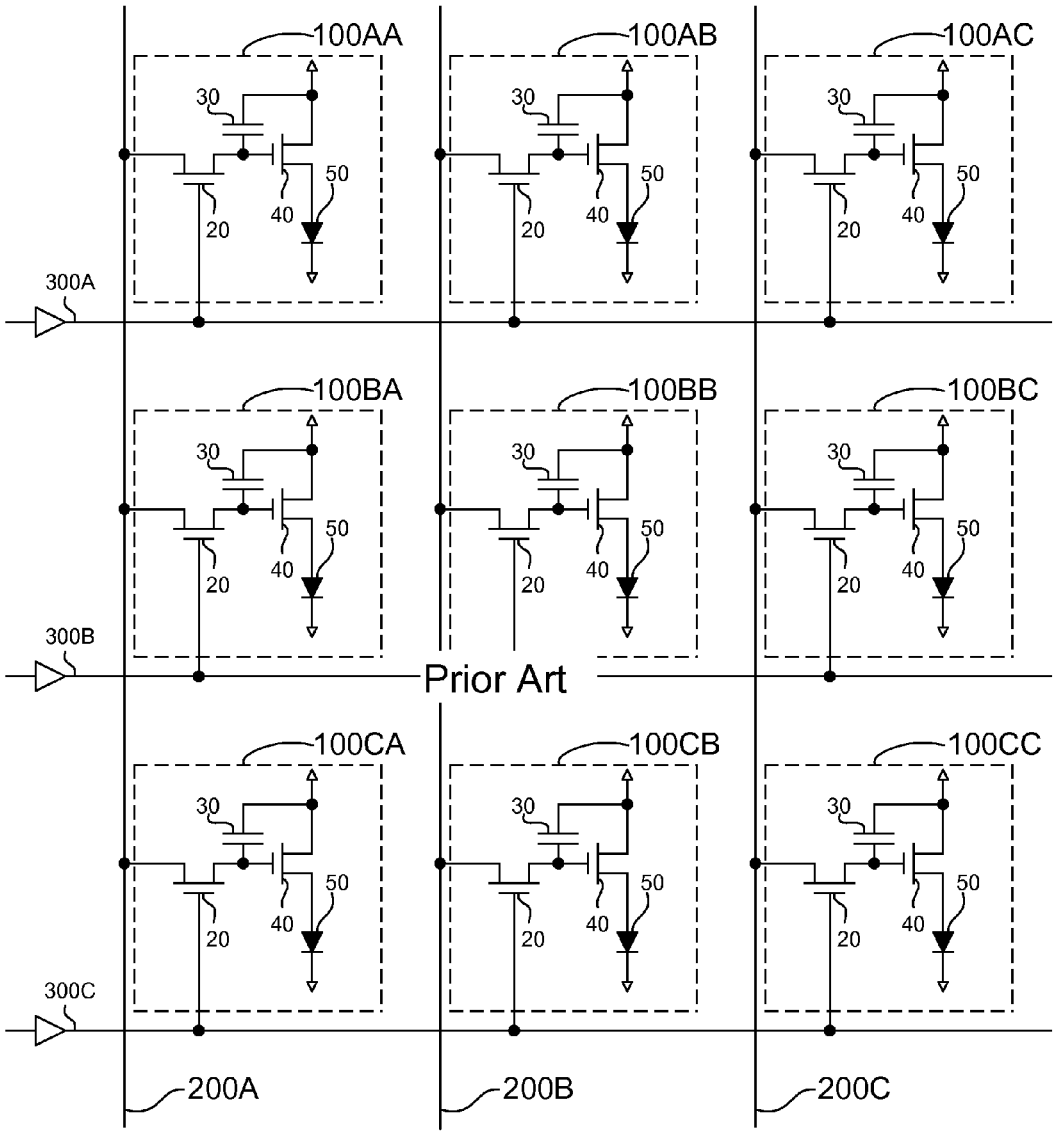
Prior Art FIG. 1
FIG. 1 shows a section of an active matrix display with pixel elements including light emitting diodes.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Figure 2:
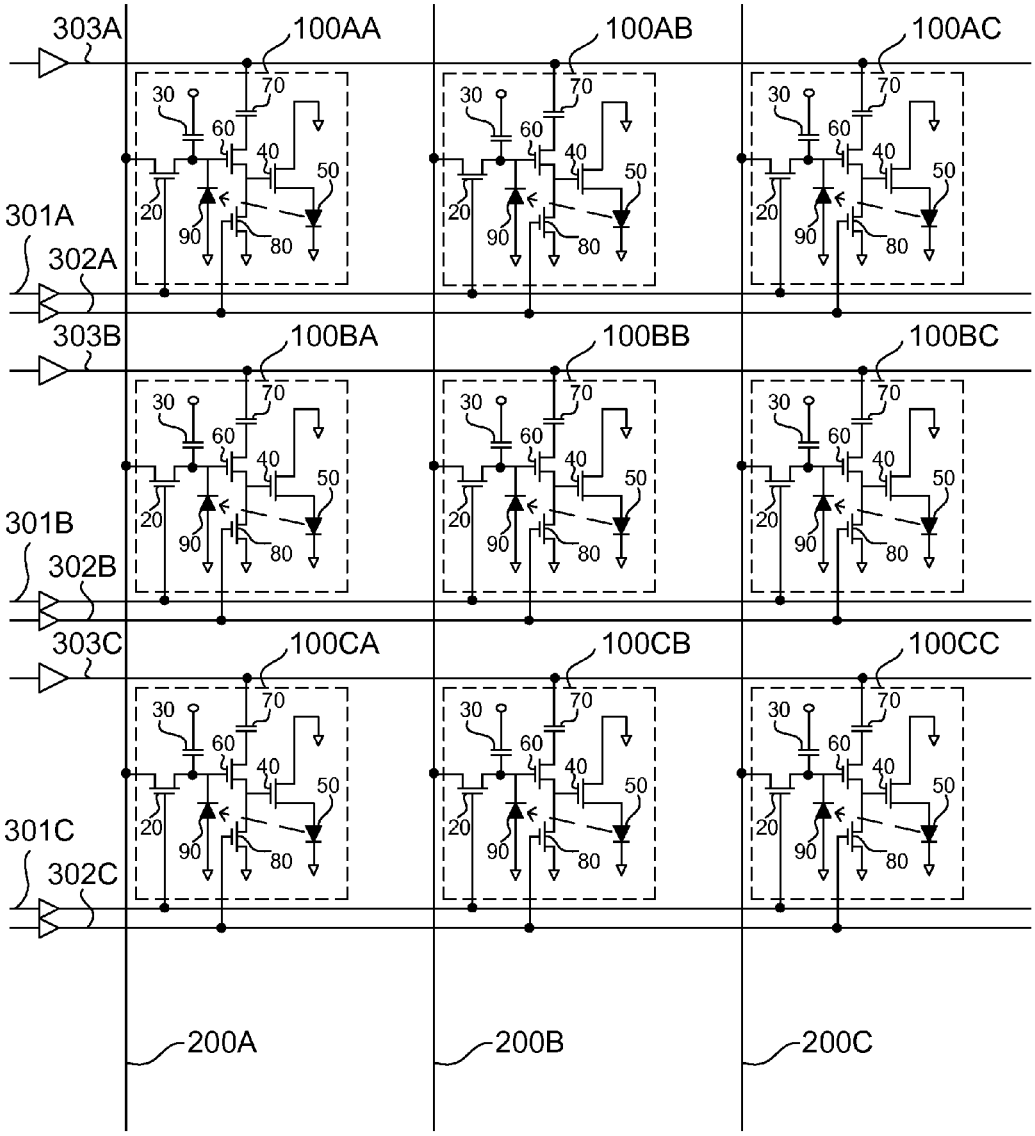
FIG. 2 shows one implementation of an active matrix display that includes a pixel element having a light-emitting element and a photo-detecting element.

FIG. 2 shows one implementation of an active matrix display that includes a pixel element having a light-emitting element and a photo-detecting element. The section of an active matrix display in FIG. 2 includes a matrix of pixel elements (e.g., 100AA, 100AB, 100AC, 100BA, 100BB, 100BC, 100CA, 100CB, and 100CC), an array of column conducting lines (e.g., 200A, 200B, and 200C), an array of row conducting lines (e.g., 301A, 302A, 303A, 301B, 302B, 303B, 301C, 302C, and 303C) crossing the array of column conducting lines.

A pixel element (e.g., 100BB) in the matrix of pixel elements is electrically connected to a column conducting line (e.g., 200B), a first row conducting line (e.g., 301B), a second row conducting line (e.g., 302B), and a third row conducting line (e.g., 303B). The pixel element (e.g., 100BB) is also shown specifically in FIG. 3A.

Figure 3A:
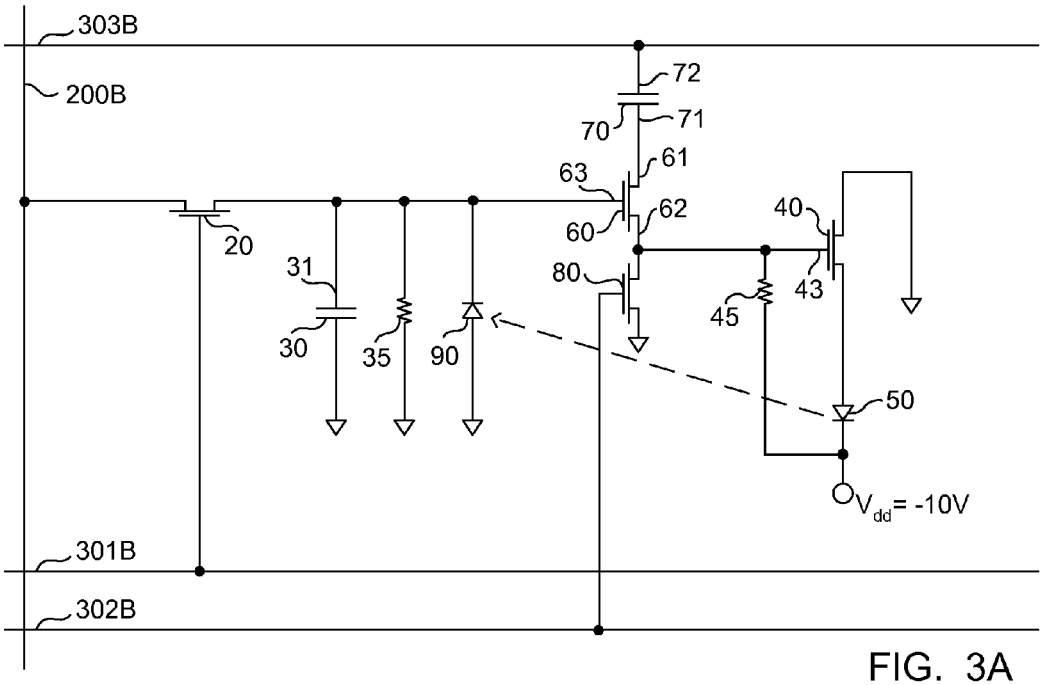
FIGS. 3A-3D illustrate implementations of a pixel element that includes at least a first capacitive element, a first transistor, a second transistor, a second capacitive element, a driving transistor, a light-emitting element, and a photo-detecting element.

In FIG. 3A, the pixel element (e.g., 100BB) includes a first capacitive element 70, a first transistor 60, a second transistor 80, a second capacitive element 30, a driving transistor 40, a light-emitting element 50, a photo-detecting element 90, and a switching transistor 20. The first transistor 60 has a semiconductor channel. The first terminal 61 of the semiconductor channel of the first transistor 60 is electrically connected to a first terminal 71 of the first capacitive element 70. The second transistor 80 has a semiconductor channel electrically connected to a second terminal 62 of the semiconductor channel of the first transistor 60. The second capacitive element 30 has a first terminal 31 electrically connected to a gate 63 of the first transistor 60. The driving transistor 40 has a gate 43 electrically connected to the second terminal 62 of the semiconductor channel of the first transistor 60. The light-emitting element 50 is electrically connected to a semiconductor channel of the driving transistor 40. The photo-detecting element 90 is electrically connected to the second capacitive element 30 and receives a portion of the light emitted from the light-emitting element 50. The switching transistor 20 has a semiconductor channel that is electrically connected between the first terminal 31 of the second capacitive element 30 and a column conducting line (e.g., 200B). The switching transistor 20 has a gate electrically connected to a first row conducting line (e.g., 301B). The second transistor 80 has a gate electrically connected to a second row conducting line (e.g., 302B). The second terminal 72 of the first capacitive element 70 is electrically connected to a third row conducting line (e.g., 303B).

During operation, a pixel element (e.g., 100BB) generally can be in threshold-setting mode, data-input mode, or optical-feedback mode. When the pixel element (e.g., 100BB) is in the threshold-setting mode, (1) a signal is applied to the second row conducting line (e.g., 302B) to drive the second transistor 80 into the low-impedance state, and (2) signals are applied to the first row conducting line (e.g., 301B) and/or the third row conducting line (e.g., 303B) to set the bias voltage of the first transistor 60 to be substantially near the threshold of the first transistor 60. In one implementation, the first transistor 60 is driven into the low-impedance state to enable the current to pass through both the semiconductor channel of the first transistor 60 and the semiconductor channel of the second transistor 80. This current will change the voltage across the first capacitive element 70 until the first transistor 60 is biased near its threshold.

When the bias voltage is changing towards the threshold, the first transistor 60 will be changing towards the high-impedance state. When the bias voltage reaches the threshold, the voltage change across the first capacitive element 70 can be essentially stopped. That is, the first capacitive element 70 will be charged or discharged until $V_{s1}-V_{g1}\approx V_{th}$, where $V_{g1}$ is the voltage at the gate of the first transistor 60, $V_{s1}$ is the voltage at the source of the first transistor 60, and $V_{th}$ is the threshold voltage of the first transistor 60. Here, the voltage $V_{s1}$ at the source of the first transistor 60 is related to the voltage $V_{ref1}$ at the second terminal 72 of the first capacitive element 70 and the voltage $V_{C1}$ across the first capacitive element: $V_{s1}=V_{ref1}-V_{C1}$. Therefore, in the threshold-setting mode, the voltage across the first capacitive element $V_{C1}$ will be charge or discharged to a value $V_{C1}\approx V_{ref1}-(V_{g1}+V_{th})$.

When the pixel element (e.g., 100BB) is in the data-input mode, signals are applied to the first row conducting line (301B) and/or the third row conducting line (303B) to drive the first transistor 60 into the high-impedance state. These signals are applied to set the bias voltage of the first transistor 60 to a value that is different from the threshold of the first transistor 60 by an offset value. Assume that the voltage across the first capacitive element is maintained at $V_{C1}$, if the voltage at the gate of the first transistor 60 is $V_{g2}$ and the voltage at the second terminal of terminal of the first capacitive element 70 is $V_{ref2}$, then, the voltage at the source of the first transistor 60 will be $V_{s2}=V_{ref2}-V_{C1}$. Consequently, the first transistor 60 will be biased at a voltage $V_{s2}-V_{g2}=V_{ref2}-V_{C1}-V_{g2}$. This bias voltage is set to be different from the threshold voltage $V_{th}$ such that $V_{s2}-V_{g2}<V_{th}$ to keep the first transistor 60 at the high-impedance state. More specifically, this bias voltage is smaller than the threshold voltage $V_{th}$ by an initial threshold offset $$V^0_{offset}=V_{th}-(V_{s2}-V_{g2})=(V_{g2}-V_{g1})-(V_{ref2}-V_{ref1}).$$

Later on, this initial threshold offset $V^0_{offset}$ can be used to substantially determine the total amount of light emitted from the light-emitting element 50.

In one implementation, after the pixel element (e.g., 100BB) is set to the data-input mode and before light is emitted from the light-emitting element 50, both the voltage across the first capacitive element 70 and the voltage across the second capacitive element 30 are essentially maintained at constant. In one implementation as shown in FIG. 3A, the second transistor 80 is kept at the low-impedance state with a signal on the second row conducting line (e.g., 302B) to keep the driving transistor 40 at the non-conducting state to prevent light from emitted from the light-emitting element 50.

When the pixel element (e.g., 100BB) is in optical-feedback mode, the light-emitting element 50 is set to emit light. In one implementation as shown in FIG. 3A, a signal is applied to the second row conducting line (e.g., 302B) to drive the second transistor 80 into the high-impedance state. In FIG. 3A, the pull-down resistor 45 is electrically connected between the gate of the driving transistor 40 and a voltage $V_{dd}$. Under the condition that the first transistor 60 is at the high-impedance state, when the second transistor 80 is changed to the high-impedance state, the voltage at the gate of the driving transistor 40 is lowered towards $V_{dd}$ and the driving transistor 40 is driven into a conducting state. The current passing through the semiconductor channel of the driving transistor 40 will drive the light-emitting element 50 to emit light. A portion of the light emitted from the light-emitting element 50 is received by the photo-detecting element 90. The photo-induced-current $i_{ph}(t)$ generated by the photo-detecting element 90 can be proportional to $I_0(t)$, the intensity of the light emitted from the light-emitting element 50. That is, $i_{ph}(t)=kI_0(t)$, where k is a coupling coefficient.

In one implementation as shown in FIG. 3A, the photo-induced-current $i_{ph}(t)$ will cause a voltage change across the second capacitive element 30. In one implementation, the changing rate of the voltage at the gate of the first transistor 60 is proportional to the photo-induced-current current $i_{ph}(t)$. That is, $dV_g(t)/dt=-i_{ph}(t)/C_g$, where $C_g$ is the capacitance of the second capacitive element 30. The total amount of charge $Q_{ph}(t)$ deposited or removed from the second capacitive element 30 is proportional to the total amount of light $L_{total}$ emitted from the light-emitting element 50. That is, $|Q_{ph}(t)|=\int i_{ph}(t)dt=k\int I_0(t)dt=k\ L_{total}$. The total voltage change $\Delta V_g(t)=|Q_{ph}(t)|/C_g$ at the gate of the first transistor 60 will change the bias voltage $V_s-V_g$ of the first transistor. When the total voltage change $\Delta V_g(t)$ at the gate of the first transistor 60 exceeds the initial threshold offset $V^0_{offset}$, the first transistor 60 will change from the high-impedance state to the low-impedance state. The current passing through the semiconductor channel of the first transistor 60 will cause a voltage change across the pull-down resistor 45 and cause a voltage increase at the gate of the driving transistor 40. When the driving transistor 40 is driven into non-conducting state, light emission from the light-emitting element 50 will be stopped. Consequently, the total amount of light $L_{total}$ emitted from the light-emitting element 50 is directly related to the initial threshold offset $V^0_{offset}$. That is, $L_{total}=(C_g/k)V^0_{offset}$.

In operation, pixel elements in the active matrix display of FIG. 2 can be driven in the following manner. A row of pixel elements (e.g., 100AA, 100AB, and 100AC) is selected and the other rows of elements (e.g., the row of pixel elements 100BB, 100BB, and 100BC, and the row of pixel elements 100CB, 100CB, and 100CC) are kept at optical-feedback mode. Each of the selected pixel elements (e.g., 100AA, 100AB, or 100AC) is first set to threshold-setting mode, and then set to data-input mode for setting the bias voltage of the first transistor 60 at a voltage that is offset from the threshold voltage $V_{th}$ by a corresponding initial threshold offset $V^0_{offset}$. The total amount of light emitted from each light-emitting element can be substantially determined by the corresponding initial threshold offset $V^0_{offset}$. Finally, each of the selected pixel elements (e.g., 100AA, 100AB, or 100AC) is set to optical-feedback mode.

In operation, after one row of pixel elements (e.g., 100AA, 100AB, and 100AC) is selected, the next row of pixel elements (e.g., 100BA, 100BB, and 100BC) is selected and the other rows of elements (e.g., the row of pixel elements 100AB, 100AB, and 100AC, and the row of pixel elements 100CB, 100CB, and 100CC) are kept at optical-feedback mod. In this manner, each row of pixel elements in the matrix is selected sequentially. After the last row of pixel elements in the matrix is selected, a complete frame of image can be formed.

In one implementation as shown in FIG. 3A, the pixel element (e.g., 100BB) may include a resistor 35 with a terminal connected to the gate of the first transistor 60. During optical-feedback mode, the resistor 35 may pull down the voltage at the gate of the first transistor 60 to ensure the first transistor 60 be kept at the low-impedance state after light emission from the light-emitting element 50 is stopped. In some implementations, when a reverse-biased photo-diode is used as the photo-detecting element 90, the leakage resistance of the reverse-biased photo-diode can possibly be used as the resistor 35. In another implementation, a slow-voltage-ramp can be applied to the second terminal of the first capacitive element 70 with the third row conducting line (e.g., 303B) to ensure the first transistor 60 be kept at the low-impedance state after light emission from the light-emitting element 50 is stopped. For example, the voltage $V_{ref}(t)$ at the second terminal of the first capacitive element 70 can take the form $V_{ref}(t)=V_{ref2}+\alpha t$, where $\alpha$ is a small positive number. In above implementations, the current passing through the resistor 35 or the change of voltage $V_{ref}(t)$ due to the slow—voltage-ramp can cause some deviations in the relationship between $L_{total}$ and $V_{offset}$ That is, in these circumstances, the equation $L_{total}=(C_g/k)\ V^0_{offset}$ may need to include some corrections. In addition, in some implementations, a resistor 75 (not shown in FIG. 3A) with a terminal connecting to the source of the first transistor 60 may be used as a replacement for the resistor 35. The resistor 75 may pull up the voltage at the source of the first transistor 60 to ensuring the first transistor 60 be kept at the low-impedance state after light emission from the light-emitting element 50 is stopped.

In some implementations, when the pixel element (e.g., 100BB) in FIG. 3A is in the threshold-setting mode, before the voltage $V_{g1}$ is applied to the gate of the first transistor 60 and the voltage $V_{ref1}$ is applied to the second terminal of the first capacitive element 70, it maybe necessary to drive the first transistor 60 into the conduction-state with another voltage $V_{g0}$ applied to the gate of the first transistor 60 and/or another voltage $V_{ref0}$ applied to the second terminal of the first capacitive element 70. Voltages $V_{g0}$ and $V_{ref0}$ can be selected to ensure the first transistor 60 be driven into the conduction-state irrespective the value of the voltage $V_{C0}$ across the first capacitive element 70 just before the pixel element (e.g., 100BB) is changed into threshold-setting mode.

Figure 3B:
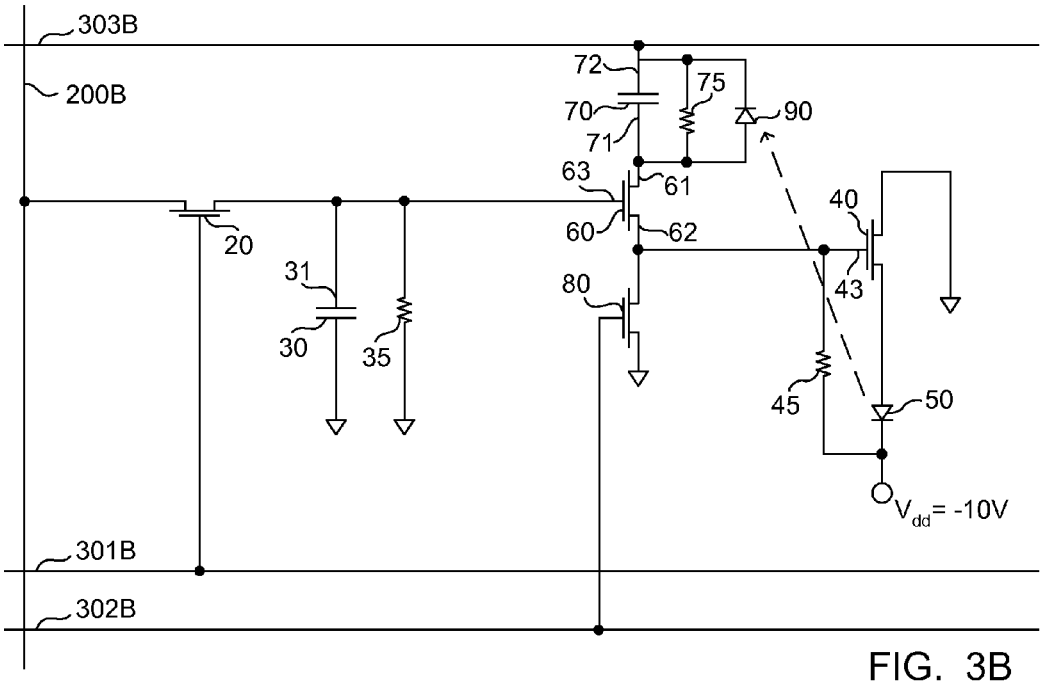

FIG. 3B shows another implementation of the pixel element (e.g., 100BB). The pixel element (e.g., 100BB) in FIG. 3B is similar to the pixel element (e.g., 100BB) in FIG. 3A, except that the photo-detecting element 90 in FIG. 3B is electrically connected to the first capacitive element 70, whereas the photo-detecting element 90 in FIG. 3A is electrically connected to the second capacitive element 30. When the pixel element (e.g., 100BB) is in optical-feedback mode, a portion of the light emitted from the light-emitting element 50 is received by the photo-detecting element 90. The photo-induced-current $i_{ph}(t)$ generated by the photo-detecting element 90 will cause a voltage change across the first capacitive element 70. That is, $dV_C(t)/dt=-i_{ph}(t)/C_s$, where $V_C(t)$ is the voltage across the first capacitive element 70 and $C_s$ is the capacitance of the first capacitive element 70. It can be shown that when the total voltage change across the first capacitive element $\Delta V_C(t))=\int i_{ph}(t)/C_s$ exceeds the initial threshold offset $V^0_{offset}$, the first transistor 60 will change from the high-impedance state to the low-impedance state and the driving transistor 40 will be driven into the non-conducting state. It can also be shown that the total amount of light $L_{total}$ emitted from the light-emitting element 50 is directly related to the initial threshold offset $V^0_{offset}$. More specifically, $L_{total}=(C_s/k)V^0_{offset}$, where k is a coupling coefficient between the photo-detecting element 90 and the light-emitting element 50.

In addition, in some implementations, the pixel element (e.g., 100BB) may include a resistor 35 with a terminal connected to the gate of the first transistor 60 to ensure the first transistor 60 be kept at the low-impedance state after light emission from the light-emitting element 50 is stopped. In some implementations, the pixel element (e.g., 100BB) may include a resistor 75 with a terminal connecting to the source of the first transistor 60 to ensure the first transistor 60 be kept at the low-impedance state after light emission from the light-emitting element 50 is stopped. In still some implementations, the pixel element (e.g., 100BB) may include both a resistor 35 and a resistor 75.

Figure 3C:
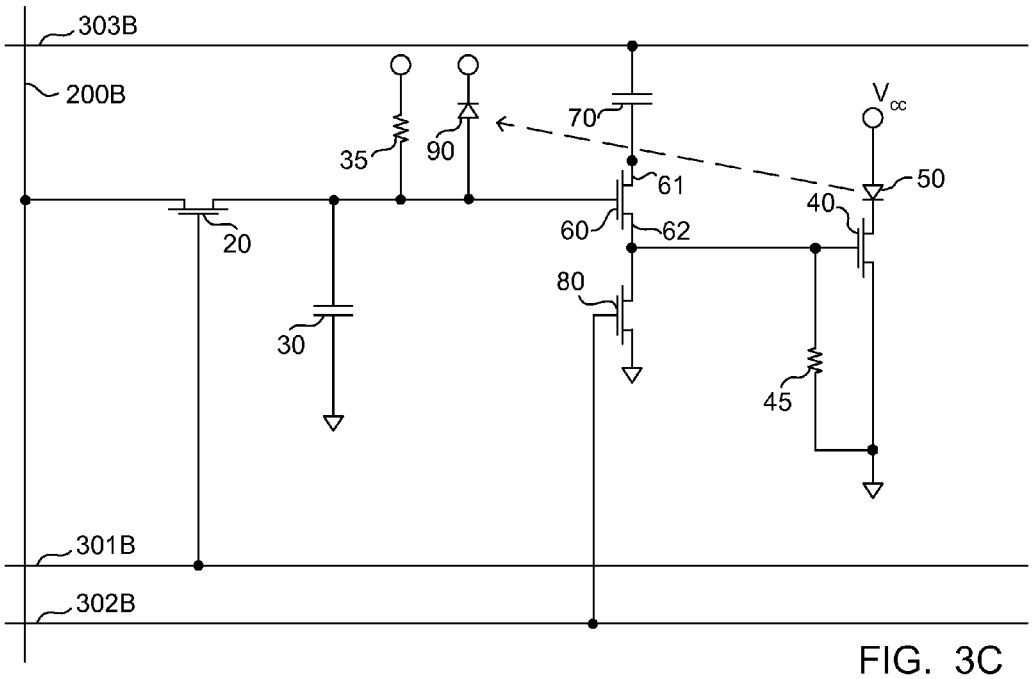

FIG. 3C shows another implementation of the pixel element (e.g., 100BB) in which the driving transistor 40 is a NFET. Like the pixel element in FIG. 3A, the pixel element in FIG. 3C generally can also be in threshold-setting mode, data-input mode, or optical-feedback mode. While in threshold-setting mode, the pixel element in FIG. 3C operates similarly as the pixel element in FIG. 3A. At the end of the threshold-setting mode, the voltage across the first capacitive element $V_{C1}$ will be change to a value $V_{C1}\approx V_{ref1}-(V_{g1}+V_{th})$, where $V_{g1}$ is the voltage at the gate of the first transistor 60 and $V_{ref1}$ is the voltage at the second terminal of terminal of the first capacitive element 70.

In data-input mode and optical-feedback mode, however, the pixel element in FIG. 3C operates somewhat differently from the pixel element in FIG. 3A. When the pixel element in FIG. 3C is in data-input mode, the second transistor 80 is first driven into the high-impedance state with a signal on the second row conducting line 302B, and then, the first transistor 60 is driven into the low-impedance state with signals applied to the first row conducting line (301B) and/or the third row conducting line (303B). These signals are applied to set the bias voltage of the first transistor 60 to a value that is different from the threshold of the first transistor 60 by an offset value. Assume that the voltage across the first capacitive element is maintained at $V_{C1}$, if the voltage at the gate of the first transistor 60 is $V_{g2}$, the voltage at the second terminal of terminal of the first capacitive element 70 is $V_{ref2}$, then, the first transistor 60 will be biased at a voltage $V_{s2}-V_{g2}=V_{ref2}-V_{C1}-V_{g2}$. This bias voltage is set to be different from the threshold voltage $V_{th}$ such that $V_{s2}-V_{g2}>V_{th}$ to keep the first transistor 60 at the low-impedance state. More specifically, this bias voltage is larger than the threshold voltage $V_{th}$ by an initial threshold offset $$V^0_{offset}=(V_{s2}-V_{g2})-V_{th}=(V_{ref2}-V_{ref1})-(V_{g2}-V_{g1}).$$

When the pixel element in FIG. 3C is in optical-feedback mode, the photo-induced-current current $i_{ph}(t)$ generated by the photo-detecting element 90 will cause a voltage change at the gate of the first capacitive element 70. That is, $dV_g(t)/dt=i_{ph}(t)/C_g$, where $C_g$ is the capacitance of the second capacitive element 30. It can be shown that when the total voltage change $\Delta V_g(t))=\int i_{ph}(t)/C_g$ at the gate of the first capacitive element 70 exceeds the initial threshold offset $V^0_{offset}$, the first transistor 60 will change from the low-impedance state to the high-impedance state and the driving transistor 40 will be driven into the non-conducting state. It can also be shown that the total amount of light $L_{total}$ emitted from the light-emitting element 50 is directly related to the initial threshold offset $V^0_{offset}$. More specifically, $L_{total}=(C_g/k)\ V^0_{offset}$, where k is a coupling coefficient between the photo-detecting element 90 and the light-emitting element 50.

Figure 3D:
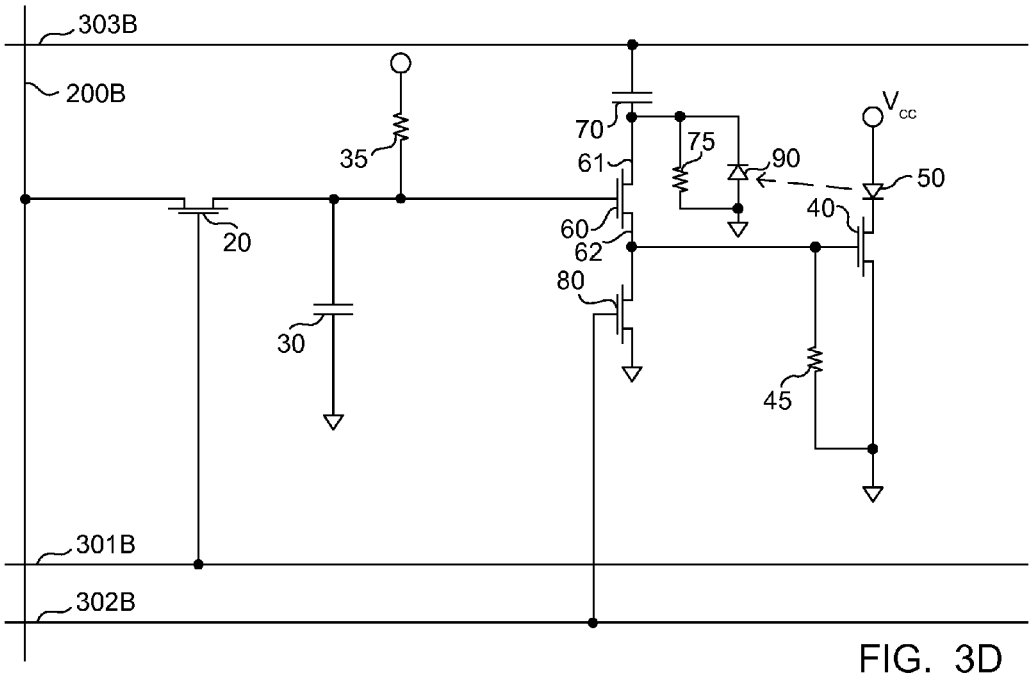

FIG. 3D shows another implementation of the pixel element (e.g., 100BB) in which the driving transistor 40 is a NFET. The pixel element (e.g., 100BB) in FIG. 3D is similar to the pixel element (e.g., 100BB) in FIG. 3C, except that the photo-detecting element 90 in FIG. 3D is electrically connected to the first capacitive element 70. During data-input mode, the bias voltage of the first transistor 60 is set to a value that is different from the threshold voltage $V_{th}$ by an initial threshold offset $V^0_{offset}$. During optical-feedback mode, the photo-induced-current generated by the photo-detecting element will cause a voltage change across the first capacitive element 70, and the light-emitting element 50 will emit light until the total voltage change across the first capacitive element 70 exceeds the initial threshold offset $V^0_{offset}$. It can also be shown that the total amount of light $L_{total}$ emitted from the light-emitting element 50 is directly related to the initial threshold offset $V^0_{offset}$. More specifically, $L_{total}=(C_s/k)\ V^0_{offset}$, where k is a coupling coefficient between the photo-detecting element 90 and the light-emitting element 50, and $C_s$ is the capacitance of the first capacitive element 70.

Figure 4A:
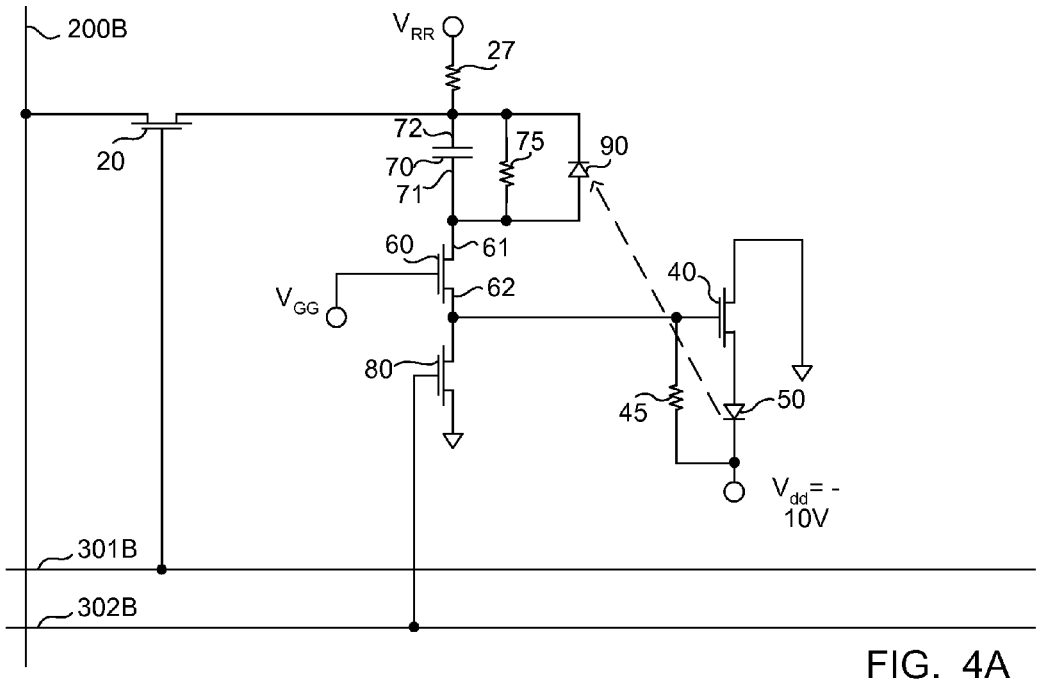
FIGS. 4A-4B illustrate implementations of a pixel element in which the second terminal of the first capacitive element is electrically connected to a column conducting line through the switching transistor.
Figure 4B:
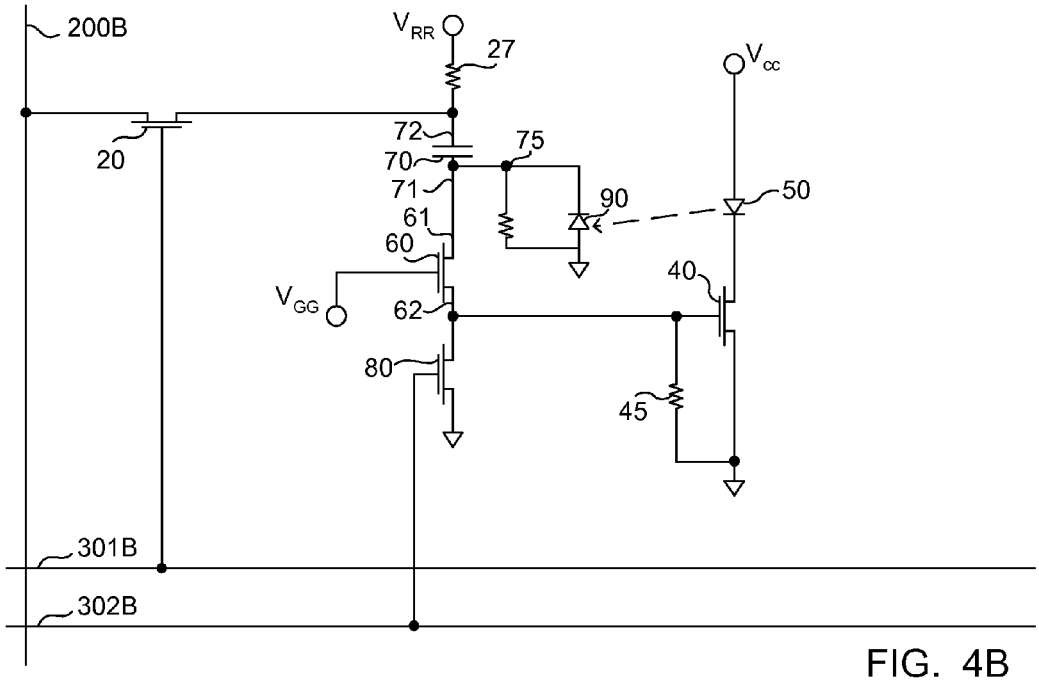

FIGS. 4A-4B illustrate another implementation of the pixel element (e.g., 100BB) in which the second terminal 72 of the first capacitive element 70 is electrically connected to a column conducting line (e.g., 200B) through the switching transistor 20. The second terminal 72 of the first capacitive element 70 is electrically connected to a common reference voltage $V_{RR}$ through a resistive element 27. The gate of the first transistor 60 is connected to a gate reference voltage $V_{GG}$. In threshold-setting mode and data-input mode, signals on the column conducting line (e.g., 200B) are applied to the second terminal 72 of the first capacitive element 70 through the switching transistor 20, and the bias voltage of the first transistor 60 is set to be different from the threshold voltage $V_{th}$ by an initial threshold offset $V^0_{offset}$. In optical-feedback mode, the switching transistor 20 is driven into non-conducting state with a signal applied on the first row conducting line 301B, and the second terminal of the first capacitive element 70 is isolated from the column conducting line 200B. During optical-feedback mode, the current generated by the photo-detecting element will cause a voltage change across the first capacitive element 70, and the light-emitting element 50 will emit light until the total voltage change across the first capacitive element 70 exceeds the initial threshold offset $V^0_{offset}$.

Figure 5A:
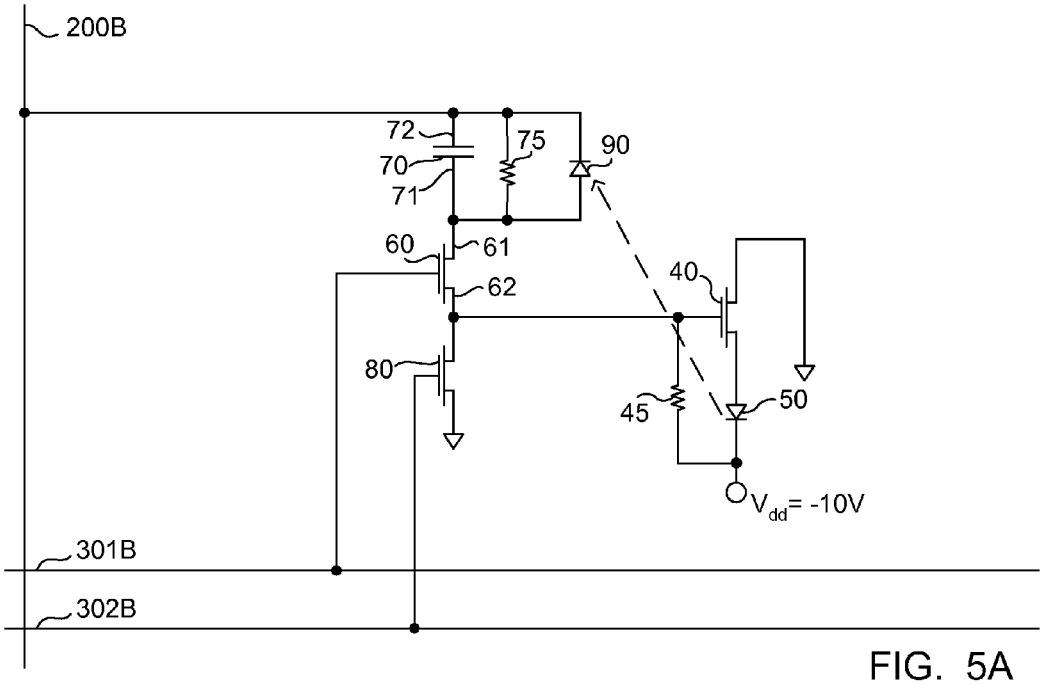
FIG. 5A shows another implementation of a pixel element in which the second terminal of the first capacitive element is electrically connected to a column conducting line directly.

FIG. 5A shows another implementation of the pixel element (e.g., 100BB) in which the second terminal 72 of the first capacitive element 70 is electrically connected to a column conducting line (e.g., 200B) directly. The gate of the first transistor 60 is connected to the first row conducting line (e.g., 301B). The gate of the second transistor 80 is connected to the second row conducting line (e.g., 302B). The pixel element (e.g., 100BB) generally can be in threshold-setting mode, data-input mode, standby mode, or optical-feedback mode.

When the pixel element (e.g., 100BB) is in threshold-setting mode, data-input mode, or standby mode, the second transistor 80 is drive to the low-impedance state with a signal applied to the second row conducting line 302B. When the pixel element (e.g., 100BB) is in optical-feedback mode, the second transistor 80 is drive to the high-impedance state with a signal applied to the second row conducting line 302B.

In threshold-setting mode, voltage $V_{g1}$ is applied to the gate of the first transistor 60 and voltage $V_{ref1}$ is applied to the second terminal 72 of the first capacitive element 70 to set the bias voltage of the first transistor 60 to be substantially near its threshold. In threshold-setting mode, the voltage across the first capacitive element $V_{C1}$ will be changed to a value $V_{C1}=V_{ref1}-(V_{g1}+V_{th})$. Certainly, before voltage $V_{g1}$ and voltage $V_{ref1}$ are applied to the pixel element (e.g., 100BB), other voltages can be applied to the pixel element to ensure that the first transistor 60 is at the low-impedance state when voltage $V_{g1}$ and voltage $V_{ref1}$ are applied.

In standby mode, a voltage $V_{g_OFF}$ is applied to the gate of the first transistor 60 to drive the first transistor 60 into the high-impedance state. During standby mode, there is no light emitted from the light-emitting element 50, and the voltage across the first capacitive element $V_{C1}$ will be maintained. The voltage $V_{g_OFF}$ is selected to keep the first transistor 60 at the high-impedance state even if the voltage applied to the second terminal 72 of the first capacitive element 70 are constantly changing to different values at different time because of a column conducting line (e.g., 200B).

In data-input mode, voltage $V_{GG}$ is applied to the gate of the first transistor 60 and voltage $V_{REF}$ is applied to the second terminal 72 of the first capacitive element 70 to keep the first transistor 60 at the high-impedance state and to set the bias voltage the first transistor 60 differ from the threshold voltage $V_{th}$ by an initial threshold offset $$V^0_{offset}=(V_{GG}-V_{g1})-(V_{REF}-V_{ref1}).$$

In optical-feedback mode, the second transistor 80 is drive to the high-impedance state and the driving transistor 40 is driven into to the conducting state. During optical-feedback mode, the photo-current generated by the photo-detecting element will cause a voltage change across the first capacitive element 70, and the light-emitting element 50 will emit light until the total voltage change across the first capacitive element 70 exceeds the initial threshold offset $V^0_{offset}$.

Figure 5B:
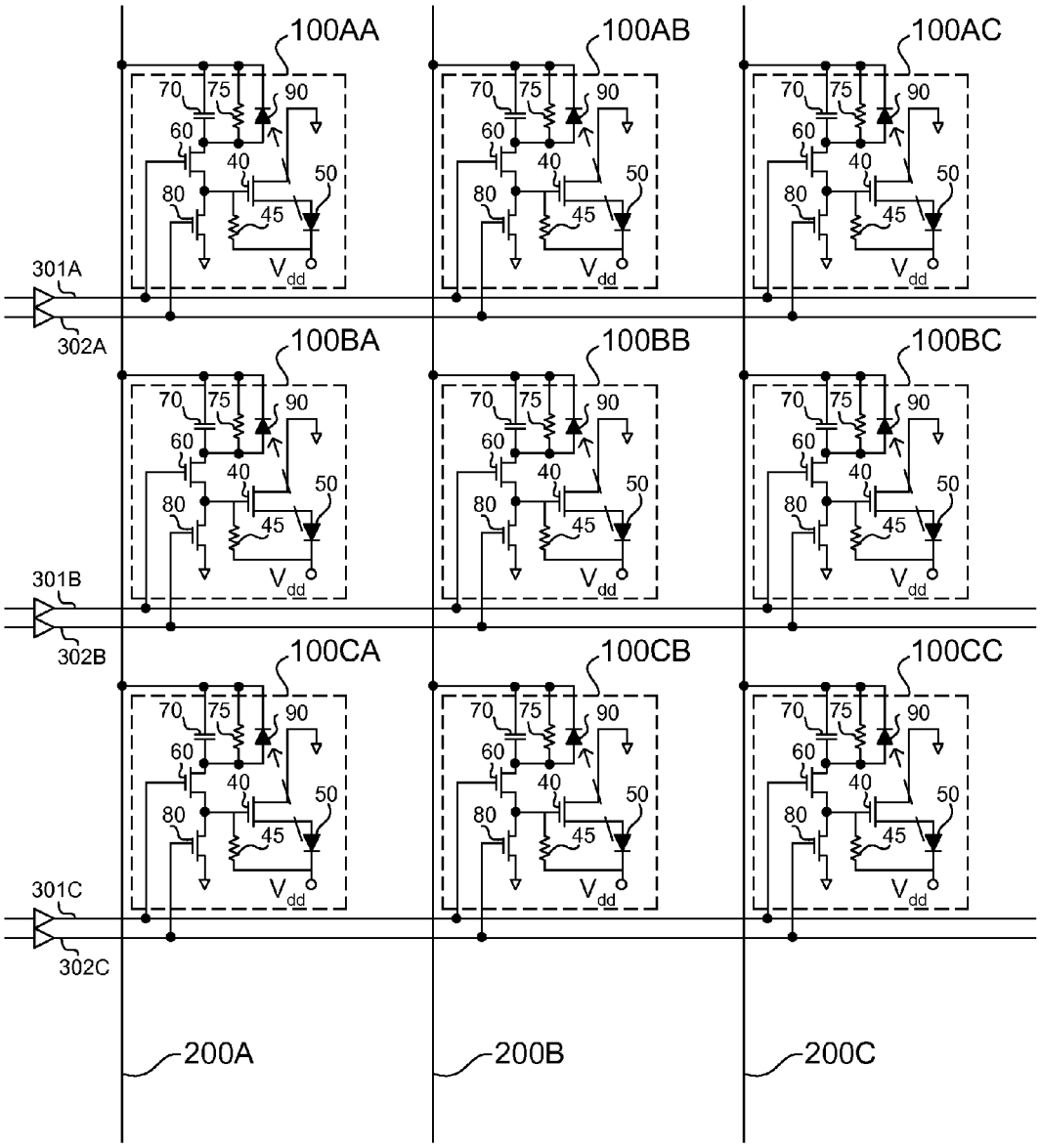
FIG. 5B shows one implementation of an active matrix display in which the pixel element of FIG. 5A is used as the pixel element in the matrix.

FIG. 5B shows one implementation of an active matrix display in which the pixel element of FIG. 5A is used as the pixel element in the matrix. In FIG. 5B, a pixel element (e.g., 100BB) in the matrix of pixel elements is electrically connected to a column conducting line (e.g., 200B), a first row conducting line (e.g., 301B), and a second row conducting line (e.g., 302B).

In operation, pixel elements in the active matrix display of FIG. 5B can be driven in the following manner. At time $T_1$, a row of pixel elements (e.g., 100AA, 100AB, and 100AC) is selected to set to threshold-setting mode. Voltage $V_{g1}(A)$ is applied to the first row conducting line 301A connecting to this selected row. Voltages $V_{ref1}$ (AA), $V_{ref1}$ (AB), and $V_{ref1}$ (AC) are respectively applied to the column conducting line 200A, 200B, and 200C. In addition, the other rows of elements (e.g., the row of pixel elements 100BA, 100BB, and 100BC, or the row of pixel elements 100CA, 100CB, and 100CC) are set to standby mode with voltage $V_{g_OFF}$ are applied to the corresponding first row conducting line (e.g., 301B, or 301C).

At time $T_2$, another row of pixel elements (e.g., 100BA, 100BB, and 100BC) is selected to set to threshold-setting mode. Voltage $V_{g1}(B)$ is applied to the first row conducting line 301A connecting to this selected row. Voltages $V_{ref1}$ (BA), $V_{ref1}$ (BB), and $V_{ref1}$ (BC) are respectively applied to the column conducting line 200A, 200B, and 200C. In addition, the other rows of elements (e.g., the row of pixel elements 100AA, 100AB, and 100AC, or the row of pixel elements 100CA, 100CB, and 100CC) are set to standby mode with voltage $V_{g_OFF}$ are applied to the corresponding first row conducting line (e.g., 301A, or 301C).

At time $T_3$, the next row of pixel elements (e.g., 100CA, 100CB, and 100CC) is selected to set to threshold-setting mode. Voltage $V_{g1}(C)$ is applied to the first row conducting line 301A connecting to this selected row. Voltages $V_{ref1}$ (CA), $V_{ref1}$ (CB), and $V_{ref1}$ (CC) are respectively applied to the column conducting line 200A, 200B, and 200C. In addition, the other rows of elements (e.g., the row of pixel elements 100AA, 100AB, and 100AC, or the row of pixel elements 100BA, 100BB, and 100BC) are set to standby mode with voltage $V_{g_OFF}$ are applied to the corresponding first row conducting line (e.g., 301A, or 301B).

At time $T_4$, pixel elements in all rows are set to data-input mode with (1) a voltage $V_{GG}$ applied to the first row conducting line connecting to each of these rows (i.e., 301A, 301B, and 301C), and (2) a voltage $V_{REF}$ applied to the column conducting line connecting to each of column of pixel elements (i.e., 200A, 200B, and 200C).

At time $T_5$, pixel elements in all rows are set to optical-feedback mode with a signal applied to the second row conducting line in each row (i.e., 302A, 302B, and 302C) to drive the second transistor 80 to the high-impedance state and to initiate the light emitting process for the light-emitting element 50 in each of these pixel elements. In this manner, a complete frame of image can be formed. The total amount of light $L_{total}$ emitted from the light-emitting element 50 in each pixel element (e.g., 100AB) is directly related to the initial threshold offset $V^0_{offset}$ in each pixel element (e.g., 100AB). As examples, for pixel element 100AB, the total amount of light emitted $L_{total}(AB)=(C_s/k)V^0_{offset}(AB)$, where k is a coupling coefficient between the photo-detecting element 90 and the light-emitting element 50 in pixel element 100AB, and $C_s$ is the capacitance of the first capacitive element 70. In addition, the initial threshold offset $V^0_{offset}$ can be determined by the following equations, $$V^0_{offset}(AB)=V_{GG}-V_{g1}(A)-V_{REF}+V_{ref1}(AB).$$

FIGS. 6A-6D and FIGS. 7A-7D illustrate some implementations of the pixel element (e.g., 100BB) in general. The pixel element (e.g., 100BB) having multiple operation modes includes a first capacitive element 70, a first transistor 60, and a light-emitting element 50. The first transistor 60 has a semiconductor channel. The first terminal 61 of the semiconductor channel of the first transistor 60 is electrically connected to a first terminal 71 of the first capacitive element 70. The light-emitting element 50 is operationally coupled to the first transistor 60 such that light emitted from the light-emitting element 50 depends upon a voltage difference between the gate 63 of the first transistor and a first terminal 61 of the semiconductor channel of the first transistor 60 at least during one operation mode.

In FIGS. 6A-6B and FIGS. 7A-7B, the pixel element also includes a second capacitive element 30 having a first terminal 31 electrically connected to a gate 63 of the first transistor 60. The second terminal 32 of the second capacitive element 30 can be connected to a voltage $V_{CP}$. In some implementations, the voltage $V_{CP}$ can be set to be identical to a common voltage, such as, the power voltage, the ground voltage, or other common voltage.

In one implementation, the pixel element includes a pixel sub-circuit 150. The pixel sub-circuit 150 has an input 151 electrically connected to the second terminal 62 of the semiconductor channel of the first transistor 60. Light emitted from the light-emitting element 50 in the pixel sub-circuit 150 depends upon a signal at the input of the pixel sub-circuit. In some implementations, the pixel sub-circuit 150 can have more than one input.

In the implementation as shown in FIGS. 6A-6D, the pixel element includes a second transistor 80. The second transistor 80 having a semiconductor channel operationally coupled to the second terminal 62 of the semiconductor channel of the first transistor 60.

Figure 18A:
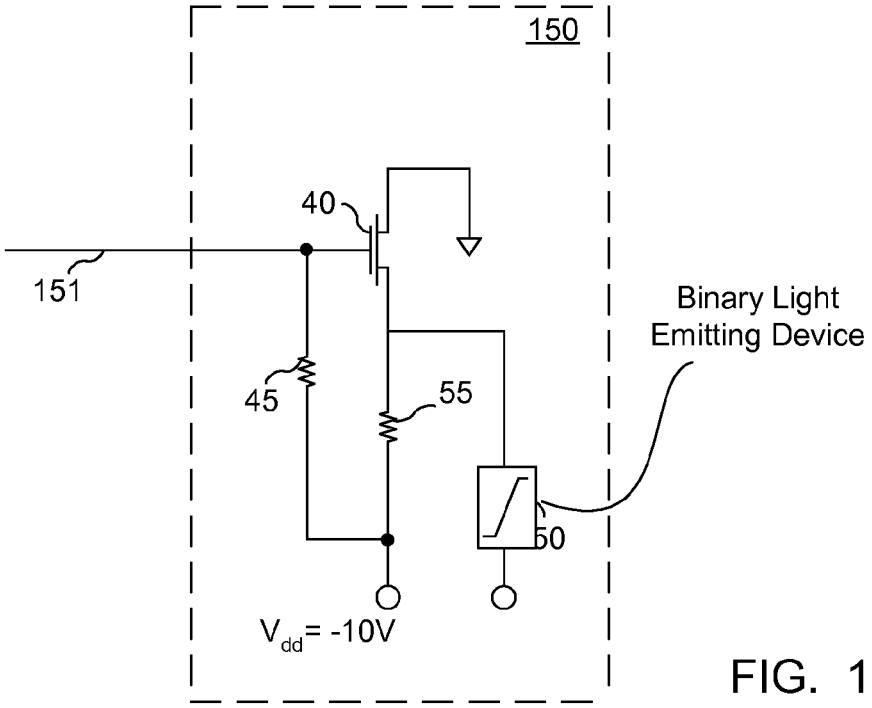
FIG. 18A shows a pixel sub-circuit that include a Binary Light Emitting Device in accordance with some embodiments.
Figure 18B:
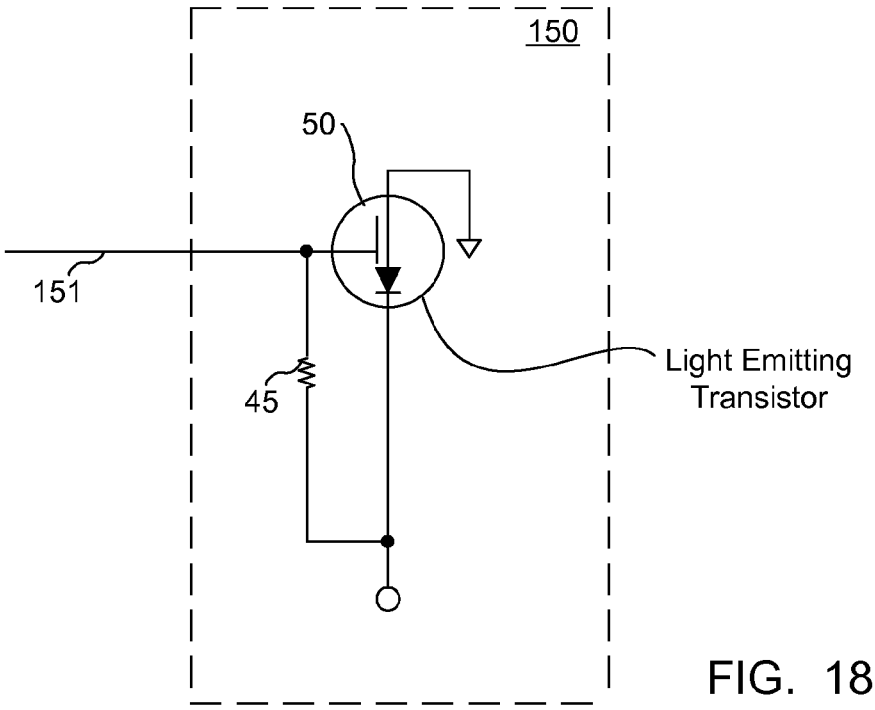
FIG. 18B shows a pixel sub-circuit that include an OLET in accordance with some embodiments.
Figure 18C:
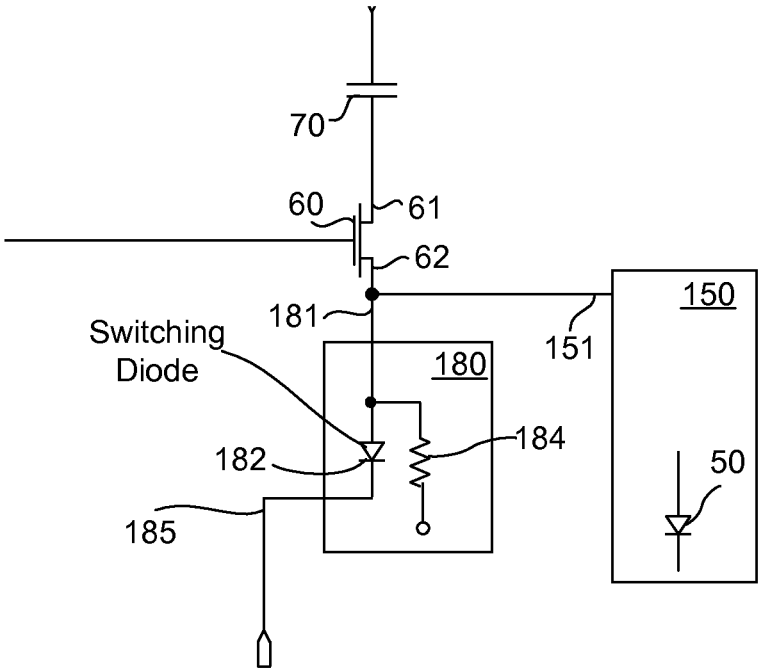
FIG. 18C shows a multi-mode electrical circuit that includes a switching diode in accordance with some embodiments.

In the implementation as shown in FIGS. 7A-7D, the pixel element includes a multi-mode electrical circuit 180. The multi-mode electrical circuit 180 has at least one mode input 185 operable to set the multi-mode electrical circuit 180 into a first mode and a second mode. The multi-mode electrical circuit is operationally coupled to a second terminal 62 of the semiconductor channel of the first transistor 60. In the first mode, the multi-mode electrical circuit 185 enables current flow into or flow from the second terminal 62 of the semiconductor channel of the first transistor 60. In the second mode, the multi-mode electrical circuit 185 substantially prevents current flow into or flow from the second terminal 62 of the semiconductor channel of the first transistor 60. While the multi-mode electrical circuit 180 can be implemented with a second transistor 80 as shown in FIGS. 6A-6D, it can also be alternatively implemented with a switching diode 182 as shown in FIG. 18C for using in some of the pixel elements described in this disclosure. In a first mode, when the switching diode 182 is forward biased, the multi-mode electrical circuit 180 in FIG. 18C becomes a low-impedance device. In a second mode, when the switching diode 182 is reverse biased, the multi-mode electrical circuit 180 in FIG. 18C becomes a high-impedance device. Depending upon the impedance of the pixel sub-circuit 150, the multi-mode electrical circuit 180 in FIG. 18C may also include a resistor 184.

In general, the pixel element can include a photo-detecting element configured to couple the first capacitive element 70 operationally with the light-emitting element 50 such that a portion of the light emitted from the light-emitting element 50 induces a voltage change across the first capacitive element 70. In the implementation as shown in FIGS. 6B-6D and FIGS. 7B-7D, the pixel element includes a photo-detecting element 90; the photo-detecting element 90 is electrically connected to the first capacitive element 70 and receives a portion of the light emitted from the light-emitting element 50.

Figure 6A:
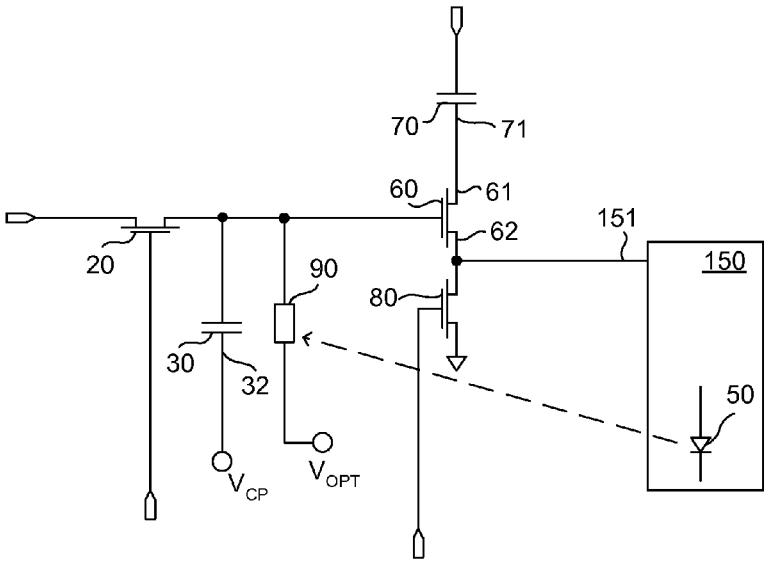
FIGS. 6A-6D illustrate some implementations of a pixel element that includes at least a first capacitive element, a first transistor, a second transistor, a pixel sub-circuit having a light-emitting element, and a photo-detecting element.
Figure 6B:
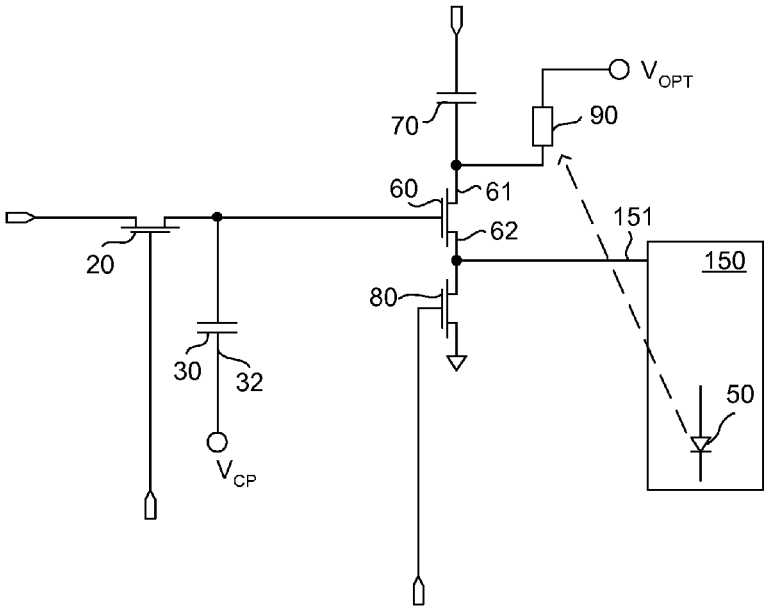
Figure 7A:
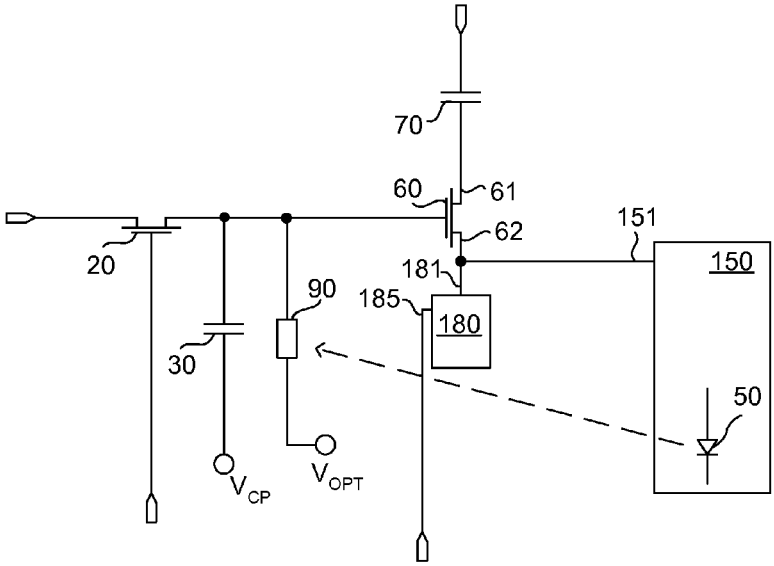
FIGS. 7A-7D illustrate some implementations of a pixel element that includes at least a first capacitive element, a first transistor, a multi-mode electrical circuit, a pixel sub-circuit having a light-emitting element, and a photo-detecting element.
Figure 7B:
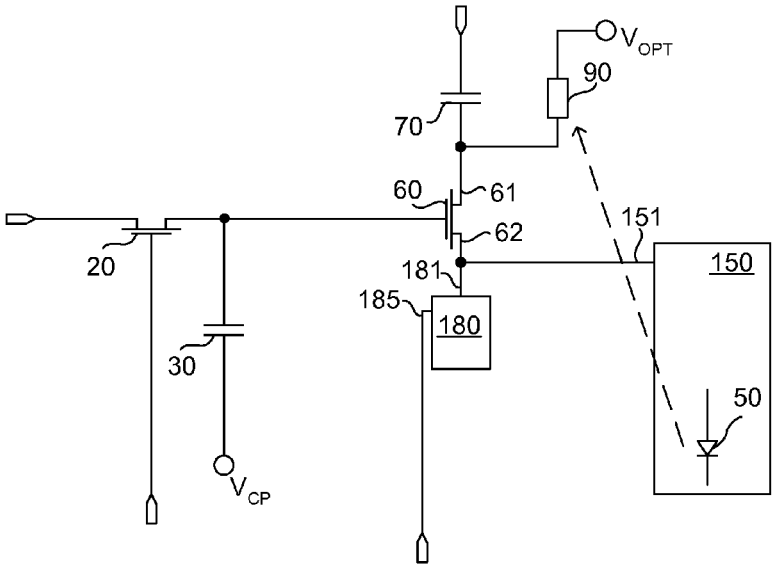

In general, the pixel element can include a photo-detecting element configured to couple the second capacitive element 30 operationally with the light-emitting element 50 such that a portion of the light emitted from the light-emitting element 50 induces a voltage change across the second capacitive element 30. In the implementation as shown in FIG. 6A and FIG. 7A, the photo-detecting element 90 is electrically connected to the second capacitive element 30 and receives a portion of the light emitted from the light-emitting element 50.

In FIG. 6A-6D and FIG. 7A-7D, the photo-detecting element 90 can be a photo-diode, photo-conductor, phototransistor, or other kinds of optical detectors. The photo-detecting element 90 can be biased with a bias voltage $V_{opt}$. In some implementations, the bias voltage $V_{opt}$ can be set to be identical to a common voltage, such as, the power voltage, or the ground voltage, or other common voltage.

Figure 6C:
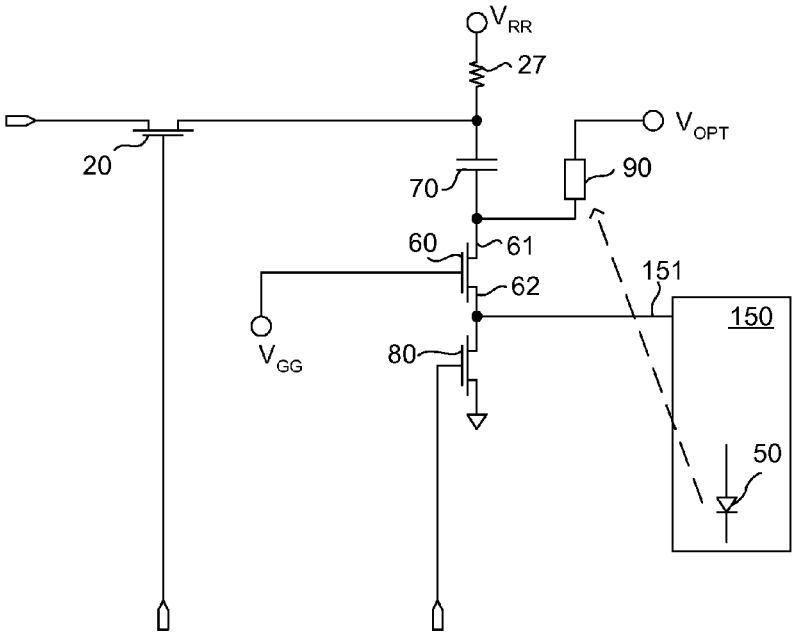
Figure 6D:
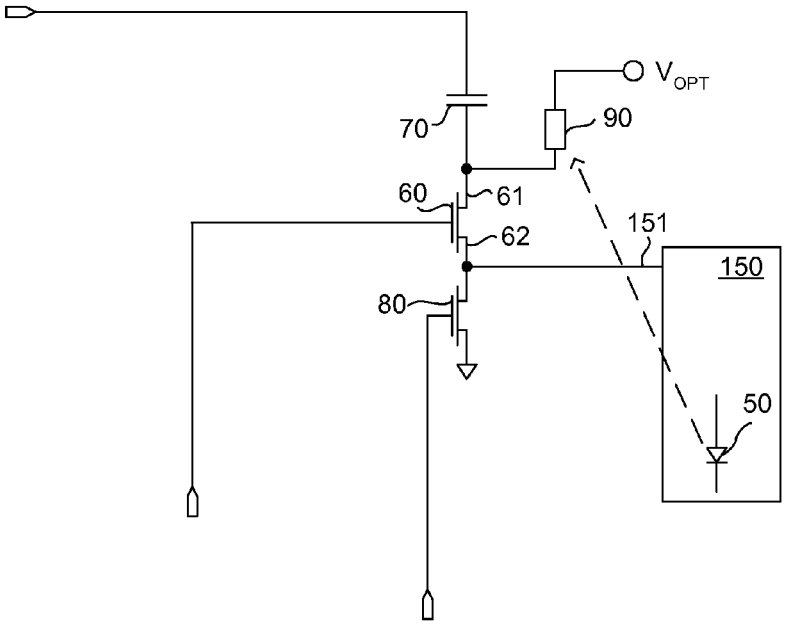
Figure 7C:
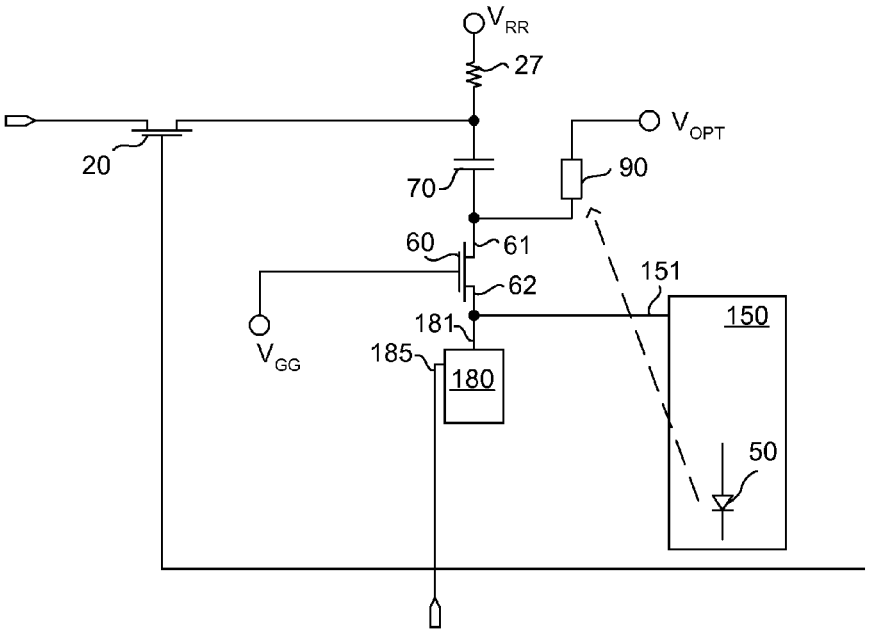
Figure 7D:
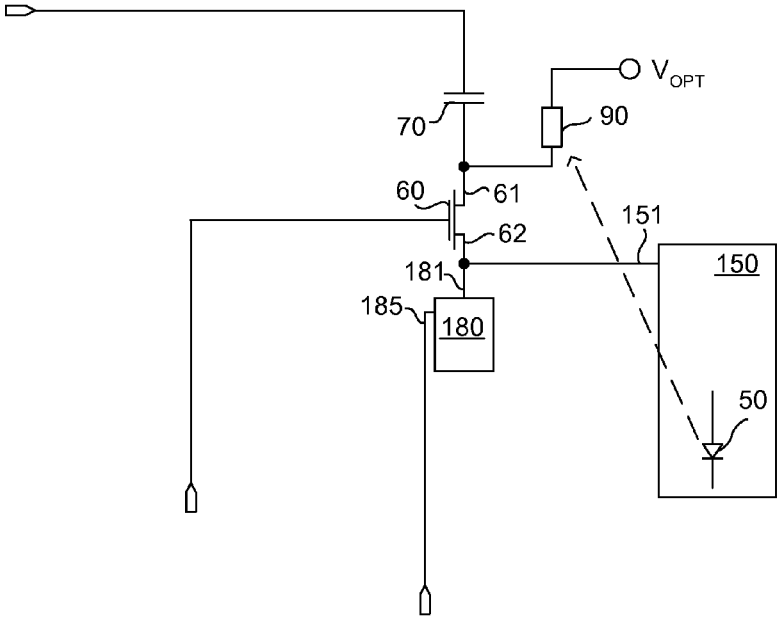

In the implementation as shown in FIGS. 6A-6B and FIGS. 7A-7B, the pixel element includes a switching transistor 20 having a semiconductor channel electrically connecting to a first terminal 31 of the second capacitive element 30. In the implementation as shown in FIG. 6C and FIG. 7C, the pixel element includes a switching transistor 20 having a semiconductor channel electrically connecting to a second terminal 72 of the first capacitive element 70. The pixel element also includes a resistive element 27 having a first terminal electrically connecting to the second terminal 72 of the first capacitive element 70.

Figure 8:
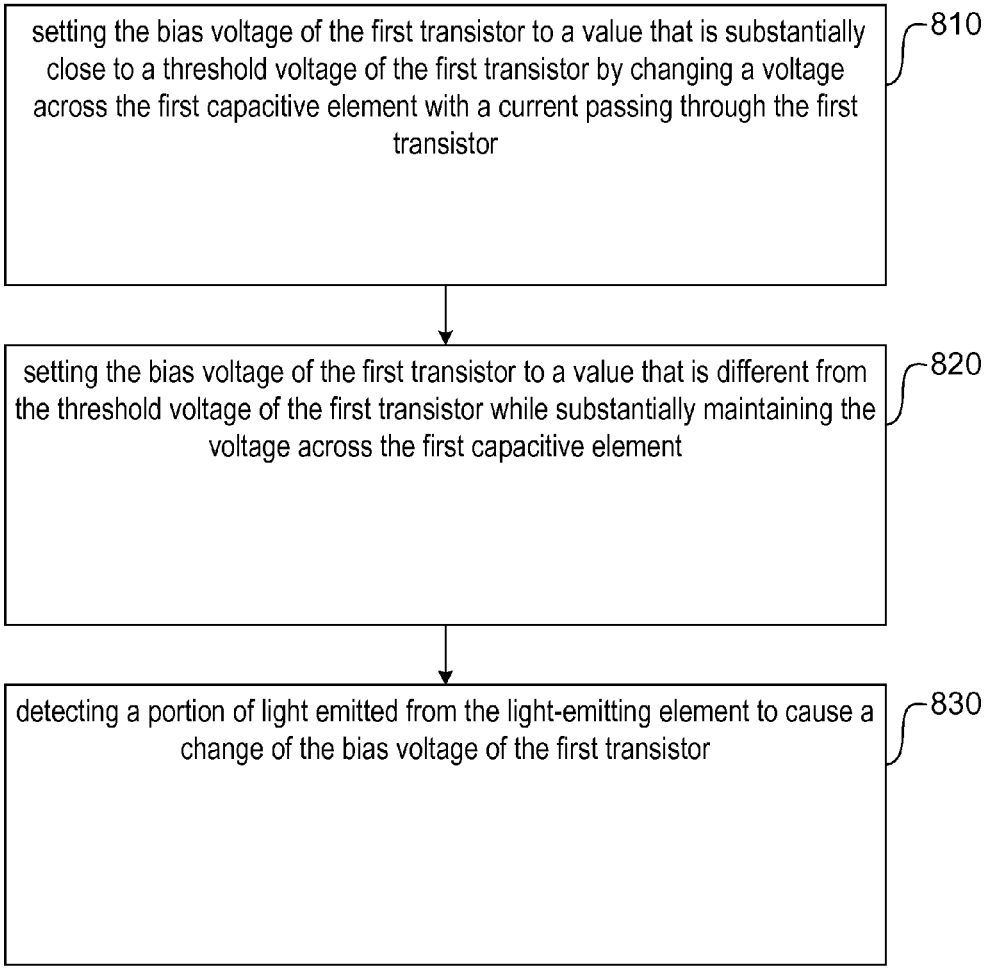
FIG. 8 shows an implementation of a method of driving a pixel element in a matrix of pixel elements.

FIG. 8 shows an implementation of a method 800 of driving a pixel element in a matrix of pixel elements. The pixel element includes (1) a first capacitive element, (2) a first transistor having a semiconductor channel, a first terminal of the semiconductor channel of the first transistor being electrically connected to a first terminal of the first capacitive element, and (3) a light-emitting element operationally coupled to the first transistor such that light emitted from the light-emitting element depends upon a bias voltage of the first transistor. Here, the bias voltage is a voltage difference between the gate of the first transistor and a first terminal of the semiconductor channel of the first transistor. In some implementations, the pixel element can also include a second transistor having a semiconductor channel operationally coupled to a second terminal of the semiconductor channel of the first transistor. The method 800 of driving a pixel element in a matrix of pixel elements includes blocks 810, 820, and 830.

Figure 9:
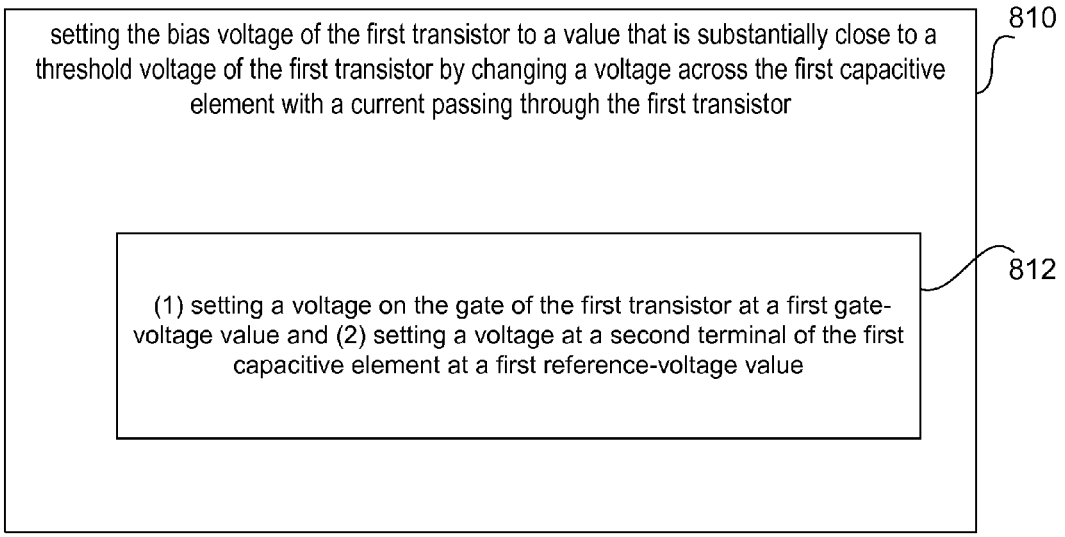
FIG. 9 shows an implementation for setting the bias voltage of the first transistor to a value that is substantially close to a threshold voltage of the first transistor.

The block 810 includes setting the bias voltage of the first transistor to a value that is substantially close to a threshold voltage of the first transistor by changing a voltage across the first capacitive element with a current passing through the first transistor. In one implementation as shown in FIG. 9, the block 810 includes a block 812. The block 812 includes (1) setting a voltage on the gate of the first transistor at a first gate-voltage value and (2) setting a voltage at a second terminal of the first capacitive element at a first reference-voltage value.

Figure 11:
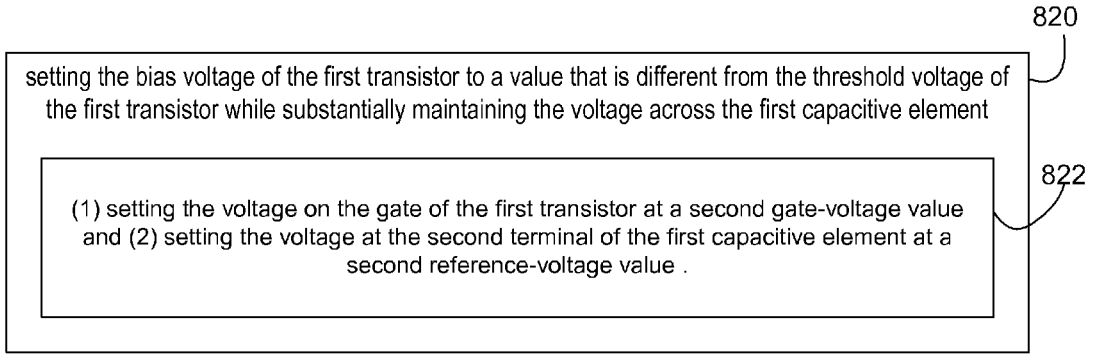
FIG. 11 shows an implementation for setting the bias voltage of the first transistor to a value that is different from the threshold voltage of the first transistor.

The block 820 includes setting the bias voltage of the first transistor to a value that is different from the threshold voltage of the first transistor while substantially maintaining the voltage across the first capacitive element. In one implementation as shown in FIG. 11, the block 820 includes a block 822. The block 822 includes (1) setting the voltage on the gate of the first transistor at a second gate-voltage value and (2) setting the voltage at the second terminal of the first capacitive element at a second reference-voltage value.

As examples, when the block 810 in FIG. 9 is applied to the pixel element as shown in FIGS. 6A-6D and FIGS. 7A-7D, the block 810 can include (1) setting a voltage on the gate of the first transistor 60 at a first gate-voltage value $V_{g1}$ and (2) setting a voltage at a second terminal of the first capacitive element 70 at a first reference-voltage value $V_{ref1}$. The voltage $V_{C1}$ across the first capacitive element 70 will be changed to a value $V_{C1} \approx V_{ref1}-(V_{g1}+V_{th})$, and the first transistor 60 will be biased near the threshold voltage $V_{th}$. When the block 820 in FIG. 11 is applied to the pixel element as shown in FIGS. 6A-6D and FIGS. 7A-7D, the block 820 can include (1) setting a voltage on the gate of the first transistor 60 at a second gate-voltage value $V_{g2}$ and (2) setting a voltage at a second terminal of the first capacitive element 70 at a second reference-voltage value $V_{ref2}$. If the voltage $V_{C1}$ across the first capacitive element 70 has been maintained at value $V_{C1} \approx V_{ref1}-(V_{g1}+V_{th})$, the block 820 will make the first transistor 60 biased at a value that is offset from the threshold voltage $V_{th}$ by an initial threshold offset $V^0_{offset}=|(V_{ref2}-V_{C1}-V_{g2})-V_{th}|=|(V_{ref2}-V_{ref1})-(V_{g2}-V_{g1})|$. Later on, this initial threshold offset $V^0_{offset}$ can be used to substantially determine the total amount of light emitted from the light-emitting element 50.

In some implementations, the voltage at the gate of the first transistor 60 is kept at constant (i.e., $V_{g2}=V_{g1}$), and the initial threshold offset $V^0_{offset}$ is determined by the difference of the reference-voltage value at the second terminal of the first capacitive element 70: $V^0_{offset}=|(V_{ref2}-V_{ref1})|$. As a specific example, in FIG. 6C and FIG. 7C, $V_{g2}=V_{g1}=V_{GG}$, and $V^0_{offset}=|(V_{RR}-V_{ref1})|$. In other implementations, the voltage at the second terminal 72 of the first capacitive element 70 is kept at constant (i.e., $V_{ref2}=V_{ref1}$), and the initial threshold offset $V^0_{offset}$ is determined by the difference of the voltage at the gate of the first transistor 60: $V^0_{offset}=|(V_{g2}-V_{g1})|$. In some implementations, the second terminal 72 of the first capacitive element 70 can be connected to a common reference voltage $V_{REF}$ such that $V_{ref2}=V_{ref1}=V_{REF}$.

Figure 10A:
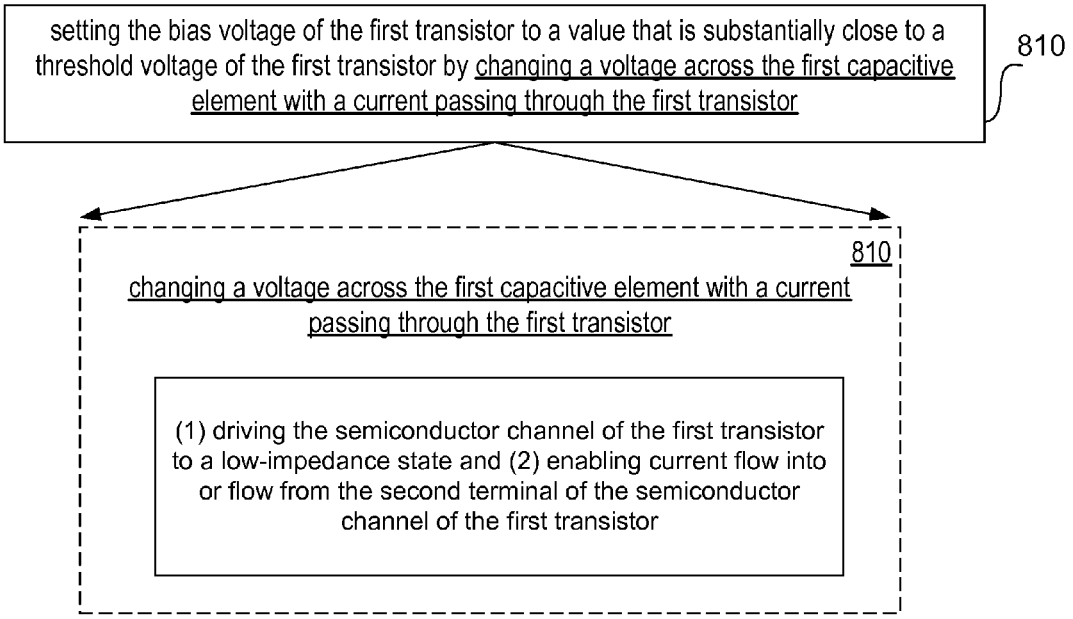
FIGS. 10A-10B illustrate the implementations for changing a voltage across the first capacitive element with a current passing through the first transistor.

In one implementation as shown in FIG. 10A, in the block 810, the changing a voltage across the first capacitive element with a current passing through the first transistor includes (1) driving the semiconductor channel of the first transistor to a low-impedance state and (2) enabling current flow into or flow from the second terminal of the semiconductor channel of the first transistor. As examples, if the block 810 in FIG. 10A is applied to the pixel element in FIGS. 7A-7D, when the multi-mode electrical circuit 180 is set into a first mode with a signal applied to the mode input 185, the multi-mode electrical circuit 180 enables current flow into or flow from the second terminal 62 of the semiconductor channel of the first transistor 60.

Figure 10B:
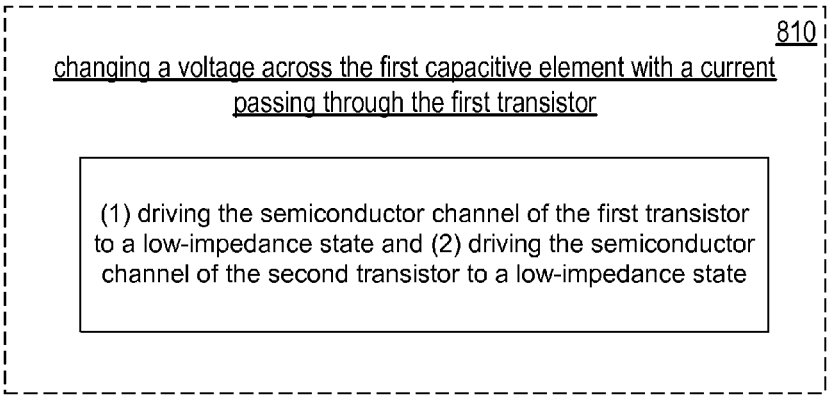

In one implementation as shown in FIG. 10B, in the block 810, the changing a voltage across the first capacitive element with a current passing through the first transistor includes (1) driving the semiconductor channel of the first transistor to a low-impedance state and (2) driving the semiconductor channel of the second transistor to a low-impedance state. As examples, if the block 810 in FIG. 10B is applied to the pixel element as shown in FIGS. 6A-6D, when both the first transistor 60 and the second transistor 80 are driven into the low-impedance state, the voltage $V_{C1}$ across the first capacitive element 70 will be changed with the current passing through the first transistor 60 until the bias voltage of the first transistor 60 is changed to a value near its threshold voltage.

Figure 12A:
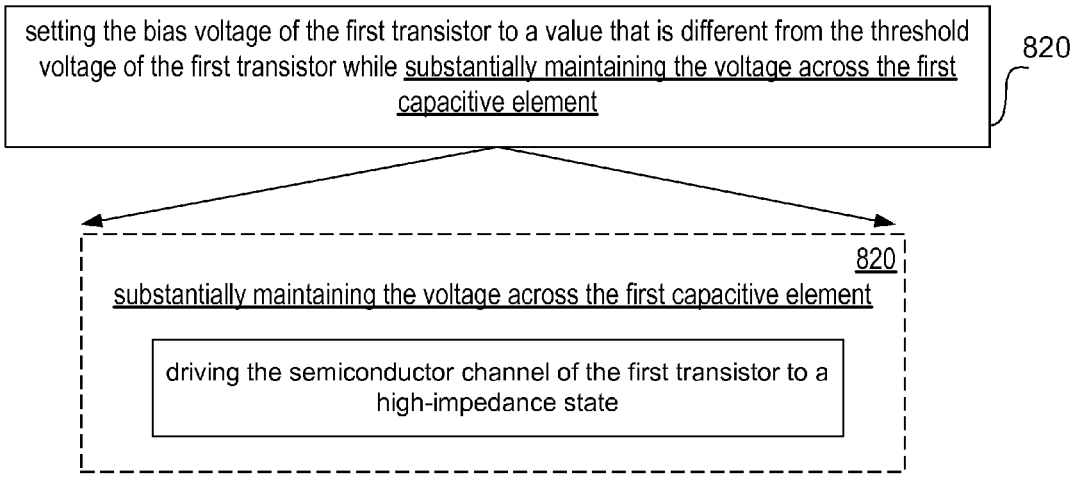
FIGS. 12A-12C illustrate the implementations for substantially maintaining the voltage across the first capacitive element.

In one implementation as shown in FIG. 12A, in the block 820, the substantially maintaining the voltage across the first capacitive element includes driving the semiconductor channel of the first transistor to a high-impedance state.

Figure 12B:
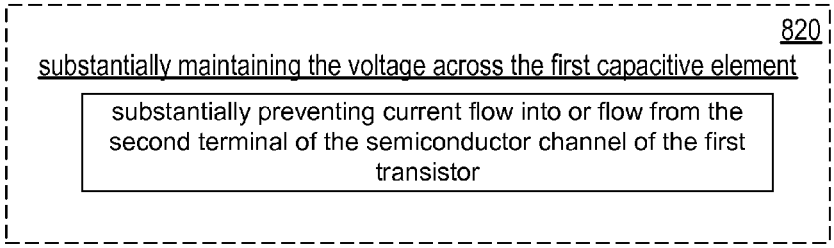

In one implementation as shown in FIG. 12B, in the block 820, the substantially maintaining the voltage across the first capacitive element includes substantially preventing current flow into or flow from the second terminal of the semiconductor channel of the first transistor. As examples, if the block 820 in FIG. 12B is applied to the pixel element in FIGS. 7A-7D, when the multi-mode electrical circuit 180 is set into a second mode with a signal applied to the mode input 185, the multi-mode electrical circuit 180 substantially prevents current flow into or flow from the second terminal 62 of the semiconductor channel of the first transistor 60.

Figure 12C:
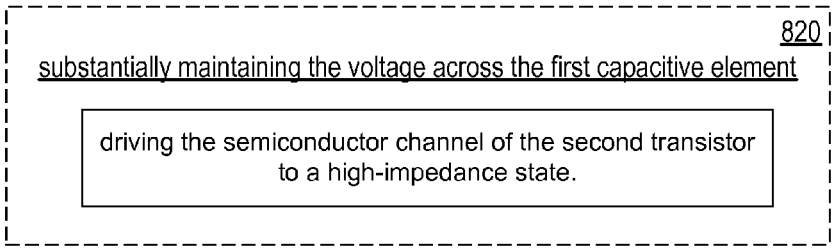

In one implementation as shown in FIG. 12C, in the block 820, the substantially maintaining the voltage across the first capacitive element includes driving the semiconductor channel of the second transistor to a high-impedance state.

The block 830 includes (1) detecting a portion of light emitted from the light-emitting element to cause a change of the bias voltage of the first transistor. As examples, when the block 830 in FIG. 9 is applied to the pixel element as shown in FIGS. 6A-6D and FIGS. 7A-7D, a portion of light emitted from the light-emitting element 50 can be detected by the photo-detecting element 90. The current generated by the photo-detecting element 90 can cause a change of the bias voltage of the first transistor 40.

Figure 13A:
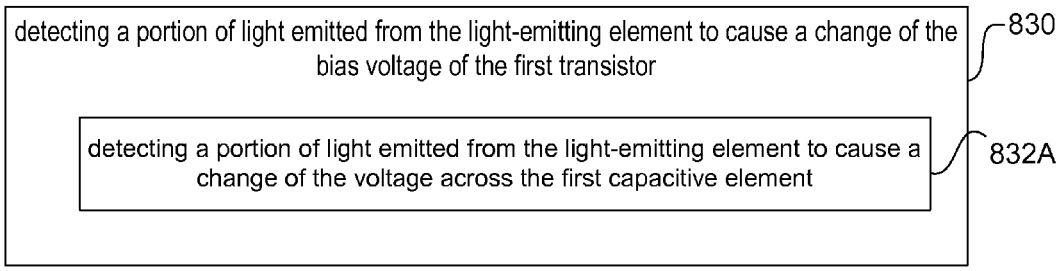
FIGS. 13A-13B illustrate the implementations for detecting a portion of light emitted from the light-emitting element to cause a change of the bias voltage of the first transistor.
Figure 13B:
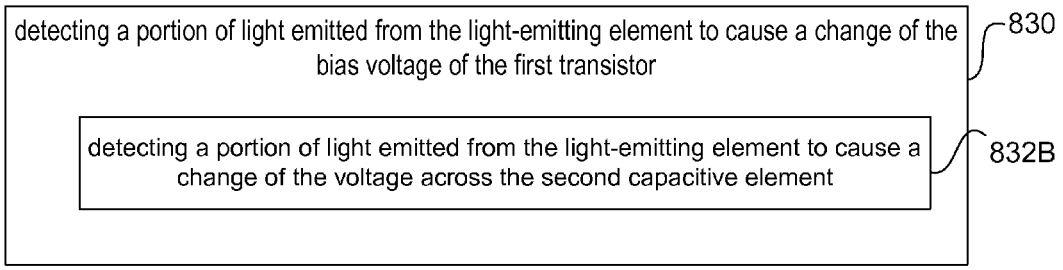

In one implementation as shown in FIG. 13A, the block 830 includes detecting a portion of light emitted from the light-emitting element to cause a change of the voltage across the first capacitive element. In another implementation as shown in FIG. 13B, when the pixel element includes a second capacitive element operationally coupled to a gate of the first transistor, the block 830 includes detecting a portion of light emitted from the light-emitting element to cause a change of the voltage across the second capacitive element.

In FIGS. 6A-6D and FIGS. 7A-7D, the pixel element includes a pixel sub-circuit 150. The pixel sub-circuit 150 has an input 151 electrically connected to the second terminal 62 of the semiconductor channel of the first transistor 60. Light emitted from the light-emitting element 50 in the pixel sub-circuit 150 depends upon a signal at the input of the pixel sub-circuit. FIGS. 14A-14D illustrate some implementations of the pixel sub-circuit 150.

Figure 14A:
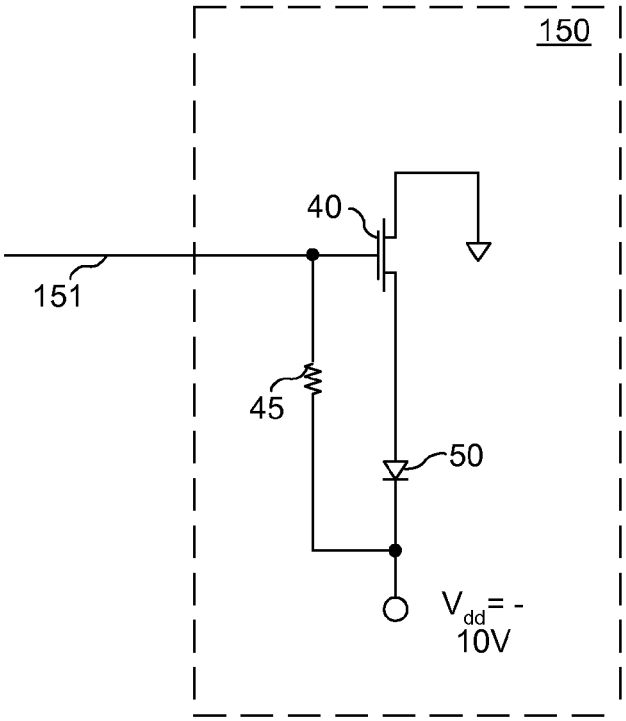
FIG. 14A is an implementation of the pixel sub-circuit 150 that is used in the pixel element in FIGS. 3A-3B.
Figure 14B:
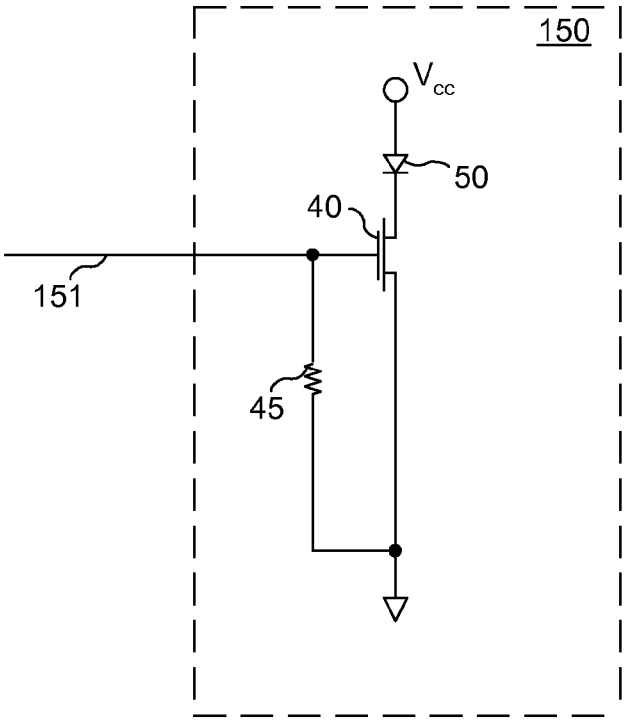
FIG. 14B is an implementation of the pixel sub-circuit 150 that is used in the pixel element in FIGS. 3C-3D.

FIG. 14A is an implementation of the pixel sub-circuit 150 that is used in the pixel element in FIGS. 3A-3B. In FIG. 14A, the pixel sub-circuit 150 includes a PFET and a light emitting diode 50. FIG. 14B is an implementation of the pixel sub-circuit 150 that is used in the pixel element in FIGS. 3C-3D. In FIG. 14B, the pixel sub-circuit 150 includes a NFET and a light emitting diode 50.

Figure 14C:
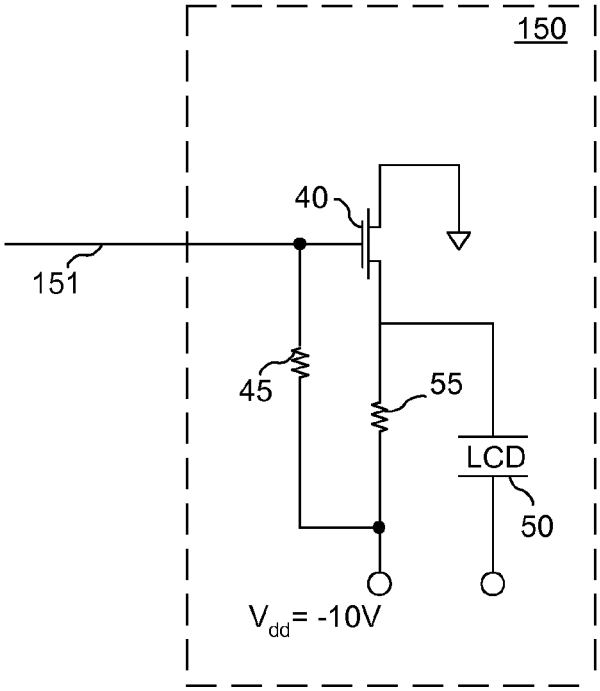
FIGS. 14C-14E are implementations of the pixel sub-circuit 150 that includes a high-impedance light-emitting element.
Figure 14D:
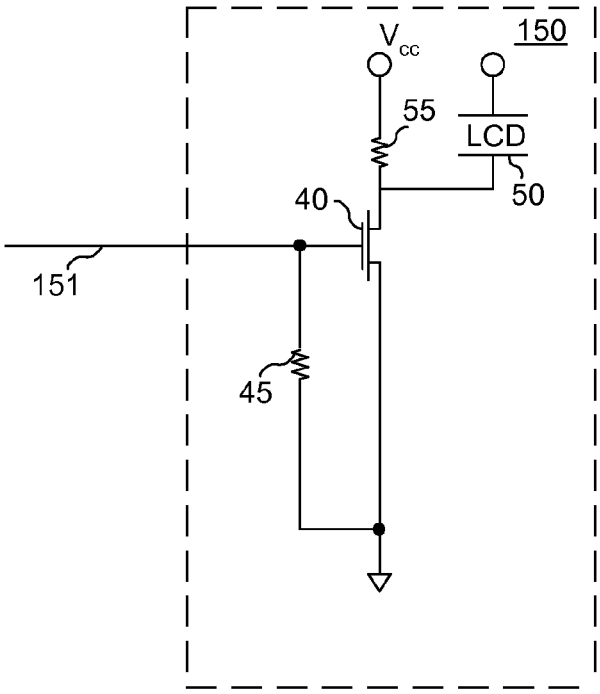
Figure 14E:
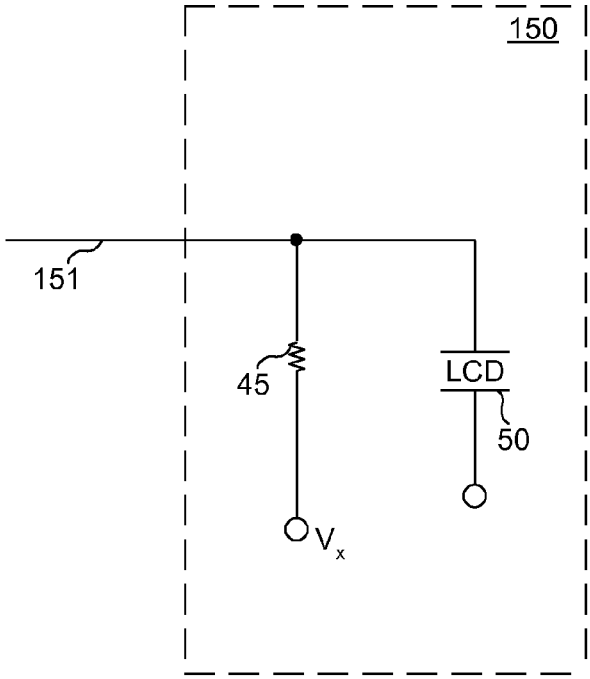

FIGS. 14C-14E are implementations of the pixel sub-circuit 150 that includes a high-impedance light-emitting element, such as a LCD cell 50 positioned in front of certain back lightening unit (e.g., a BLU, which is not shown in the figure). In FIGS. 14C-14D, the pixel sub-circuit 150 also includes a resistive element 55 electrically connected to the semiconductor channel of the driving transistor 40. The voltage at a terminal of the resistive element 55 is used to control the light intensity emitted from the LCD cell 50. In FIG. 14E, the voltage at the input 151 of the pixel sub-circuit 150 is used to control the light intensity emitted from the LCD cell 50. The pixel sub-circuit 150 can also include a resistive element 45 connected between the input 151 and a common voltage $V_X$.

When the pixel sub-circuit 150 in FIGS. 14C-14E is used for a pixel element in FIGS. 6A-6D and FIGS. 7A-7D, a portion of light emitted from the LCD cell 50 can be detected by the photo-detecting element 90. The current generated by the photo-detecting element 90 can cause a change of the bias voltage of the first transistor 40. In general, the light intensity emitted from the LCD cell 50 depends upon the light intensity of the back lightning unit and the transmission coefficient of the LCD cell 50. The transmission coefficient of the LCD cell 50 generally depends upon a voltage applied on the LCD cell 50, and this functional dependence generally can be characterized with a transmission coefficient curve. When the pixel sub-circuit 150 in FIGS. 14C-14E are used for a pixel element in FIGS. 6A-6D and FIGS. 7A-7D, variations of the transmission coefficient curve of the LCD cell 50 among different pixel elements can be compensated. The LCD cell 50 can be a nematic LCD cell or a ferroelectric LCD cell. In some implementations, the LCD cell can be substitute with other kinds of high-impedance light-emitting element, such as MEMS based light modulation devices. Examples of MEMS bases light modulation devices include the MEMS device as described in U.S. Pat. No. 7,742,215, titled "Methods and Apparatus for Spatial light modulation" and U.S. Pat. No. 7,742,016, titled "Display Methods and Apparatus."

Figure 15A:
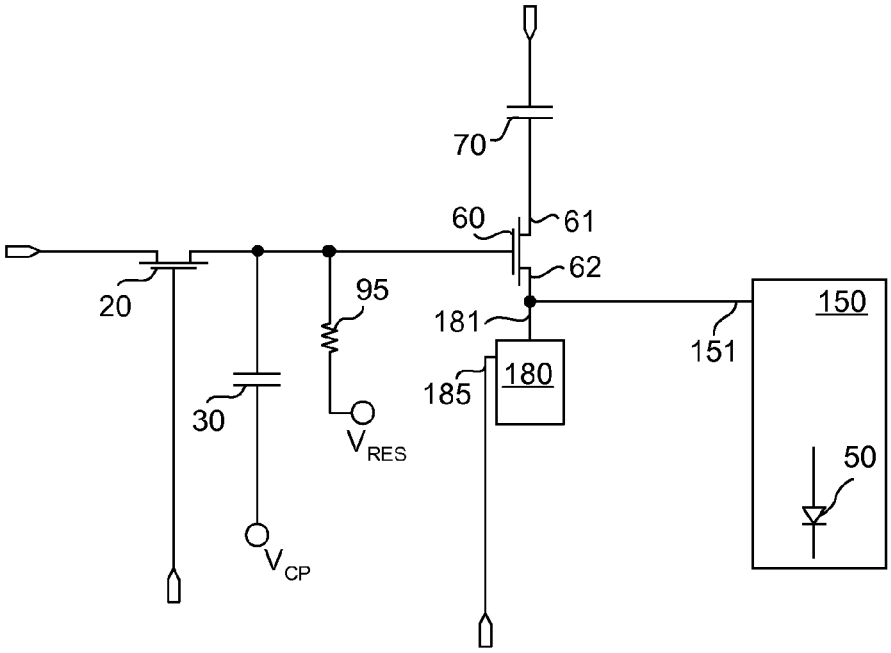
FIGS. 15A-15C are implementations of a pixel element that includes a resistive element operable to change the bias voltage of the first transistor with a current passing through the resistive element.
Figure 15B:
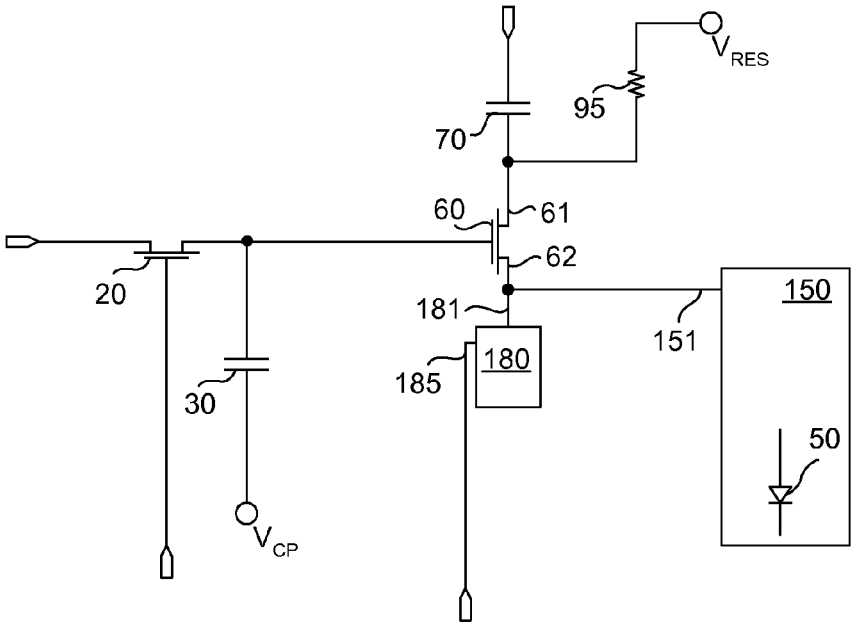
Figure 15C:
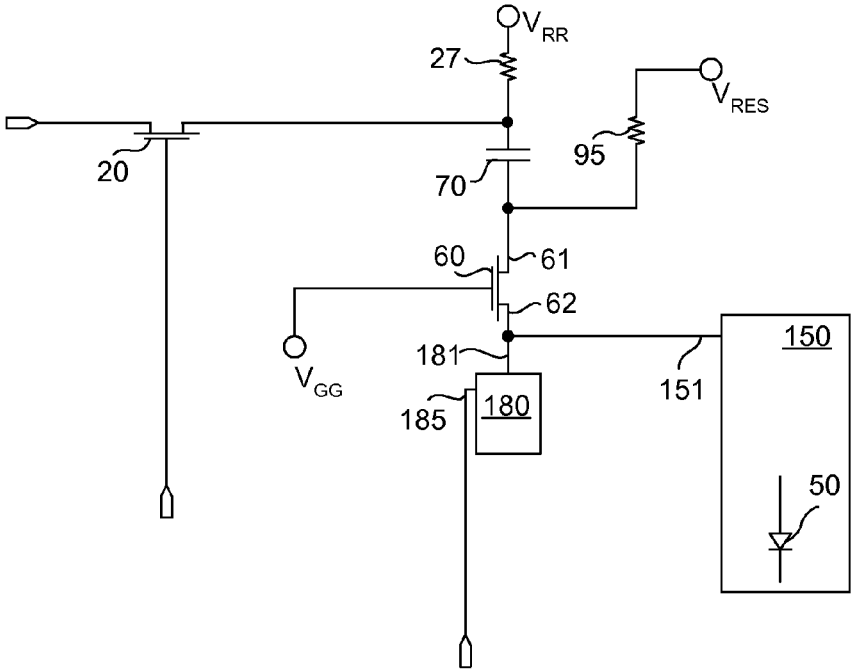

In FIGS. 6A-6D and FIGS. 7A-7D, the pixel element includes a photo-detecting element 90 operable to change the bias voltage of the first transistor 40 with the current generated by the photo-detecting element 90. In certain implementations, the pixel element does not include the photo-detecting element 90. For example, FIGS. 15A-15C illustrate other implementations of the pixel element (e.g., 100BB) that includes a resistive element 95 operable to change the bias voltage of the first transistor 40 with a current passing through the resistive element 95. In FIG. 15A, the resistive element 95 is electrically connected to the second capacitive element 30. In FIGS. 15B-15C, the resistive element 95 is electrically connected to the first capacitive element 70. The resistive element 95 can be biased with a bias voltage $V_{RES}$. In some implementations, the bias voltage $V_{RES}$ can be set to be identical to a common voltage, such as, the power voltage, or the ground voltage, or other common voltage.

Figure 16:
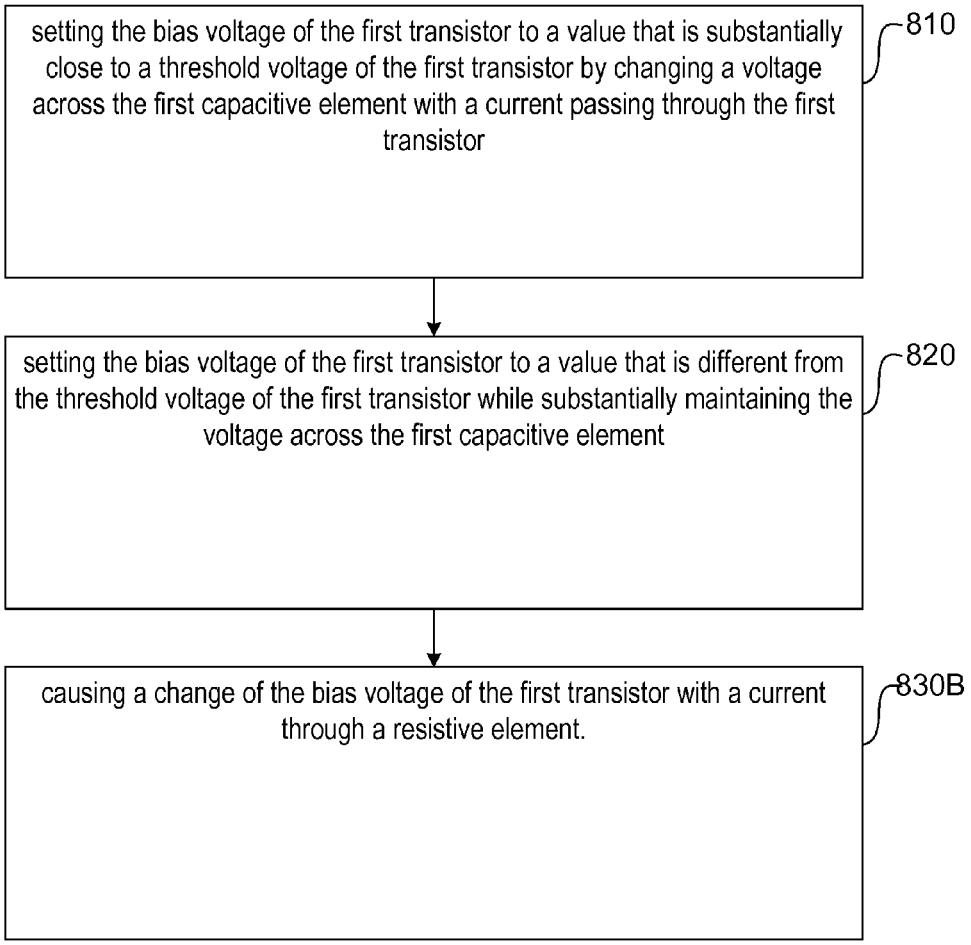
FIG. 16 shows another implementation of a method of driving a pixel element in a matrix of pixel elements.
Figure 17:
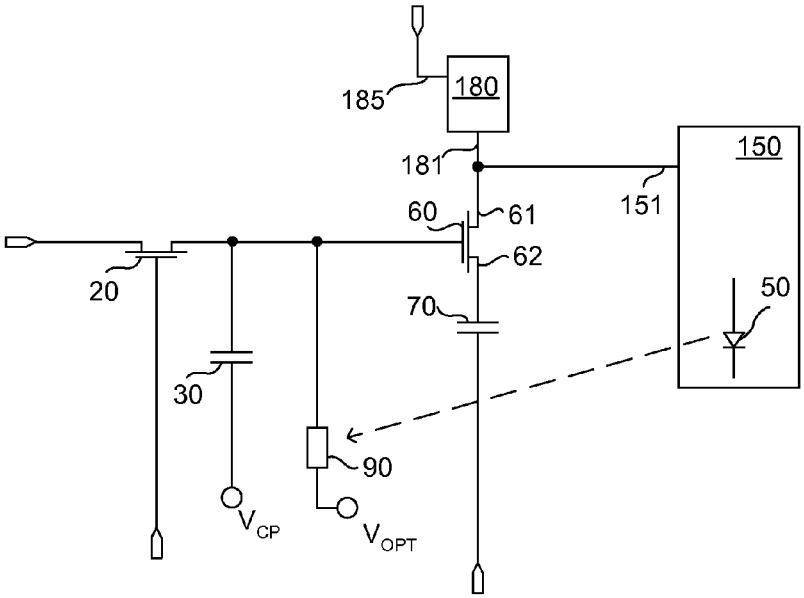
FIG. 17 shows an implementation of a pixel element in which the first transistor is a NFET.

FIG. 16 shows an implementation of a method 800B of driving a pixel element in a matrix of pixel elements. The pixel element includes (1) a first capacitive element, (2) a first transistor having a semiconductor channel, a first terminal of the semiconductor channel of the first transistor being electrically connected to a first terminal of the first capacitive element, and (3) a light-emitting element operationally coupled to the first transistor such that light emitted from the light-emitting element depends upon a bias voltage of the first transistor. Here, the bias voltage is a voltage difference between the gate of the first transistor and a first terminal of the semiconductor channel of the first transistor. In some implementations, the pixel element can also include a second transistor having a semiconductor channel operationally coupled to a second terminal of the semiconductor channel of the first transistor. Like the method 800 in FIG. 8, the method 800B in FIG. 16 also includes blocks 810 and 820. But unlike the method 800 in FIG. 8, which includes the block 830, the method 800B in FIG. 16 includes a block 830B.

The block 830B includes causing a change of the bias voltage of the first transistor with a current through a resistive element. As examples, when the block 830B in FIG. 16 is applied to the pixel element as shown in FIG. 15A, the current through the resistive element 95 can cause a change of the voltage on the gate of the first transistor 60 and consequently cause a change of the bias voltage of the first transistor 60. When the block 830B in FIG. 16 is applied to the pixel element as shown in FIGS. 15B-15C, the current through the resistive element 95 can cause a change of the voltage across the first capacitive element 70 and consequently cause a change of the bias voltage of the first transistor 60.

Generally, the current through the resistive element 95 can be a constant or can change with time. If this current is known or can be determined, it may be possible to determine the time duration that light is emitted from the light-emitting element 50 based on some initial conditions (e.g., one or more of the following: $V_{g1}$, $V_{g2}$, $V_{ref1}$, $V_{ref2}$, or $V^0_{offset}$). Furthermore, if the intensity of light emitted from the light-emitting element 50 during that time period is known, the total amount of light $L_{total}$ emitted from the light-emitting element 50 in each pixel element (e.g., 100AB) can also be determined from these initial conditions As an example, when the method 800B in FIG. 16 is applied to the pixel element as shown in FIG. 15A with a pixel sub-circuit 150 as shown in FIG. 14A or FIG. 14C, the time duration that light is emitted from the light-emitting element 50 can be determined by some initial conditions. In one simple implementation, assume that both the voltage $V_{CP}$ and the voltage $V_{RES}$ are designed to be identical to the ground voltage, and assume that when the blocks 810 and 820 are applied to the pixel element as shown in FIG. 15A, the voltage at the second terminal of the first capacitive element 70 is kept at constant (i.e., $V_{ref2}=V_{ref1}$). With such implementation, the initial threshold offset $V^0_{offset}$ is determined by the difference of the voltage at the gate of the first transistor 60: $V^0_{offset}=|(V_{g2}-V_{g1})|$.

During operation, when the block 810 is applied to the pixel element, the voltage on the gate of the first transistor 60 is set to $V_{g1}$, and the second capacitive element 30 is charged to the identical voltage $V_{g1}$; in addition, the bias voltage of the first transistor is changed to a value that is substantially close to a threshold voltage of the first transistor 60. Later on, when the block 820 is applied to the pixel element, the voltage on the gate of the first transistor 60 is set to $V_{g2}$, and the second capacitive element 30 is charged to the identical voltage $V_{g2}$; in addition, the bias voltage of the first transistor is set to a value that is different from the threshold voltage of the first transistor. When $V_{g2}$ is larger than $V_{g1}$, the first transistor 60 is driven into the high-impedance state. The current through the resistive element 95 can cause a change of the voltage across the second capacitive element 30. If the capacitance of the second capacitive element 30 is $C_g$, and the resistance of the resistive element 95 is $R_g$, then, the voltage across the second capacitive element 30 is $V_g(t)=V_{g2}\ [1-\exp(-t/\tau)]$, where $\tau=R_g\ C_g$.

When the voltage across the second capacitive element 30 is decreased to $V_{g1}$, the first transistor 60 will begin to change from the high-impedance state to the low impedance state. Therefore, the time duration T* that the first transistor 60 staying at the high-impedance state can be determined from equation, $T^*=\tau \ln [V_{g2}/(V_{g2}-V_{g1})]$. The time duration T* is also the time duration that light is emitted from the light-emitting element 50.

In certain implementations, the time duration T* can substantially determine the total amount of light $L_{total}$ emitted from the light-emitting element 50 in each pixel element. For example, when the pixel element in FIG. 15A is implemented with a pixel sub-circuit 150 in FIG. 14C, if the transmission coefficient of the LCD cell 50 is 100% when the first transistor 60 is at the high-impedance state and the transmission coefficient of the LCD cell 50 is 0% when the first transistor 60 is at the low-impedance state, then, the total amount of light $L_{total}$ emitted from the light-emitting element 50 is directly proportional to T*. That is, $L_{total}=T^*I_0$, where $I_0$ is the intensity of light emitted from the LCD cell 50 when the first transistor 60 is at the high-impedance state.

Both the method 800 in FIG. 8 and the method 800B in FIG. 16 are the method of driving a pixel element. Both the method 800 in FIG. 8 and the method 800B in FIG. 16 include causing a change of the bias voltage of the first transistor. In FIG. 8, the method 800 includes detecting a portion of light emitted from the light-emitting element to cause a change of the bias voltage of the first transistor. In FIG. 16, the method 800B includes causing a change of the bias voltage of the first transistor with a current through a resistive element. Other than the implementations in FIG. 8 and FIG. 16, there are other methods of causing a change of the bias voltage of the first transistor. For example, in one implementation, one of the methods of causing a change of the bias voltage of the first transistor can include monitoring a current flowing through the light-emitting element and causing a change of the bias voltage of the first transistor with a current that is proportional to the current flowing through the light-emitting element.

Figure 19:
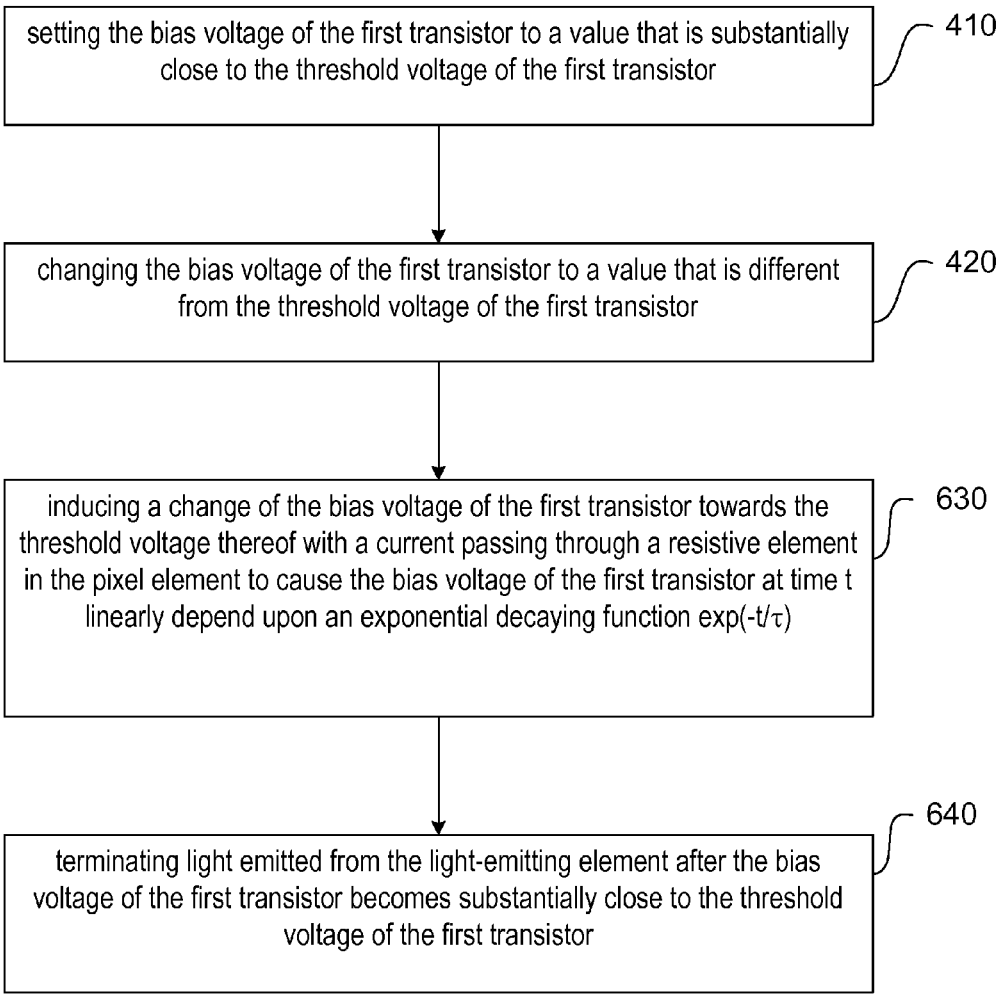
FIG. 19 shows a method of driving a pixel element in an active matrix display in accordance with some embodiments.

FIG. 19 shows a method 600 of driving a pixel element in a matrix of pixel elements of an active matrix display in accordance with some embodiments. The pixel element includes (1) a first capacitive element, (2) a first transistor having a semiconductor channel, and (3) a light-emitting element. The first transistor is biased at a bias voltage between the gate of the first transistor and a first terminal of the semiconductor channel of the first transistor, the active matrix display comprising an array of column conducting lines and an array of row conducting lines crossing the array of column conducting lines.

As shown in FIG. 19, the method 600 includes blocks 410, 420, 630, and 640. The block 410 includes setting the bias voltage of the first transistor to a value that is substantially close to the threshold voltage of the first transistor. The block 420 includes changing the bias voltage of the first transistor to a value that is different from a threshold voltage of the first transistor. The block 630 includes inducing a change of the bias voltage of the first transistor towards the threshold voltage thereof with a current passing through a resistive element in the pixel element to cause the bias voltage of the first transistor at time t linearly depend upon an exponential decaying function $\exp(-t/\tau)$. Here, the predetermined time constant $\tau$ is independent of the intensity of light emitted by the light-emitting element and is essentially independent of time t at least during said entire time period. In some implementations, the bias voltage of the first transistor at time t linearly depends upon the exponential decaying function $\exp(-t/\tau)$ essentially during entire time period that the light-emitting element is emitting light. The block 640 includes terminating light emitted from the light-emitting element after said inducing a change of the bias voltage of the first transistor causes the bias voltage of the first transistor becoming substantially close to the threshold voltage of the first transistor.

Figure 20:
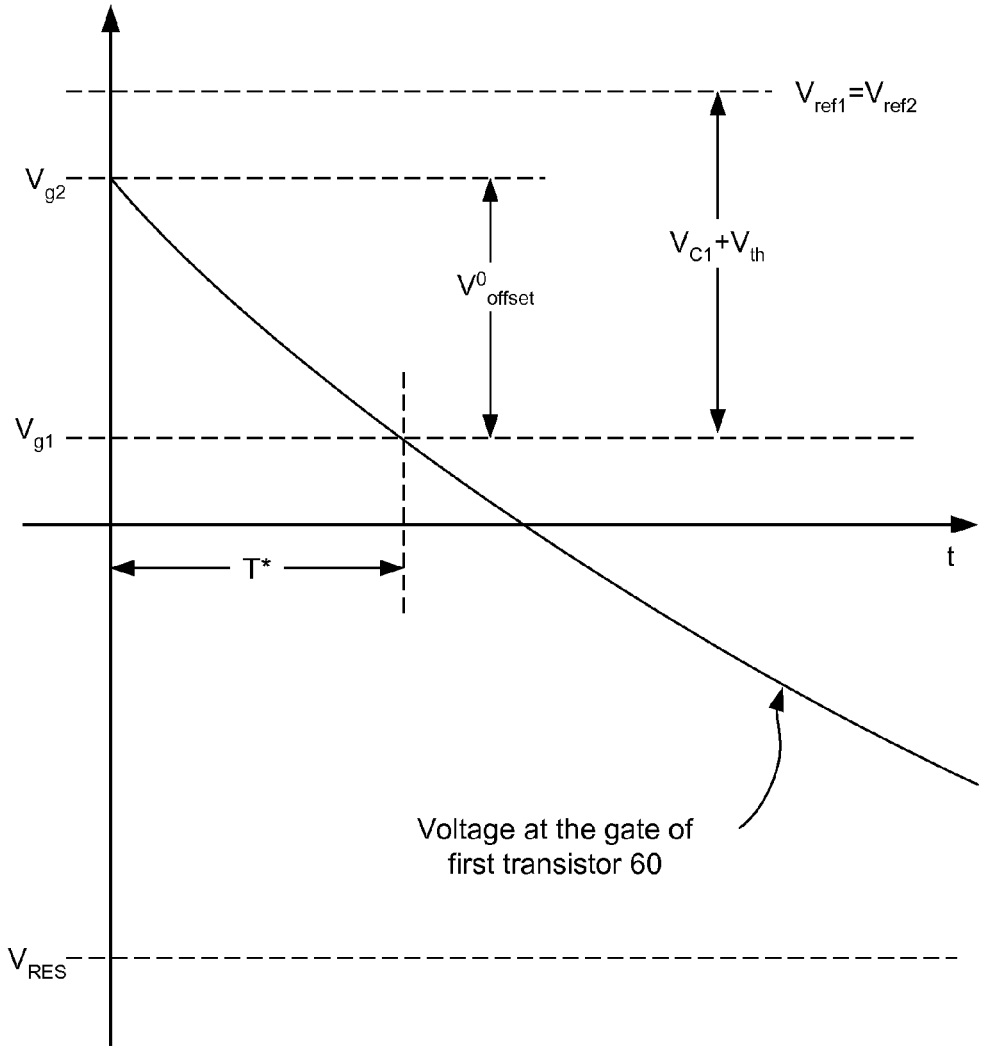
FIG. 20 shows the gate voltage of the first transistor when the method 600 is used for driving an example pixel element as shown in FIG. 15A in accordance with some embodiments.

FIG. 20 shows the gate voltage of the first transistor 60 when the method 600 is used for driving an example pixel element as shown in FIG. 15A in accordance with some embodiments. The example pixel element as shown in FIG. 15A can include a pixel sub-circuit 150 as shown in FIG. 14A or FIG. 14C. At block the 410 of FIG. 19, voltage at the second terminal of the first capacitive element 70 is kept at constant (i.e., $V_{ref2}=V_{ref1}$) and the gate voltage of the first transistor 60 is set to the voltage $V_{g1}$. After the bias voltage of the first transistor 60 is settled to a value that is substantially close to the threshold voltage $V_{th}$ of the first transistor 60, the gate voltage of the first transistor 60 differs from $V_{ref1}$ by the sum of the threshold voltage $V_{th}$ and the voltage $V_{C1}$ across the first capacitive element 70 (i.e., $V_{C1}+V_{th}$). At block the 420 of FIG. 19, the gate voltage of the first transistor 60 is set to the voltage $V_{g2}$, which changes the bias voltage of the first transistor to a value that is different from the threshold voltage $V_{th}$ of the first transistor 60. At block the 630 of FIG. 19, because of the current passing through the resistive element 95, the voltage across the second capacitive element 30 will change with time t, and the bias voltage of the first transistor at time t will linearly depend upon an exponential decaying function $\exp(-t/\tau)$. Specifically, the gate voltage $V_g(t)$ of the first transistor 60 at time t is given by equation, $$V_g(t)=V_{g2}+[V_{RES}-V_{g2}][1-\exp(-t/\tau)].$$

At block the 640 of FIG. 19, when the gate voltage $V_g(t)$ of the first transistor 60 changes back to the voltage $V_{g1}$ at time T*, the bias voltage of the first transistor also changes back to the threshold voltage $V_{th}$ of the first transistor, and light emitted from the light-emitting element 50 is terminated. The time T* it takes for the bias voltage of the first transistor to change back to the threshold voltage $V_{th}$ depend upon the value of the voltage $V_{g2}$. Generally the larger the difference between the voltage $V_{g2}$ and the voltage $V_{g1}$, the longer the time T* becomes. If the time T* as a function of the voltage $V_{g2}$, such as $T^*=f(V_{g2})$, can be determined, the total amount of light $L_{total}$ emitted from the light-emitting element 50 as a function of the voltage $V_{g2}$, such as $L_{total}=g(V_{g2})$, can also be determined, for the reason that the total amount of light $L_{total}$ can be made directly proportional to T*.

Figure 21:
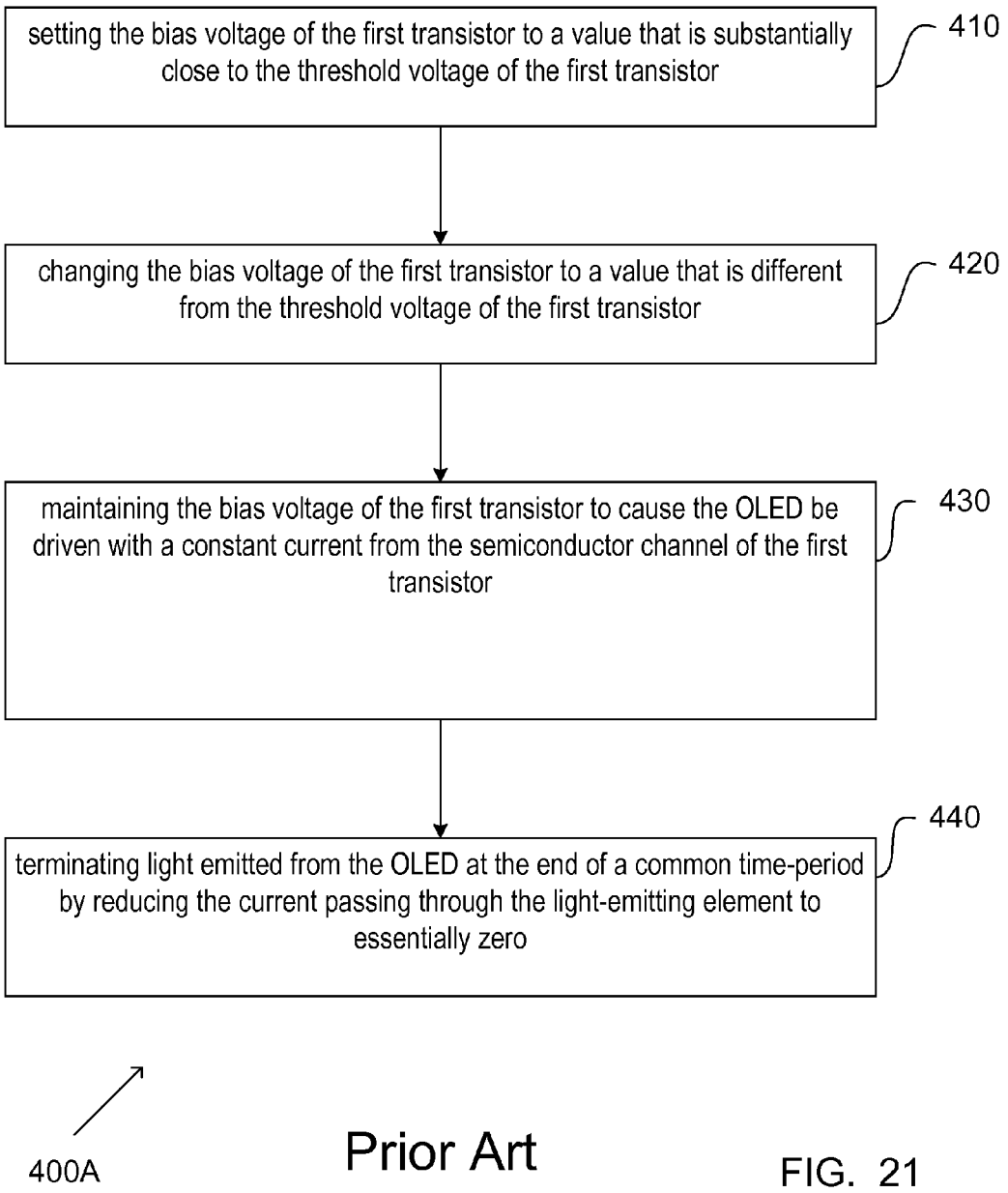
Prior Art FIG. 21
FIG. 21 shows a prior art method of driving a pixel element in an active matrix display.

In addition to the example pixel element as shown in FIG. 15A, there are large number of other types of pixel elements that can also be driven with the method 600 of FIG. 19. Particularly, many pixel elements that can be driven with the prior art method 400A of FIG. 21 can be modified to become the types of pixel elements that can be driven with the method 600 of FIG. 19. FIG. 21 shows the prior art method 400A of driving a pixel element in an active matrix display. The pixel element includes (1) a first capacitive element, (2) a first transistor having a semiconductor channel, and (3) an OLED. The first transistor is biased at a bias voltage between the gate of the first transistor and a first terminal of the semiconductor channel of the first transistor.

As shown in FIG. 21, the prior art method 400A includes blocks 410, 420, 430, and 440. The block 410 includes setting the bias voltage of the first transistor to a value that is substantially close to the threshold voltage of the first transistor. The block 420 includes changing the bias voltage of the first transistor to a value that is different from a threshold voltage of the first transistor. The block 430 includes maintaining the bias voltage of the first transistor to cause the OLED be driven with a constant current from the semiconductor channel of the first transistor. The block 440 includes terminating light emitted from the OLED at the end of a common time-period by reducing the current passing through the light-emitting element to essentially zero.

Figure 26A:
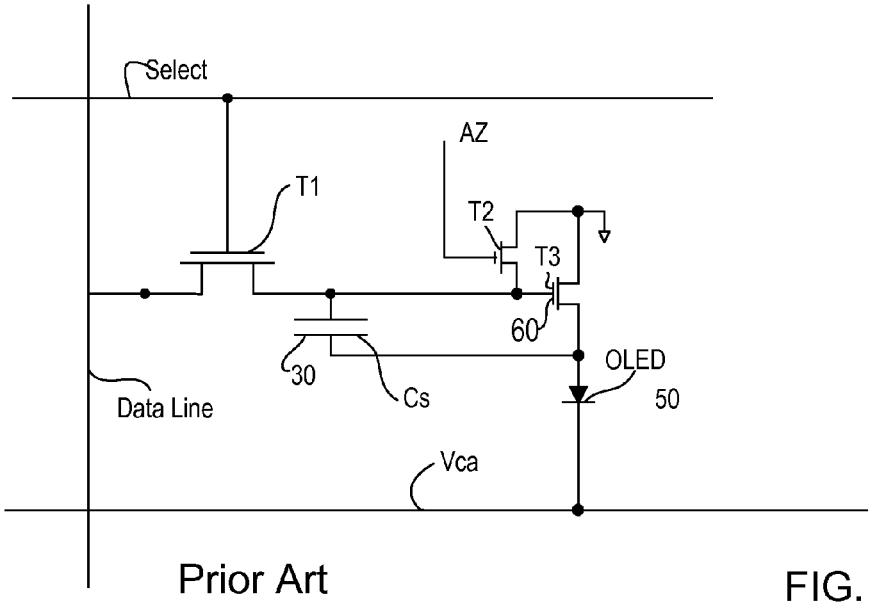
Prior Art FIG. 26A
FIG. 26A and FIG. 26 B are respectively a prior art pixel element and the corresponding modified pixel element in accordance with some embodiments.

Some example pixel elements that can be driven with the prior art method 400A of FIG. 21 includes the pixel element as shown FIG. 25A and the pixel element as shown FIG. 26A. When one of the previously mentioned prior art pixel elements is driven with the prior art method 400A of FIG. 21, such pixel element often includes a sub-circuit that is functionally equivalent to one of the sub-circuits as shown in FIGS. 22A-22F, at least during the time period when it is driven by method 400A at the block 430, even if such sub-circuit may not be exactly equivalent to any one of the circuits as shown during other time period—since the inner connections of these pixel elements are often dynamically changing with time with the help of one or more transistors functioning as linear switches. At the block 430, as shown in one of the equivalent circuits of FIGS. 22A-22F, the voltage across the capacitive element 30 is essentially held constant for maintaining the bias voltage of the first transistor 60 to cause the OLED 50 be driven with a constant current from the semiconductor channel of the first transistor 60. At the block 440, light emitted from the OLED 50 is terminated by reducing the current passing through the OLED 50 to essentially zero. The total amount of light $L_{total}$ emitted from the OLED 50 depends upon the constant current from the semiconductor channel of the first transistor 60 during the time period that the pixel element operates at the block 430.

Figure 22A:
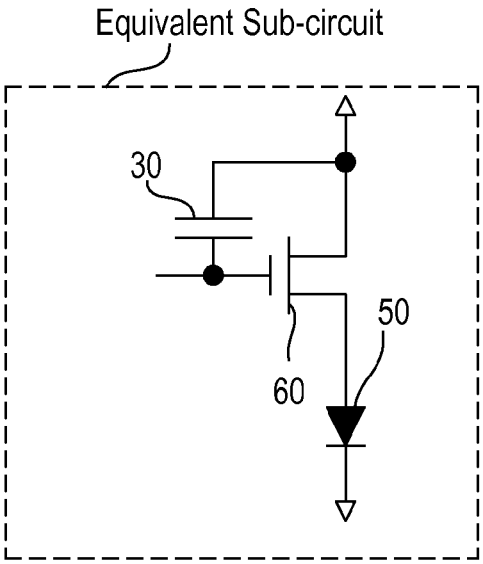
FIGS. 22A-22F are figures for showing that some prior art pixel elements driven with the prior art method of FIG. 21 can include a sub-circuit that is functionally equivalent to one of the circuits as shown the figures.
Figure 22B:
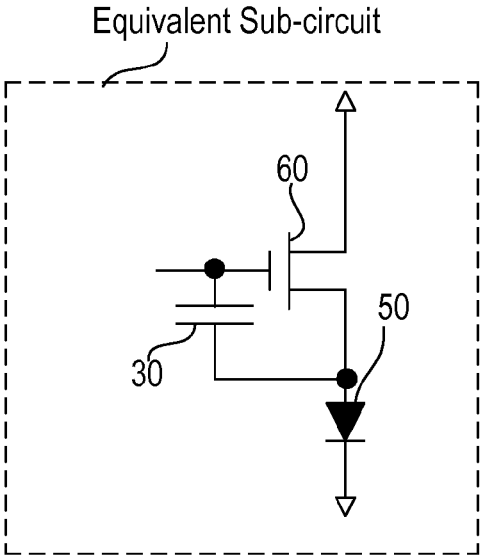
Figure 22C:
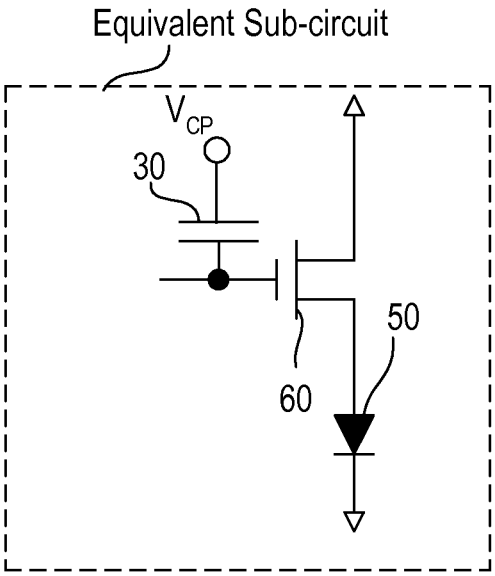
Figure 23A:
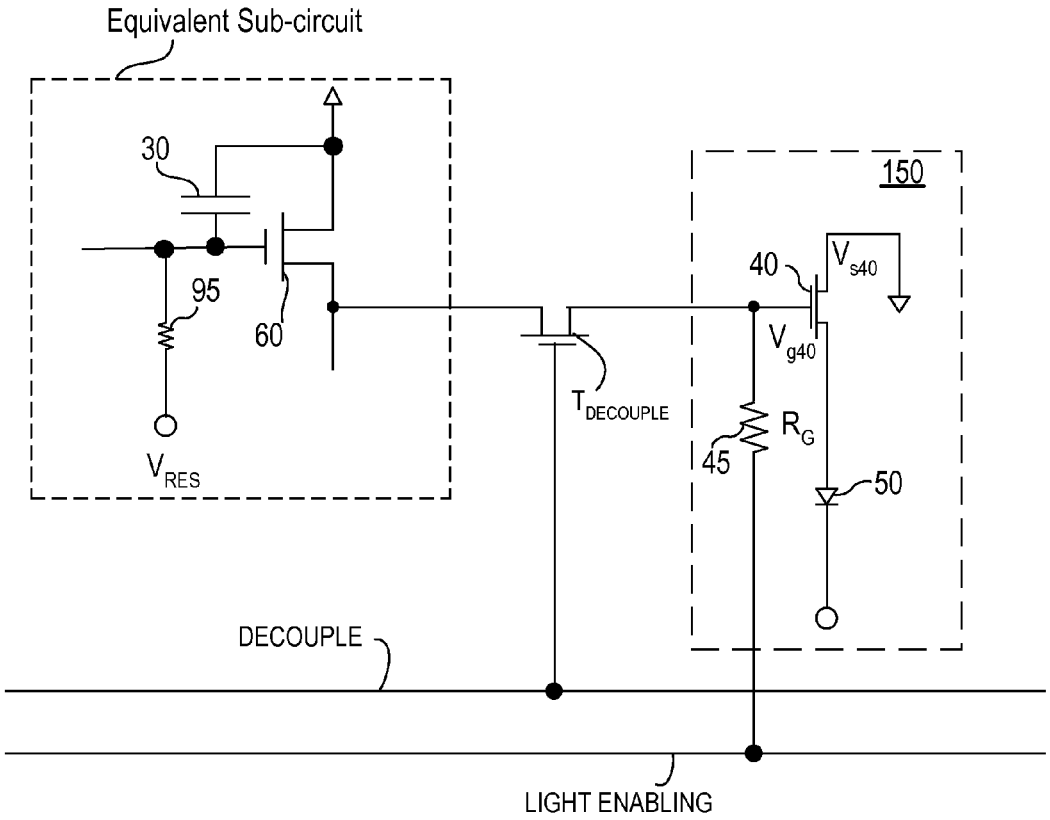
FIGS. 23A-23B depict modified pixel elements in accordance with some embodiments.
Figure 23B:
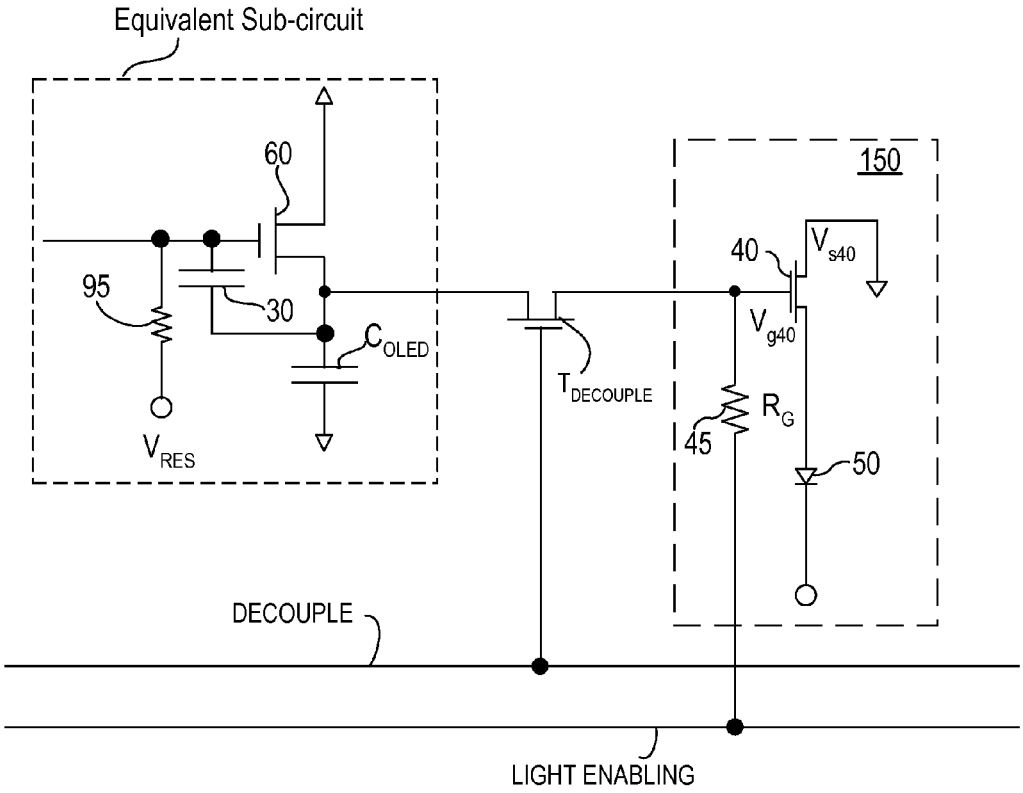

A pixel element that can be driven with the prior art method 400A of FIG. 21 generally can be modified to become a pixel element that can be driven with the method 600 of FIG. 19 by following some general principle of modifications. In one example, if a pixel element includes a sub-circuit that is functionally equivalent to the circuit as shown in FIG. 22A, such a pixel element can be modified for driven with the method 600 of FIG. 19 by adding additional circuitry as shown in FIG. 23A. In another example, if a pixel element includes a sub-circuit that is functionally equivalent to the circuit as shown in FIG. 22B, such a pixel element can be modified for driven with the method 600 of FIG. 19 by adding additional circuitry as shown in FIG. 23B. When driving such modified pixel element with the method 600 of FIG. 19, at the block 410 and the block 420, the decoupling transistor $T_{decouple}$ is turned off to decouple the pixel sub-circuit 150 from other parts of the modified pixel element, and the gate voltage of the supplementary transistor 40 is set by the LIGHT ENABLING line to turn off the light-emitting element 50.

Figure 24:
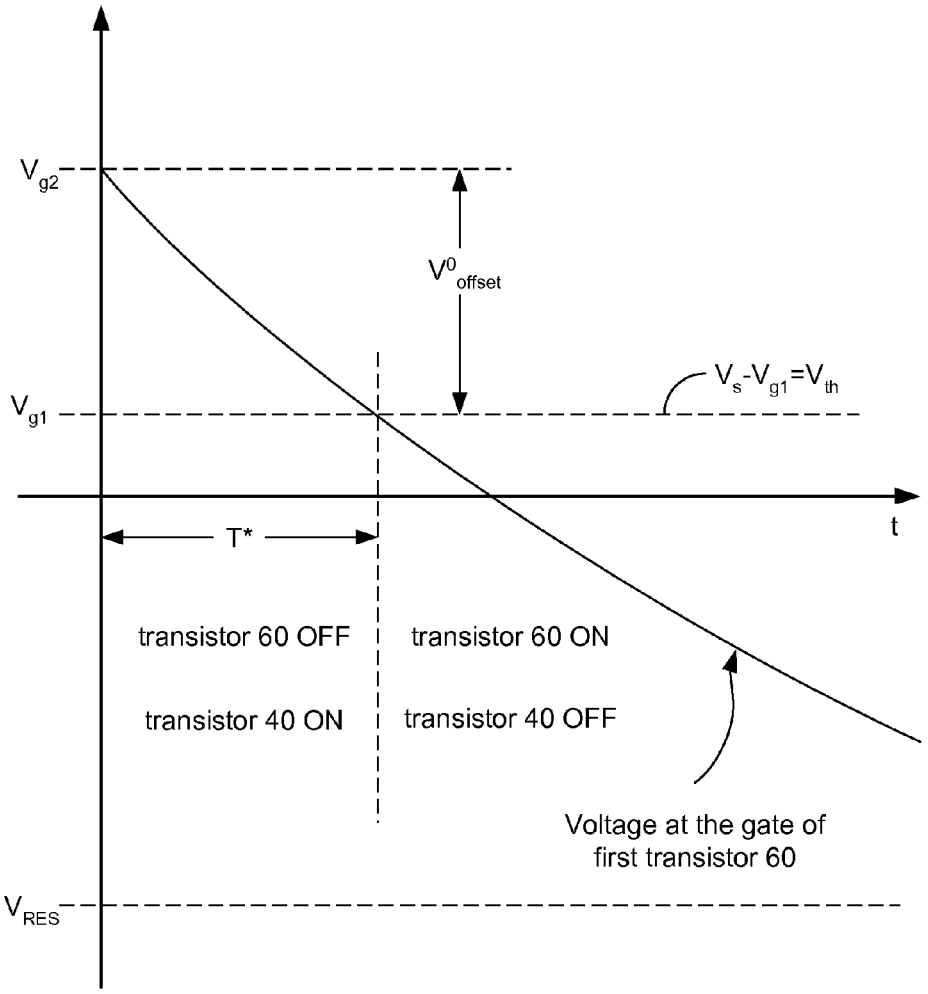
FIG. 24 shows the gate voltage of the first transistor in modified pixel elements of FIGS. 23A-23B during operation in accordance with some embodiments.

At the block 630, the decoupling transistor $T_{decouple}$ is turned on, the pixel sub-circuit 150 is directly connected to the semiconductor channel of the first transistor 60, and the gate voltage of the supplementary transistor 40 is set by the LIGHT ENABLING line to turn on the light-emitting element 50. As shown in FIG. 24, when the gate voltage of the first transistor 60 is changing because of the current passing through the resistive element 95, the bias voltage of the first transistor at time t linearly depend upon an exponential decaying function $\exp(-t/\tau)$, and such bias voltage changes towards the threshold voltage of the first transistor 60. At the block 640, when the gate voltage of the first transistor 60 reaches the voltage $V_{g1}$, the bias voltage of the first transistor 60 becoming substantially close to its threshold voltage $V_{th}$, the first transistor 60 is turned on; consequently, the current from the semiconductor channel of the first transistor 60 passes through the resistor 45 in the pixel sub-circuit 150 and causes a voltage change at the gate of the supplementary transistor 40. Such change of the gate voltage turns off the supplementary transistor 40 and terminates the light emitted from the light-emitting element 50.

Because the pixel element in FIG. 25A includes a sub-circuit that is functionally equivalent to the circuit as shown in FIG. 22A after the bias voltage is set at an offset from the threshold voltage, such a pixel element can be modified for driven with the method 600 of FIG. 19 by adding additional circuitry as shown in FIG. 23A. The modified pixel element in shown in FIG. 25B. In the modified pixel element, the transistor P2, the capacitor C2, and the transistor P4 are respectively functioning as the first transistor 60, the capacitor 30, and the decoupling transistor $T_{decouple}$. In addition to the pixel sub-circuit 150, the resistive element 95 is also added to the modified pixel element of FIG. 25B.

Figure 26B:
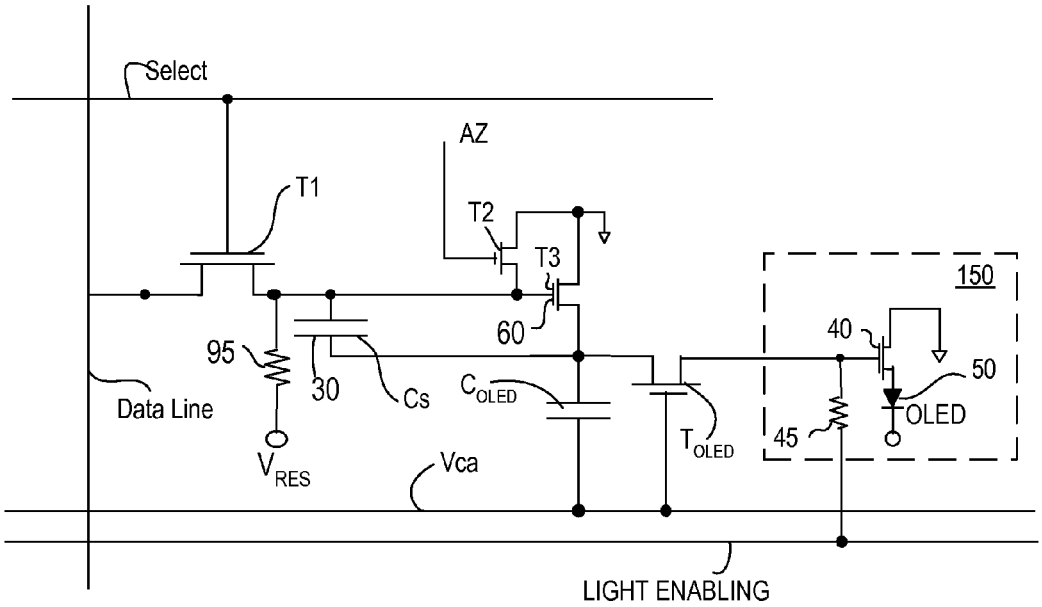

Similarly, because the pixel element in FIG. 26A includes a sub-circuit that is functionally equivalent to the circuit as shown in FIG. 22B after the bias voltage is set at an offset from the threshold voltage, such a pixel element can be modified for driven with the method 600 of FIG. 19 by adding additional circuitry as shown in FIG. 23B. The modified pixel element in shown in FIG. 26B. In the modified pixel element, the transistor T3 and the capacitor Cs are respectively functioning as the first transistor 60 and the capacitor 30. In addition to the decoupling transistor $T_{decouple}$ and the pixel sub-circuit 150, the resistive element 95 and the capacitor $C_{OLED}$ are also added to the modified pixel element of FIG. 26B.

In general, if a pixel element driven with the prior art method 400A of FIG. 21 includes a sub-circuit that is functionally equivalent to one of the sub-circuits as shown in FIGS. 22A-22F during the time period of light emitting, such pixel element generally can be modified for driven with the method 600 of FIG. 19. In addition to the modified pixel elements as shown in FIGS. 23A-23B, there are also other ways to modify the pixel element for driven it with the method 600 of FIG. 19. In the examples as shown in FIGS. 27A-27B, the modified pixel element can include a pixel sub-circuit 150 that is different from the corresponding sub-circuit 150 in FIGS. 23A-23B.

Figure 27A:
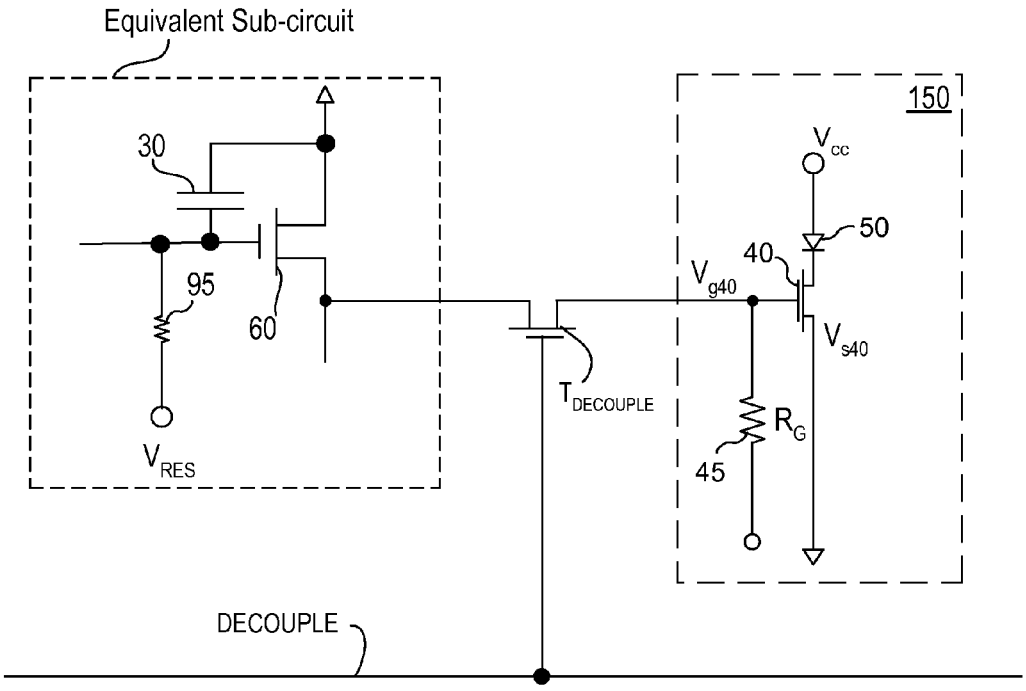
FIGS. 27A-27B are different implementations of the modified pixel element in accordance with some embodiments.
Figure 27B:
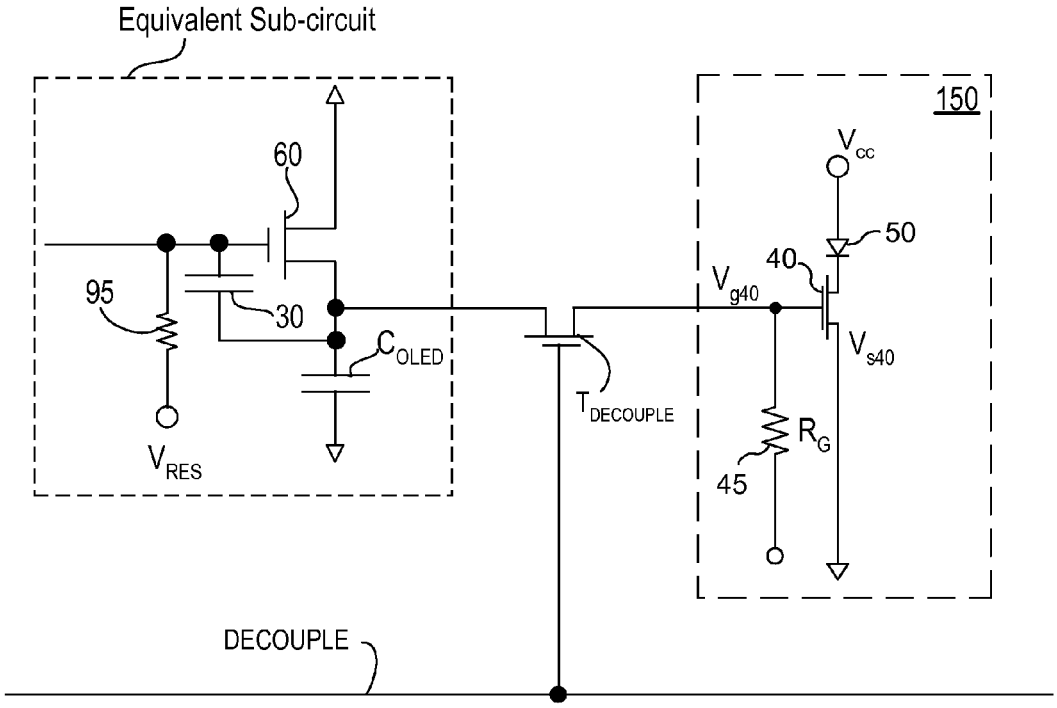
Figure 28:
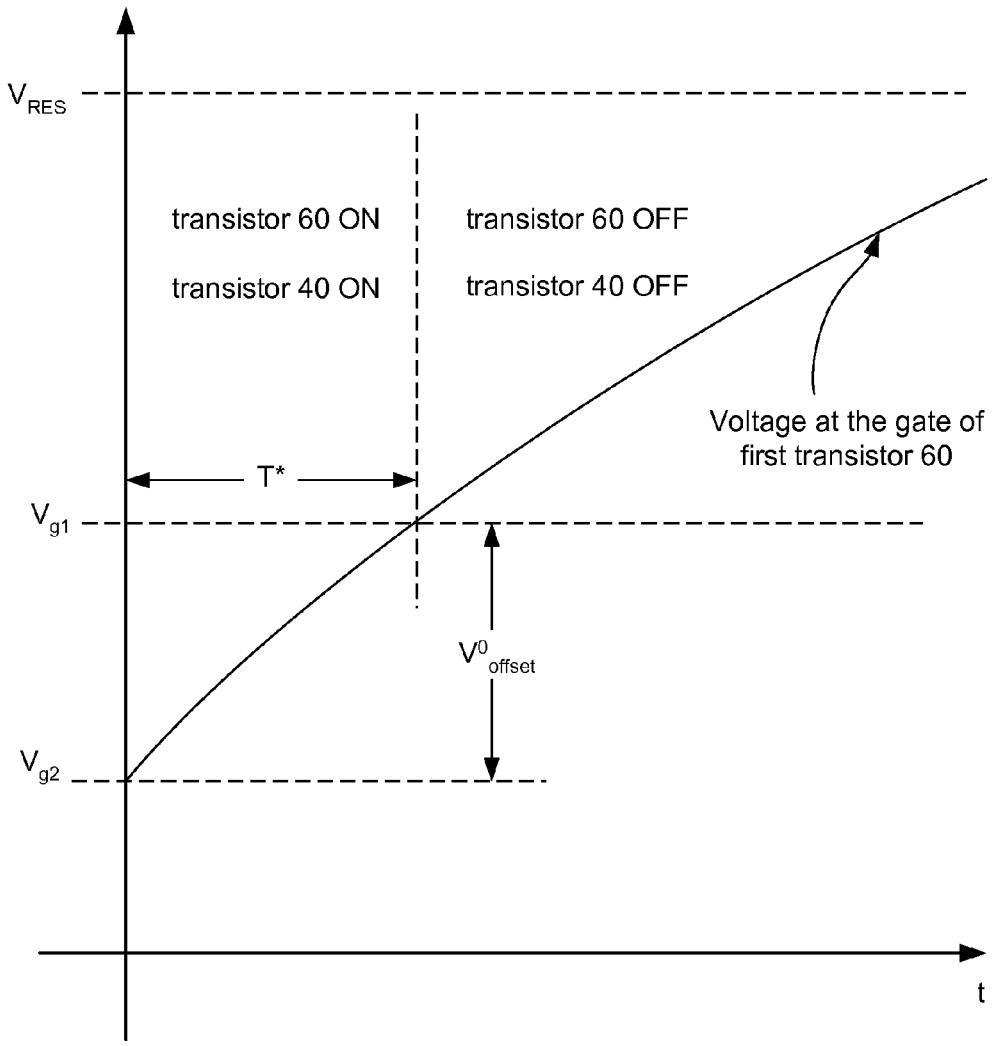
FIG. 28 shows the gate voltage of the first transistor in the modified pixel elements of FIGS. 27A-27B during operation in accordance with some embodiments.

When the modified pixel elements as shown in FIGS. 27A-27B is driven with the method 600 of FIG. 19, at the block 410 and the block 420, the decoupling transistor $T_{decouple}$ is turned off to decouple the pixel sub-circuit 150 from other parts of the modified pixel element, and the light-emitting element 50 is tuned off because the gate voltage of the supplementary transistor 40 is set by the resistor 45 as a pulling-down resistor. At the block 630, the first transistor 60 is turned on, the decoupling transistor $T_{decouple}$ is turned on, and the pixel sub-circuit 150 is directly connected to the semiconductor channel of the first transistor 60; consequently, the light-emitting element 50 is turned on when the gate voltage of the supplementary transistor 40 is raised by the current passing through the resistor 45 from the semiconductor channel of the first transistor. As shown in FIG. 28, when the gate voltage of the first transistor 60 is changing because of the current passing through the resistive element 95, the bias voltage of the first transistor at time t linearly depend upon an exponential decaying function exp(−t/τ), and such bias voltage changes towards the threshold voltage of the first transistor 60. At the block 640, when the gate voltage of the first transistor 60 reaches the voltage $V_{g1}$, the bias voltage of the first transistor 60 becoming substantially close to its threshold voltage $V_{th}$, the first transistor 60 is turned off; consequently, the current from the semiconductor channel of the first transistor 60 that passes through the resistor 45 in the pixel sub-circuit 150 is cutoff, which causes a voltage change at the gate of the supplementary transistor 40. Such change of the gate voltage turns off the supplementary transistor 40 and terminates the light emitted from the light-emitting element 50.

Figure 22D:
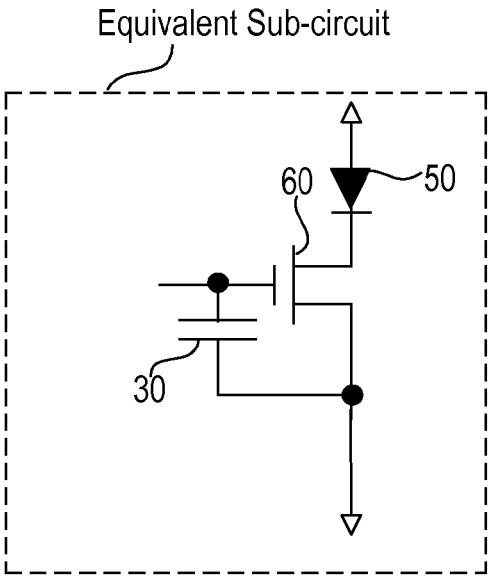
Figure 22E:
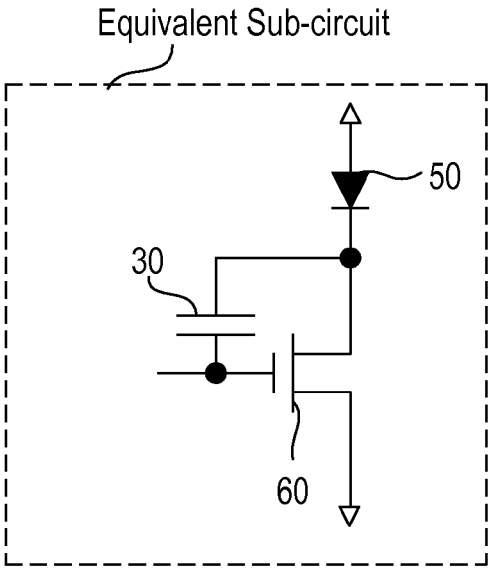
Figure 22F:
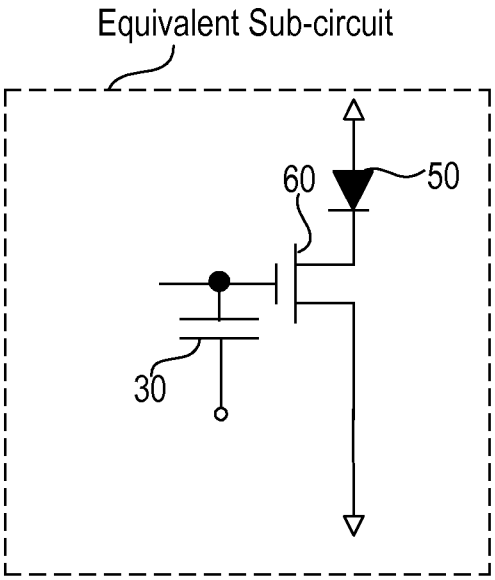
Figure 29:
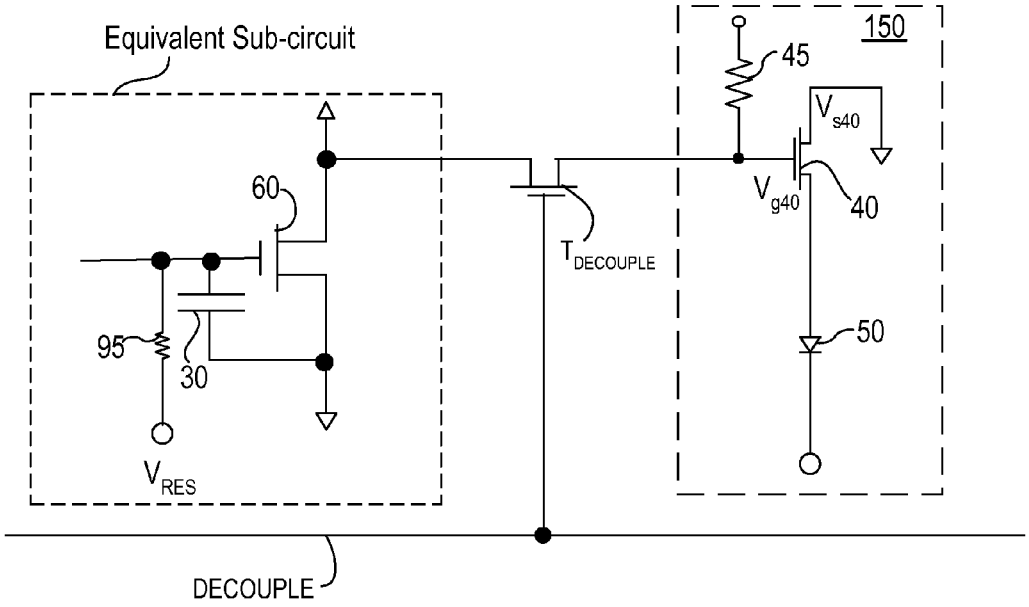
FIG. 29 shows another modified pixel element in accordance with some embodiments.
Figure 30:
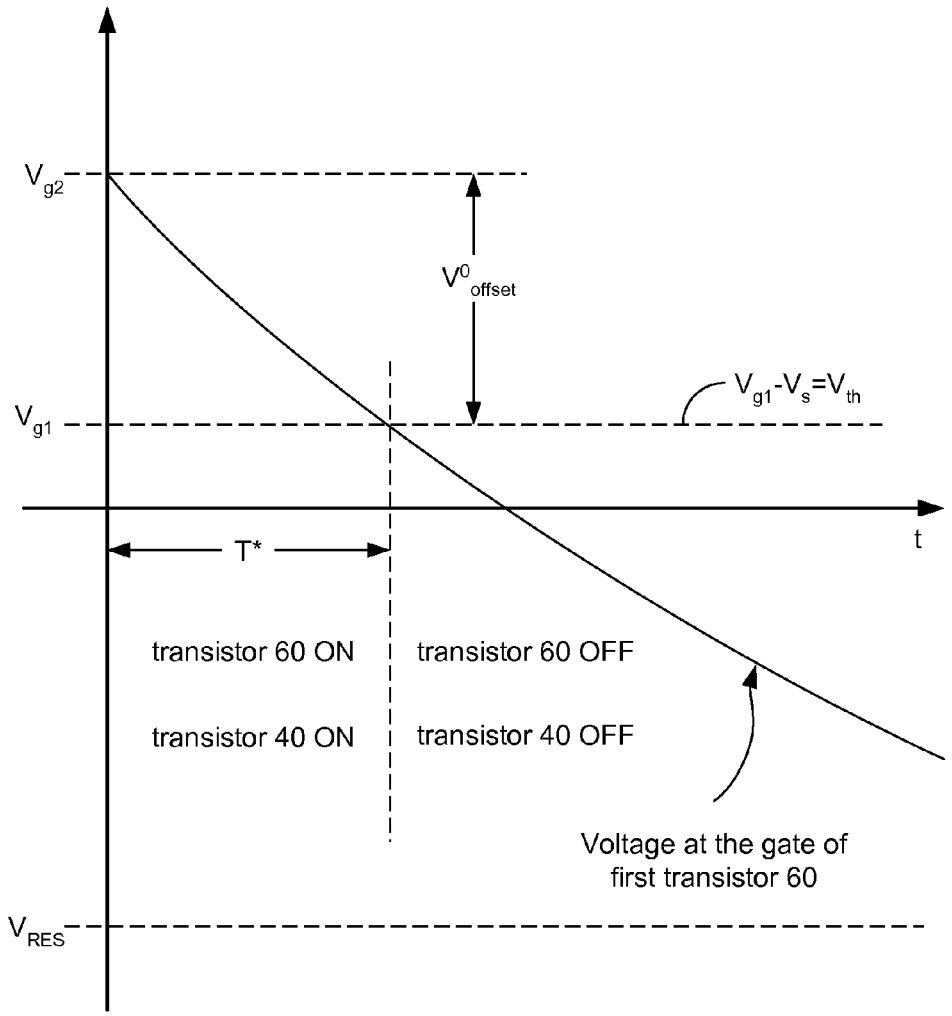
FIG. 30 shows the gate voltage of the first transistor in the modified pixel elements of FIG. 29 during operation in accordance with some embodiments.

As another example, FIG. 29 shows another modified pixel element that is modified from a pixel element having a functionally equivalent sub-circuit of FIG. 22D during the time period of light emitting. FIG. 30 shows the gate voltage of the first transistor 60 as a function of time when the method 600 is used for driving modified pixel element in FIG. 29 in accordance with some embodiments. Before the block 630 is carried out, the pixel sub-circuit 150 is decoupled from the first transistor 60, and the light-emitting element 50 is tuned off by a pulling-up resistor (i.e., the resistor 45). At the block 630, the first transistor 60 is turned on, the decoupling transistor $T_{decouple}$ is turned on, and the pixel sub-circuit 150 is directly connected to the semiconductor channel of the first transistor 60; consequently, the light-emitting element 50 is turned on when the gate voltage of the supplementary transistor 40 is lowered by the current passing through the resistor 45 from the semiconductor channel of the first transistor. At the block 630, after the first transistor 60 is turned on, the bias voltage of the first transistor 60 changes towards the threshold voltage of the first transistor 60 because of the current passing through the resistive element 95, and such bias voltage of the first transistor at time t linearly depends upon an exponential decaying function exp(−t/τ). At the block 640, when the gate voltage of the first transistor 60 reaches the voltage $V_{g1}$, the bias voltage of the first transistor 60 becomes substantially close to its threshold voltage $V_{th}$, and the first transistor 60 is turned off; consequently, the supplementary transistor 40 is tuned off, and the light emitted from the light-emitting element 50 is terminated.

In FIG. 20, FIG. 24, FIG. 28, and FIG. 30, the gate voltage of the first transistor 60 is a function of time. Once such function of time is determined, the time delay T* that the bias voltage of the first transistor 60 returns to its threshold voltage $V_{th}$ can be determined the gate voltages from $V_{g1}$ and the voltage $V_{g2}$. This time delay T* generally is not a linear function of the gate voltages $V_{g1}$ or the voltage $V_{g2}$, because the gate voltage of the first transistor 60 at time t does not linearly depend upon the time t; instead, this gate voltage of the first transistor 60 linearly depends upon an exponential decaying function exp(−t/τ).

Figure 31:
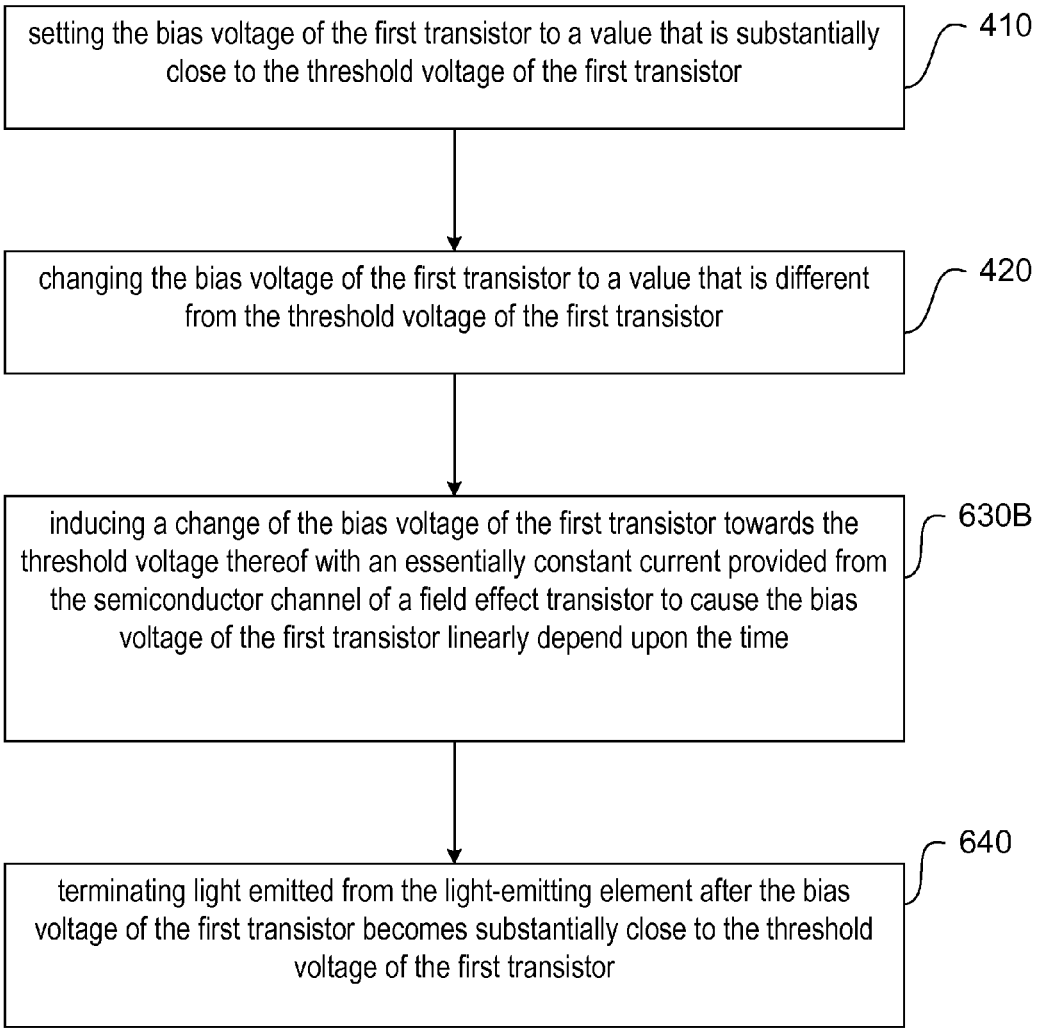
FIG. 31 shows a method for driving the modified pixel elements in accordance with some embodiments.

If the pixel elements disclosed previously is modified to make the gate voltage of the first transistor 60 at time t linearly depend upon the time t. Specifically, if the resistive element 95 in some of these pixel elements is replaced with a current source 195 having a constant current $I_{c0}$, the bias gate voltage of the first transistor 60 at time t can become linearly depend upon the time t. FIGS. 32A-32E illustrate some examples of these pixel elements after modification, and each of the modified pixel elements can be driven with the method 600B as shown in FIG. 31. The modified pixel element in FIG. 32A, FIG. 32B, FIG. 32C, FIG. 32D, and FIG. 32E is respectively modified from a corresponding pixel element in FIG. 15A, FIG. 15B, FIG. 23A, FIG. 23B, and FIG. 29, by substituting the resistive element 95 with a current source 195. In each of these modified pixel element as shown in the figures, the current source 195 is implemented with an FET with proper bias applied to its gate voltage to determine the constant current $I_{c0}$ in its semiconductor channel. Other implementations of the current source 195 are also possible. For example, the current source 195 can be implemented with a current-mirror device.

As shown in FIG. 31, the method 600B includes blocks 410, 420, 630B, and 640. The block 410 includes setting the bias voltage of the first transistor to a value that is substantially close to the threshold voltage of the first transistor. The block 420 includes changing the bias voltage of the first transistor to a value that is different from a threshold voltage of the first transistor. The block 630B inducing a change of the bias voltage of the first transistor towards the threshold voltage thereof with an essentially constant current provided from the semiconductor channel of a field effect transistor to cause the bias voltage of the first transistor linearly depend upon the time. Here, the essentially constant current is independent of the intensity of light emitted by the light-emitting element. In some implementations, the bias voltage of the first transistor linearly depends upon the time lapse since the light-emitting element starts to emit light at least during substantially entire time period that the light-emitting element is emitting light. The block 640 includes terminating light emitted from the light-emitting element after said inducing a change of the bias voltage of the first transistor causes the bias voltage of the first transistor becoming substantially close to the threshold voltage of the first transistor.

Figure 32A:
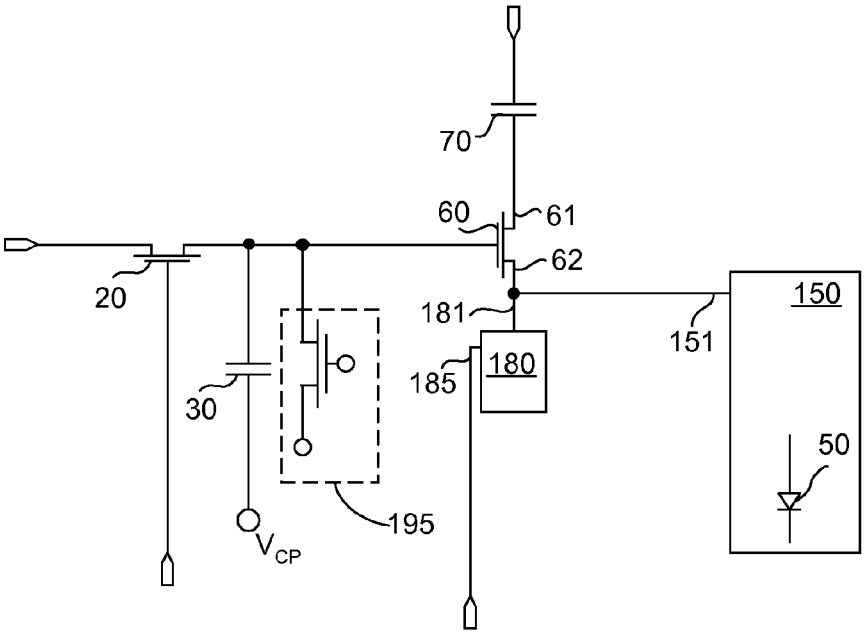
FIGS. 32A-32E illustrate some examples of modified pixel elements that can be driven with the method of FIG. 31.
Figure 32B:
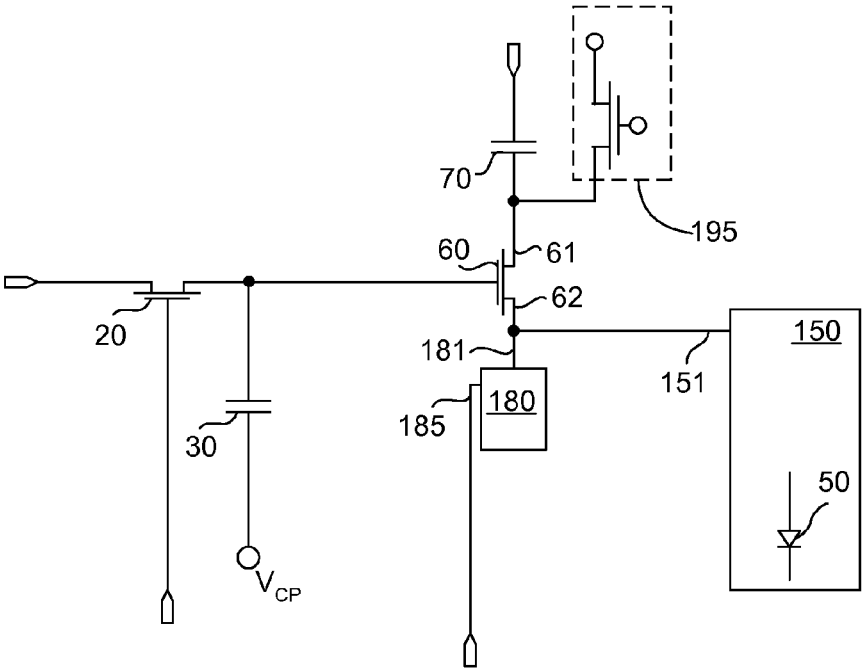
Figure 32C:
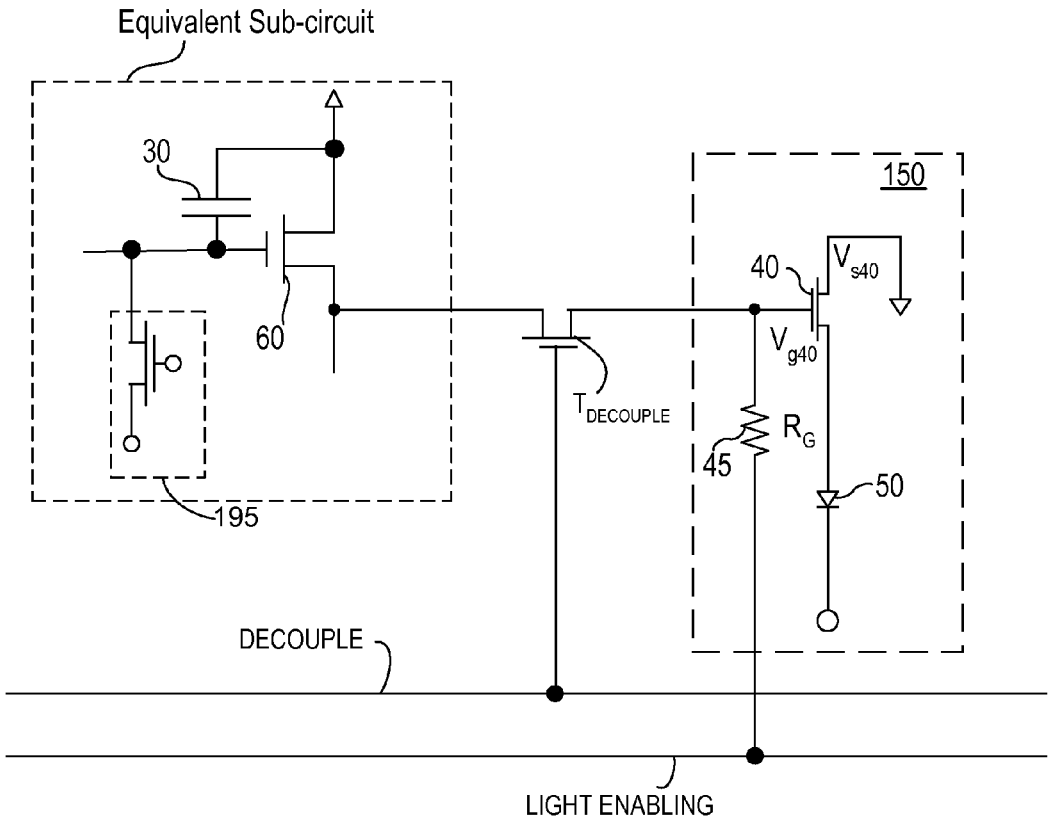
Figure 32D:
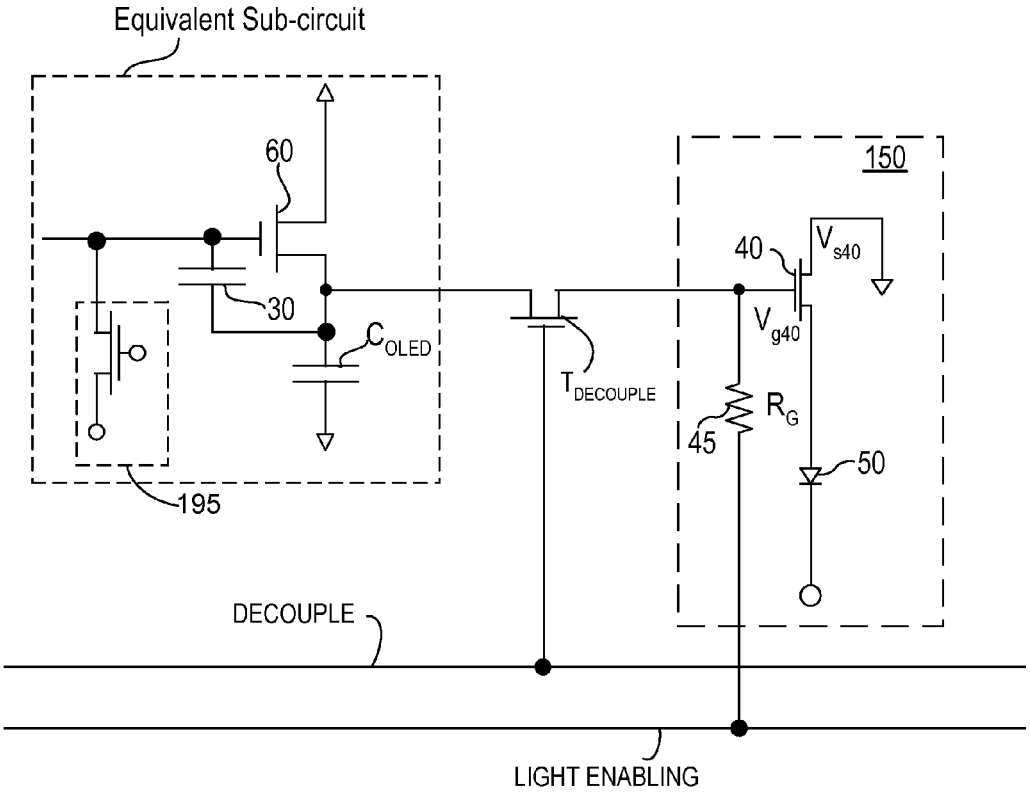
Figure 32E:
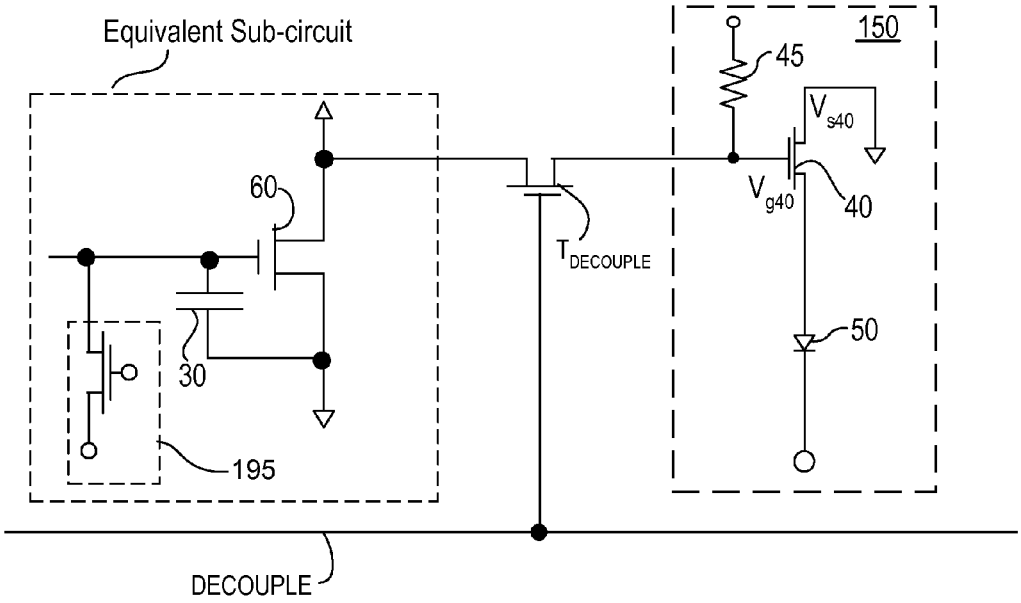
Figure 33:
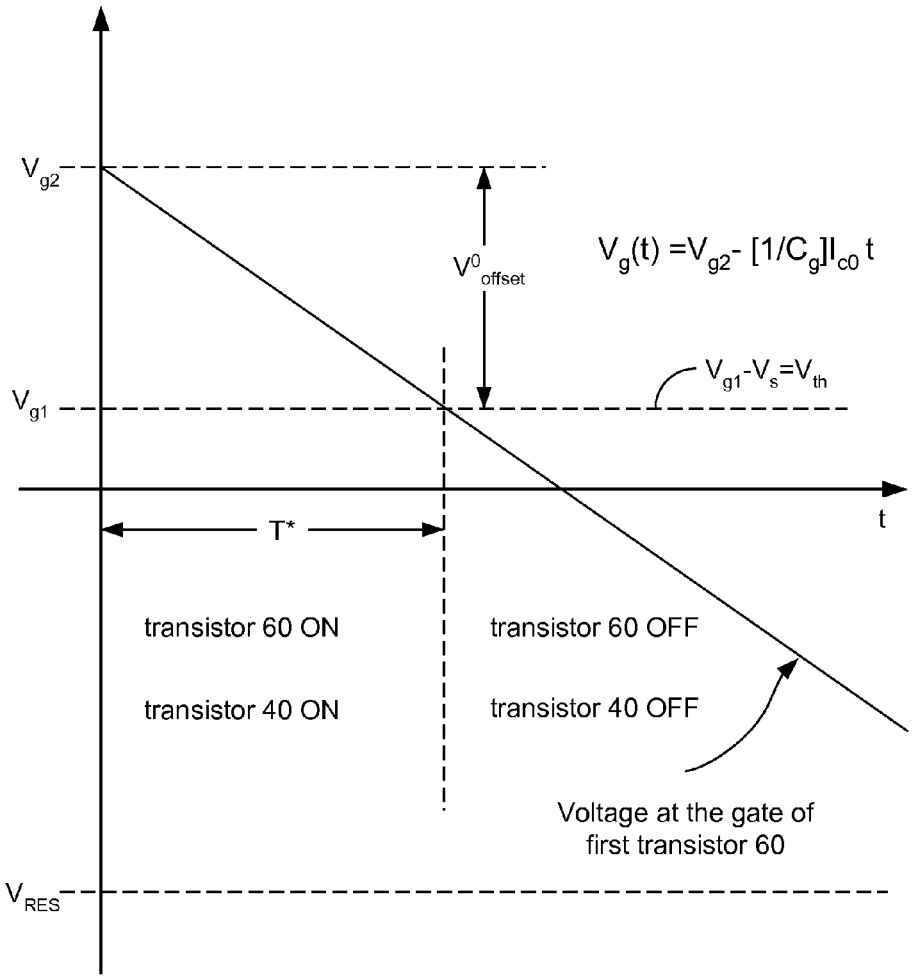
FIG. 33 shows the gate voltage of the first transistor in the modified pixel elements of FIG. 32E during operation in accordance with some embodiments.

FIG. 33 shows the gate voltage of the first transistor 60 when the method 600B in FIG. 31 is used for driving modified pixel element as shown in FIG. 32E in accordance with some embodiments. The gate voltage $V_g(t)$ of the first transistor 60 at time t is given by equation, $$V_g(t)=V_{g2}-[1/C_g]I_{c0}t$$

where $I_{c0}$ is the constant current in semiconductor channel of the FET in current source 195, and $C_g$ is the capacitance of the capacitive element 30. As shown in FIG. 33, during the time period that the gate voltage $V_g(t)$ of the first transistor 60 is above the voltage $V_{g1}$, the bias voltage of the first transistor 60 is above its threshold voltage $V_{th}$, and light is emitted from the light-emitting element 55. As the gate voltage $V_g(t)$ of the first transistor 60 decreases with time, at time T*, when the gate voltage $V_g(t)$ of the first transistor 60 changes back to the voltage $V_{g1}$, the bias voltage of the first transistor 60 changes back to the threshold voltage $V_{th}$ of the first transistor, and the light emitted from the light-emitting element 50 is terminated. The time T* linearly depend upon the voltage $V_{g2}$ and is given by the equation $$T^*=[V_{g2}-V_{g1}]C_g/I_{c0}.$$

In some implementations of the modified pixel element in FIG. 32E, the total amount of light $L_{total}$ is directly proportional to T*. Consequently, the total amount of light $L_{total}$ can be made to be linearly depending upon the voltage $V_{g2}$. The total amount of light $L_{total}$ can be easily set by the value of the voltage $V_{g2}$.

In FIGS. 23A-23B, FIGS. 27A-27B, and FIG. 29, the resistive element 95 can be replaced with a current source 195 in some embodiments to make the total amount of light $L_{total}$ linearly depending upon the voltage $V_{g2}$. In some other embodiments, the resistive element 95 can be replaced with a photo-detecting element 90 to make the total amount of light $L_{total}$ linearly depending upon the voltage difference $|V_{g2}-V_{g1}|$ when the photo-detecting element 90 is used to sample the intensity of light emitted by the light-emitting element.

The pixel elements and the methods for driving these pixel elements as described in this disclosure can be used to achieve gray levels for Binary Light Emitting Devices. FIG. 18A shows a pixel sub-circuit 150 that include a Binary Light Emitting Device in accordance with some embodiments. Such pixel sub-circuit 150 can be used in many of the pixel elements as described in this disclosure to achieve gray levels. Examples of Binary Light Emitting Devices include MEMS devices and devices based on ferroelectric LCD materials. Some of the Binary Light Emitting Devices can be used as high speed light shutters for using with Field Sequential Color technology to remove color filters in display panels. But, unfortunately, many Binary Light Emitting Devices also use Time-Divisional Multiplexing to achieve gray levels. Time-Divisional Multiplexing technology may need to be implemented with high speed electronics, which sometimes requires high mobility semiconductor materials, such as IGZO. Some of the pixel elements as described in this disclosure enable a Binary Light Emitting Device to achieve gray levels without using high speed electronics.

The methods for driving pixel elements as described in this disclosure can be used to drive pixel elements implemented with organic light emitting transistor (OLET). FIG. 18B shows a pixel sub-circuit 150 that include an OLET in accordance with some embodiments. Such pixel sub-circuit 150 can be used in many of the pixel elements as described in this disclosure. When these pixel elements are driven by the method described in this disclosure, possible threshold variations or threshold instability in the OLET can be compensated.

Both the method 600 in FIG. 19 and the method 600B in FIG. 31 include the block 640. The block 640 includes terminating light emitted from the light-emitting element after the bias voltage of the first transistor becomes substantially close to the threshold voltage of the first transistor. In some implementations, the block 640 includes sensing a current passing through the semiconductor channel of the first transistor with a high impedance component while the light-emitting element is emitting light. In some implementations, the block 640 includes inducing a voltage change at the gate of a supplementary transistor with a voltage change across a high impedance component caused by a change of the current passing through the semiconductor channel of the first transistor. Such a high impedance component can be a resistive element 45 as previously shown in the figures. In some implementations, the resistive element 45 can be provided with a resistor external to the supplementary transistor. In some implementations, the resistive element 45 can be provided with the intrinsic high impedance between the source and the gate of the supplementary transistor, and the external resistor can be discarded.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A method of driving a pixel element in a matrix of pixel elements of an active matrix display, the pixel element comprising (1) a first capacitive element, (2) a first transistor having a semiconductor channel, a first terminal of the semiconductor channel of the first transistor being electrically connected to a first terminal of the first capacitive element, and (3) a light-emitting element, wherein the first transistor is biased at a bias voltage between the gate of the first transistor and a first terminal of the semiconductor channel of the first transistor, the active matrix display comprising an array of column conducting lines and an array of row conducting lines crossing the array of column conducting lines, the method comprising:

setting the bias voltage of the first transistor to a value that is substantially close to a threshold voltage of the first transistor by changing a voltage across the first capacitive element with a current passing through the first transistor;

setting the bias voltage of the first transistor to a value that is different from the threshold voltage of the first transistor while substantially maintaining the voltage across the first capacitive element;

inducing a change of the bias voltage of the first transistor towards the threshold voltage thereof with an essentially constant current provided from the semiconductor channel of a field effect transistor to cause the bias voltage of the first transistor linearly depend upon the time, the essentially constant current being independent of the intensity of light emitted by the light-emitting element while the light-emitting element is emitting light; and terminating light emitted from the light-emitting element after said inducing a change of the bias voltage of the first transistor causes the bias voltage of the first transistor becoming substantially close to the threshold voltage of the first transistor.

2. The method of claim 1, wherein the pixel element further comprises a second transistor having a semiconductor channel operationally coupled to a second terminal of the semiconductor channel of the first transistor.

3. The method of claim 2, wherein the changing a voltage across the first capacitive element comprises:

(1) driving the semiconductor channel of the first transistor to a low-impedance state and (2) driving the semiconductor channel of the second transistor to a low-impedance state.

4. The method of claim 1, wherein the setting the bias voltage of the first transistor to a value that is substantially close to a threshold voltage of the first transistor by changing a voltage across the first capacitive element comprises:

(1) setting a voltage on the gate of the first transistor at a first gate-voltage value and (2) setting a voltage at a second terminal of the first capacitive element at a first reference-voltage value.

5. The method of claim 4, wherein the setting the bias voltage of the first transistor to a value that is different from the threshold voltage of the first transistor comprises:

(1) setting the voltage on the gate of the first transistor at a second gate-voltage value and (2) setting the voltage at the second terminal of the first capacitive element at a second reference-voltage value.

6. The method of claim 1, wherein the changing a voltage across the first capacitive element comprises:

(1) driving the semiconductor channel of the first transistor to a low-impedance state and (2) enabling current flow into or flow from the second terminal of the semiconductor channel of the first transistor.

7. The method of claim 1, wherein the substantially maintaining the voltage across the first capacitive element comprises:

driving the semiconductor channel of the first transistor to a high-impedance state.

8. The method of claim 1, wherein the substantially maintaining the voltage across the first capacitive element comprises:

substantially preventing current flow into or flow from the second terminal of the semiconductor channel of the first transistor.

9. A method of driving a pixel element in a matrix of pixel elements of an active matrix display, the pixel element comprising (1) a first capacitive element, (2) a first transistor having a semiconductor channel, and (3) a light-emitting element, wherein the first transistor is biased at a bias voltage between the gate of the first transistor and a first terminal of the semiconductor channel of the first transistor, the active matrix display comprising an array of column conducting lines and an array of row conducting lines crossing the array of column conducting lines, the method comprising:

changing the bias voltage of the first transistor to a value that is different from a threshold voltage of the first transistor;

emitting light from the light-emitting element while changing the bias voltage of the first transistor towards the threshold voltage thereof with an essentially constant current provided from the semiconductor channel of a field effect transistor to cause the bias voltage of the first transistor linearly depend upon the time lapse since the light-emitting element starts to emit light, the essentially constant current being independent of the intensity of light emitted by the light-emitting element; and terminating light emitted from the light-emitting element after the bias voltage of the first transistor becomes substantially close to the threshold voltage of the first transistor.

10. The method of claim 9, further comprising:

setting the bias voltage of the first transistor to a value that is substantially close to the threshold voltage of the first transistor before said changing the bias voltage of the first transistor to a value that is different.

11. A method of driving a pixel element in a matrix of pixel elements of an active matrix display, the pixel element comprising (1) a first capacitive element, (2) a first transistor having a semiconductor channel, and (3) a light-emitting element, wherein the first transistor is biased at a bias voltage between the gate of the first transistor and a first terminal of the semiconductor channel of the first transistor, the active matrix display comprising an array of column conducting lines and an array of row conducting lines crossing the array of column conducting lines, the method comprising:

changing the bias voltage of the first transistor to a value that is different from a threshold voltage of the first transistor;

inducing a change of the bias voltage of the first transistor towards the threshold voltage thereof with an essentially constant current provided from the semiconductor channel of a field effect transistor to cause the bias voltage of the first transistor linearly depend upon the time, the essentially constant current being independent of the intensity of light emitted by the light-emitting element while the light-emitting element is emitting light; and terminating light emitted from the light-emitting element after said inducing a change of the bias voltage of the first transistor causes the bias voltage of the first transistor becoming substantially close to the threshold voltage of the first transistor.

12. The method of claim 11, wherein said changing the bias voltage of the first transistor comprises:

changing the bias voltage of the first transistor to a value that is different from a threshold voltage of the first transistor after a step of setting the bias voltage of the first transistor to a value that is substantially close to the threshold voltage of the first transistor by changing a voltage across the first capacitive element with a current passing through the first transistor.

13. The method of claim 11, wherein said terminating light emitted from the light-emitting element comprises:

sensing a current passing through the semiconductor channel of the first transistor with a high impedance component while the light-emitting element is emitting light.

14. The method of claim 11, wherein said terminating light emitted from the light-emitting element comprises:

inducing a voltage change at the gate of a supplementary transistor with a change of the current passing through the semiconductor channel of the first transistor.

15. The method of claim 11, wherein said terminating light emitted from the light-emitting element comprises:

inducing a voltage change at the gate of a supplementary transistor with a voltage change across a high impedance component caused by a change of the current passing through the semiconductor channel of the first transistor.

16. The method of claim 15, wherein the light-emitting element is electrically connected with the semiconductor channel of the supplementary transistor for causing the current passing through the light-emitting element depend upon the voltage at the gate of a supplementary transistor.

17. The method of claim 15, wherein the light-emitting element is electrically connected with the semiconductor channel of the supplementary transistor for causing the voltage across the light-emitting element depend upon the voltage at the gate of the supplementary transistor.

18. The method of claim 11, and wherein said terminating light emitted from the light-emitting element comprises:

inducing a voltage change across the light-emitting element with a change of the current passing through the semiconductor channel of the first transistor.

19. The method of claim 11, and wherein said terminating light emitted from the light-emitting element comprises:

inducing a voltage change across the light-emitting element with a voltage change across a high impedance component caused by a change of the current passing through the semiconductor channel of the first transistor.

20. The method of claim 11, wherein:

the bias voltage of the first transistor linearly depend upon the time lapse since the light-emitting element starts to emit light at least during substantially entire time period that the light-emitting element is emitting light.

* * * * *